US008805697B2

(12) United States Patent
Visser et al.

(10) Patent No.: US 8,805,697 B2
(45) Date of Patent: Aug. 12, 2014

(54) DECOMPOSITION OF MUSIC SIGNALS USING BASIS FUNCTIONS WITH TIME-EVOLUTION INFORMATION

(75) Inventors: Erik Visser, San Diego, CA (US); Yinyi Guo, Stanford, CA (US); Mofei Zhu, Stanford, CA (US); Sang-Uk Ryu, San Diego, CA (US); Lae-Hoon Kim, San Diego, CA (US); Jongwon Shin, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 386 days.

(21) Appl. No.: 13/280,295

(22) Filed: Oct. 24, 2011

(65) Prior Publication Data

US 2012/0101826 A1 Apr. 26, 2012

Related U.S. Application Data

(60) Provisional application No. 61/406,376, filed on Oct. 25, 2010.

(51) Int. Cl.
*G10L 19/00* (2013.01)

(52) U.S. Cl.
USPC ..... 704/501; 704/212; 704/219; 704/264; 704/500; 381/94.1; 381/23

(58) Field of Classification Search
CPC ..... G10L 25/90; G10L 13/033; G10L 25/00; G10L 19/012; G10L 19/16; G10L 19/24; G10L 19/22; G10L 19/173; G10L 21/0272; G10L 21/0208; G10L 21/038; H04S 3/008; G10H 1/0091; G10H 2250/111; G10H 2210/301
USPC ..... 381/119, 17, 23, 94.1; 704/278, 704/500–504, 212, 219, 264, 203
See application file for complete search history.

(56) References Cited

U.S. PATENT DOCUMENTS

| | | | | |
|---|---|---|---|---|
| 6,691,082 | B1 * | 2/2004 | Aguilar et al. | 704/219 |
| 7,505,902 | B2 | 3/2009 | Mesgarani et al. | |
| 7,612,275 | B2 | 11/2009 | Seppanen et al. | |
| 7,626,112 | B2 | 12/2009 | Miyajima | |
| 7,772,478 | B2 | 8/2010 | Whitman et al. | |

(Continued)

FOREIGN PATENT DOCUMENTS

| | | | |
|---|---|---|---|
| CN | 1658283 | A | 8/2005 |
| CN | 1831554 | A | 9/2006 |
| CN | 101398475 | A | 4/2009 |

OTHER PUBLICATIONS

Abdallah S. A., et al., "Unsupervised Analysis of Polyphonic Music by Sparse Coding", IEEE Transactions on Neural Networks, vol. 17, No. 1, Jan. 1, 2006, pp. 179-196, XP55015161, ISSN: 1045-9227, DOI: 10.1109/TNN.2005.861031 abstract figures 5,6,8,10,11 p. 180, left-hand column, lines 3-15 p. 180, section L A , lines 3-13 p. 182, section 111, lines 2-4 and 48-50 p. 185, left-hand column, lines 9-27 section 1V.C p. 190, left-hand column, lines 7-23 section V.D.

(Continued)

*Primary Examiner* — Vijay B Chawan
(74) *Attorney, Agent, or Firm* — Austin Rapp & Hardman

(57) ABSTRACT

Decomposition of a multi-source signal using a basis function inventory and a sparse recovery technique is disclosed.

43 Claims, 48 Drawing Sheets

(56) References Cited

U.S. PATENT DOCUMENTS

| | | | | |
|---|---|---|---|---|
| 7,842,874 | B2 | 11/2010 | Jehan | |
| 7,953,604 | B2 * | 5/2011 | Mehrotra et al. | 704/500 |
| 7,996,233 | B2 * | 8/2011 | Oshikiri | 704/500 |
| 8,190,425 | B2 * | 5/2012 | Mehrotra et al. | 704/203 |
| 2001/0044719 | A1 | 11/2001 | Casey | |
| 2007/0124138 | A1 * | 5/2007 | Lamblin et al. | 704/212 |
| 2007/0160216 | A1 * | 7/2007 | Nicol et al. | 381/17 |
| 2007/0172071 | A1 * | 7/2007 | Mehrotra et al. | 381/23 |
| 2007/0174063 | A1 * | 7/2007 | Mehrotra et al. | 704/501 |
| 2009/0022336 | A1 | 1/2009 | Visser et al. | |
| 2009/0190780 | A1 * | 7/2009 | Nagaraja et al. | 381/119 |
| 2009/0192791 | A1 * | 7/2009 | El-Maleh et al. | 704/219 |
| 2009/0192803 | A1 * | 7/2009 | Nagaraja et al. | 704/278 |
| 2009/0306797 | A1 | 12/2009 | Cox et al. | |
| 2010/0131086 | A1 | 5/2010 | Itoyama et al. | |
| 2011/0015931 | A1 * | 1/2011 | Kawahara et al. | 704/264 |
| 2011/0313777 | A1 * | 12/2011 | Baeckstroem et al. | 704/500 |

OTHER PUBLICATIONS

International Search Report and Written Opinion—PCT/US2011/057712—ISA/EPO—Dec. 29, 2011.

Michael Syskind Pedersen et al: "A Survey of Convolutive Blind Source Separation Methods" In: "Springer Handbook on Speech Processing and Speech Communication", Jan. 1, 2007, Springer, XP55015264, ISBN: 978-3-54-049125-5, pp. 1-34, sections 5.2.2, 5.3.

Cont, A. et al "Realtime Multiple-Pitch and Multiple-Instrument Recognition for Music Signals Using Sparse Non-Negative Constraints." Sep. 30, 2010.

Dessein, Arnaud. "Incremental Multi-Source Recognition with Non-Negative Matrix Factorization." Centre Pompidou. pp. 1-57. Jun. 2009.

Plumbley, M. et al. "Musical Audio Analysis Using Sparse Representations." Compstat 2006—Proceedings in Computational Statistics 2006, Part II, 105-117.

* cited by examiner

| Piano-flute Test Case | SIR (p/f) dB | SAR(p/f) dB | SDR(p/f) dB |
|---|---|---|---|
| 1. Different octave same timbre | 31.73/ 44.67 | 8.12/ 9.56 | 8.09/ 9.56 |
| 2. Same octave same timbre | 19.49/ 35.73 | 7.89/ 7.23 | 7.56/ 7.22 |
| 3. Different octave different timbre | 26.97/ 24.12 | 3.58/ 6.13 | 3.55/ 6.05 |
| 4. Same octave different timbre | 21.67/ 3.71 | 6.17/ 0.43 | 6.02/ -2.34 |

DECOMPOSITION OF MUSIC SIGNALS USING BASIS FUNCTIONS WITH TIME-EVOLUTION INFORMATION

CLAIM OF PRIORITY UNDER 35 U.S.C. §119

The present Application for Patent claims priority to Provisional Application No. 61/406,376, entitled "CASA (COMPUTATIONAL AUDITORY SCENE ANALYSIS) FOR MUSIC APPLICATIONS: DECOMPOSITION OF MUSIC SIGNALS USING BASIS FUNCTION INVENTORY AND SPARSE RECOVERY," filed Oct. 25, 2010, and assigned to the assignee hereof.

BACKGROUND

1. Field

This disclosure relates to audio signal processing.

2. Background

Many music applications on portable devices (e.g., smartphones, netbooks, laptops, tablet computers) or video game consoles are available for single-user cases. In these cases, the user of the device hums a melody, sings a song, or plays an instrument while the device records the resulting audio signal. The recorded signal may then be analyzed by the application for its pitch/note contour, and the user can select processing operations, such as correcting or otherwise altering the contour, upmixing the signal with different pitches or instrument timbres, etc. Examples of such applications include the QUSIC application (QUALCOMM Incorporated, San Diego, Calif.); video games such as Guitar Hero and Rock Band (Harmonix Music Systems, Cambridge, Mass.); and karaoke, one-man-band, and other recording applications.

Many video games (e.g., Guitar Hero, Rock Band) and concert music scenes may involve multiple instruments and vocalists playing at the same time. Current commercial game and music production systems require these scenarios to be played sequentially or with closely positioned microphones to be able to analyze, post-process and upmix them separately. These constraints may limit the ability to control interference and/or to record spatial effects in the case of music production and may result in a limited user experience in the case of video games.

SUMMARY

A method of decomposing an audio signal according to a general configuration includes calculating, for each of a plurality of segments in time of the audio signal, a corresponding signal representation over a range of frequencies. This method also includes calculating a vector of activation coefficients, based on the plurality of calculated signal representations and on a plurality of basis functions. In this method, each activation coefficient of the vector corresponds to a different basis function of the plurality of basis functions, and each of the plurality of basis functions comprises a first corresponding signal representation over the range of frequencies and a second corresponding signal representation over the range of frequencies that is different than said first corresponding signal representation. Computer-readable storage media (e.g., non-transitory media) having tangible features that cause a machine reading the features to perform such a method are also disclosed.

An apparatus for decomposing an audio signal according to a general configuration includes means for calculating, for each of a plurality of segments in time of the audio signal, a corresponding signal representation over a range of frequencies; and means for calculating a vector of activation coefficients, based on the plurality of calculated signal representations and on a plurality of basis functions. In this apparatus, each activation coefficient of the vector corresponds to a different basis function of the plurality of basis functions, and each of the plurality of basis functions comprises a first corresponding signal representation over the range of frequencies and a second corresponding signal representation over the range of frequencies that is different than said first corresponding signal representation.

An apparatus for decomposing an audio signal according to another general configuration includes a transform module configured to calculate, for each of a plurality of segments in time of the audio signal, a corresponding signal representation over a range of frequencies; and a coefficient vector calculator configured to calculate a vector of activation coefficients, based on the plurality of calculated signal representations and on a plurality of basis functions. In this apparatus, each activation coefficient of the vector corresponds to a different basis function of the plurality of basis functions, and each of the plurality of basis functions comprises a first corresponding signal representation over the range of frequencies and a second corresponding signal representation over the range of frequencies that is different than said first corresponding signal representation.

DETAILED DESCRIPTION

Figure 1A:
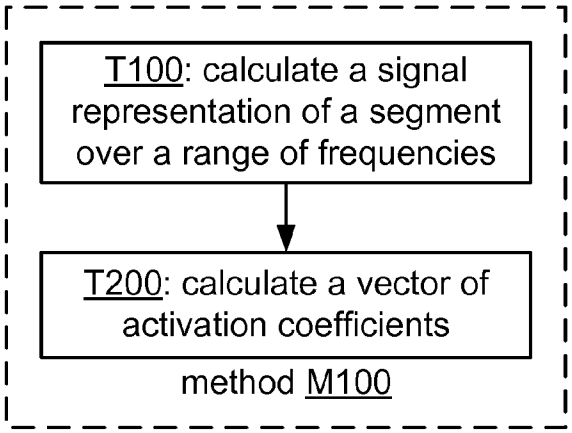
FIG. 1A shows a flowchart of a method M100 according to a general configuration.

Decomposition of an audio signal using a basis function inventory and a sparse recovery technique is disclosed, wherein the basis function inventory includes information relating to the changes in the spectrum of a musical note over the pendency of the note. Such decomposition may be used to support analysis, encoding, reproduction, and/or synthesis of the signal. Examples of quantitative analyses of audio signals that include mixtures of sounds from harmonic (i.e., non-percussive) and percussive instruments are shown herein.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases (e.g., base two) are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion. Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, the term "plurality" is used herein to indicate an integer quantity that is greater than one.

A method as described herein may be configured to process the captured signal as a series of segments. Typical segment lengths range from about five or ten milliseconds to about forty or fifty milliseconds, and the segments may be overlapping (e.g., with adjacent segments overlapping by 25% or 50%) or nonoverlapping. In one particular example, the signal is divided into a series of nonoverlapping segments or "frames", each having a length of ten milliseconds. A segment as processed by such a method may also be a segment (i.e., a "subframe") of a larger segment as processed by a different operation, or vice versa.

It may be desirable to decompose music scenes to extract individual note/pitch profiles from a mixture of two or more instrument and/or vocal signals. Potential use cases include taping concert/video game scenes with multiple microphones, decomposing musical instruments and vocals with spatial/sparse recovery processing, extracting pitch/note profiles, partially or completely up-mixing individual sources with corrected pitch/note profiles. Such operations may be used to extend the capabilities of music applications (e.g., Qualcomm's QUSIC application, video games such as Rock Band or Guitar Hero) to multi-player/singer scenarios.

Figure 15:
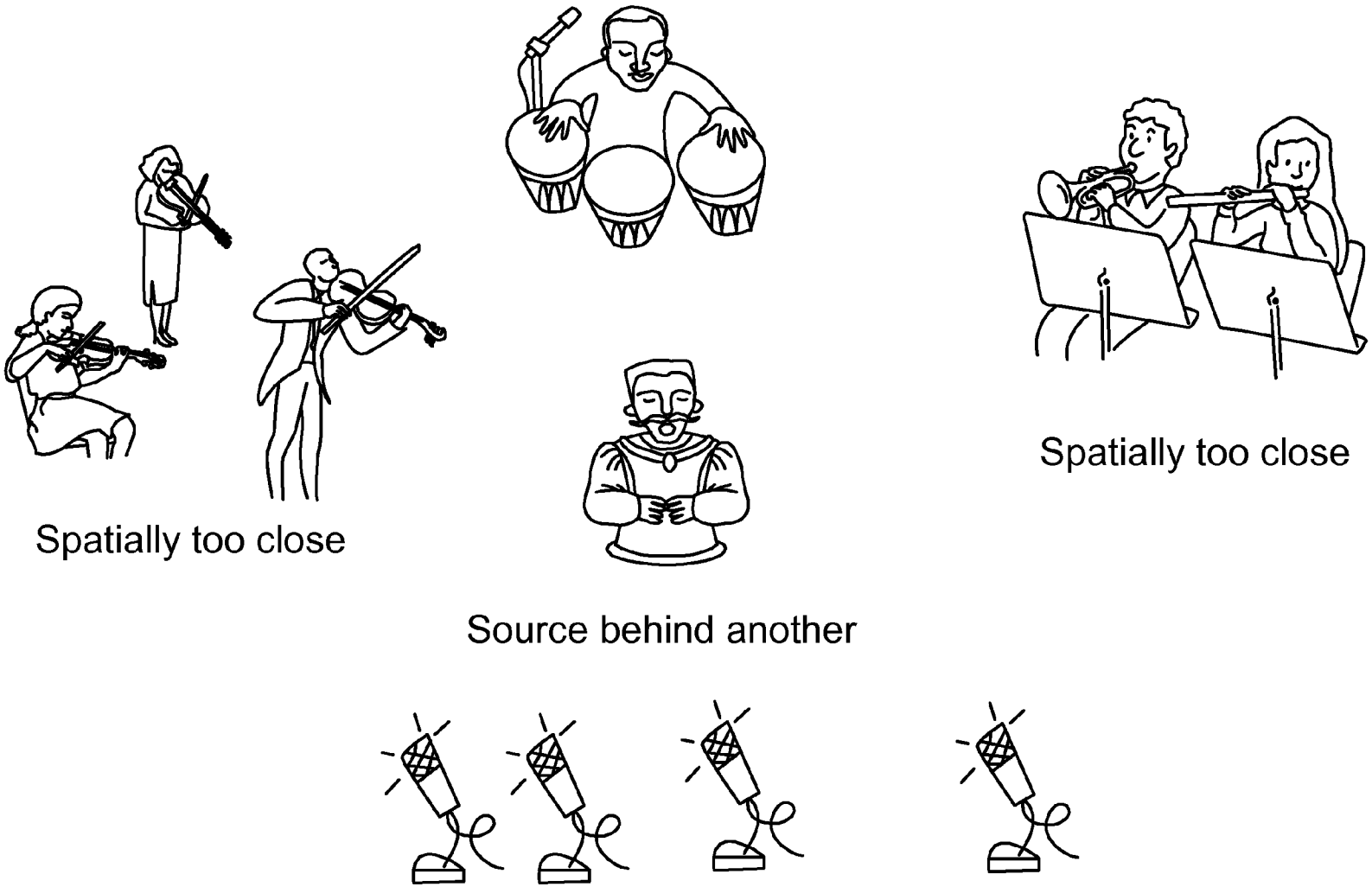
FIG. 15 illustrates a scenario in which multiple sound sources are active.

It may be desirable to enable a music application to process a scenario in which more than one vocalist is active and/or multiple instruments are played at the same time (e.g., as shown in FIG. 15). Such capability may be desirable to support a realistic music-taping scenario (multi-pitch scene). Although a user may want the ability to edit and resynthesize each source separately, producing the sound track may entail recording the sources at the same time.

This disclosure describes methods that may be used to enable a use case for a music application in which multiple sources may be active at the same time. Such a method may be configured to analyze an audio mixture signal using basis-function inventory-based sparse recovery (e.g., sparse decomposition) techniques.

It may be desirable to decompose mixture signal spectra into source components by finding the sparsest vector of activation coefficients (e.g., using efficient sparse recovery algorithms) for a set of basis functions. The activation coefficient vector may be used (e.g., with the set of basis functions) to reconstruct the mixture signal or to reconstruct a selected part (e.g., from one or more selected instruments) of the mixture signal. It may also be desirable to post-process the sparse coefficient vector (e.g., according to magnitude and time support).

FIG. 1A shows a flowchart for a method M100 of decomposing an audio signal according to a general configuration. Method M100 includes a task T100 that calculates, based on information from a frame of the audio signal, a corresponding signal representation over a range of frequencies. Method M100 also includes a task T200 that calculates a vector of activation coefficients, based on the signal representation calculated by task T100 and on a plurality of basis functions, in which each of the activation coefficients corresponds to a different one of the plurality of basis functions.

Task T100 may be implemented to calculate the signal representation as a frequency-domain vector. Each element of such a vector may indicate the energy of a corresponding one of a set of subbands, which may be obtained according to a mel or Bark scale. However, such a vector is typically calculated using a discrete Fourier transform (DFT), such as a fast Fourier transform (FFT), or a short-time Fourier transform (STFT). Such a vector may have a length of, for example, 64, 128, 256, 512, or 1024 bins. In one example, the audio signal has a sampling rate of eight kHz, and the 0-4 kHz band is represented by a frequency-domain vector of 256 bins for each frame of length 32 milliseconds. In another example, the signal representation is calculated using a modified discrete cosine transform (MDCT) over overlapping segments of the audio signal.

In a further example, task T100 is implemented to calculate the signal representation as a vector of cepstral coefficients (e.g., mel-frequency cepstral coefficients or MFCCs) that represents the short-term power spectrum of the frame. In this case, task T100 may be implemented to calculate such a vector by applying a mel-scale filter bank to the magnitude of a DFT frequency-domain vector of the frame, taking the logarithm of the filter outputs, and taking a DCT of the logarithmic values. Such a procedure is described, for example, in the Aurora standard described in ETSI document ES 201 108, entitled "STQ: DSR—Front-end feature extraction algorithm; compression algorithm" (European Telecommunications Standards Institute, 2000).

Musical instruments typically have well-defined timbres. The timbre of an instrument may be described by its spectral envelope (e.g., the distribution of energy over a range of frequencies), such that a range of timbres of different musical instruments may be modeled using an inventory of basis functions that encode the spectral envelopes of the individual instruments.

Each basis function comprises a corresponding signal representation over a range of frequencies. It may be desirable for each of these signal representations to have the same form as the signal representation calculated by task T100. For example, each basis function may be a frequency-domain vector of length 64, 128, 256, 512, or 1024 bins. Alternatively, each basis function may be a cepstral-domain vector, such as a vector of MFCCs. In a further example, each basis function is a wavelet-domain vector.

The basis function inventory A may include a set $A_n$ of basis functions for each instrument n (e.g., piano, flute, guitar, drums, etc.). For example, the timbre of an instrument is generally pitch-dependent, such that the set $A_n$ of basis functions for each instrument n will typically include at least one basis function for each pitch over some desired pitch range, which may vary from one instrument to another. A set of basis functions that corresponds to an instrument tuned to the chromatic scale, for example, may include a different basis function for each of the twelve pitches per octave. The set of basis functions for a piano may include a different basis function for each key of the piano, for a total of eighty-eight basis functions. In another example, the set of basis functions for each instrument includes a different basis function for each pitch in a desired pitch range, such as five octaves (e.g., 56 pitches) or six octaves (e.g., 67 pitches). These sets $A_n$ of basis functions may be disjoint, or two or more sets may share one or more basis functions.

Figure 6:
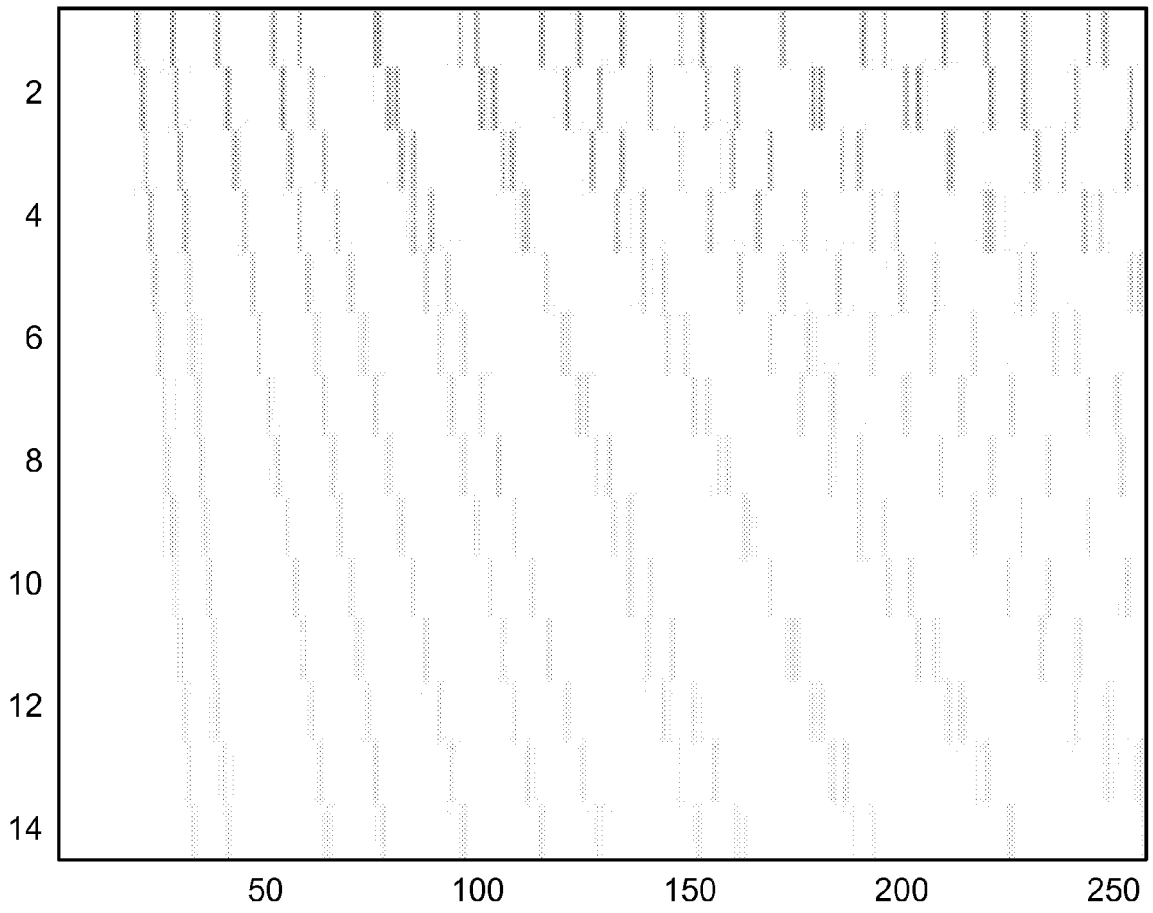
FIG. 6 shows a second example of a basis function inventory.
Figure 7:
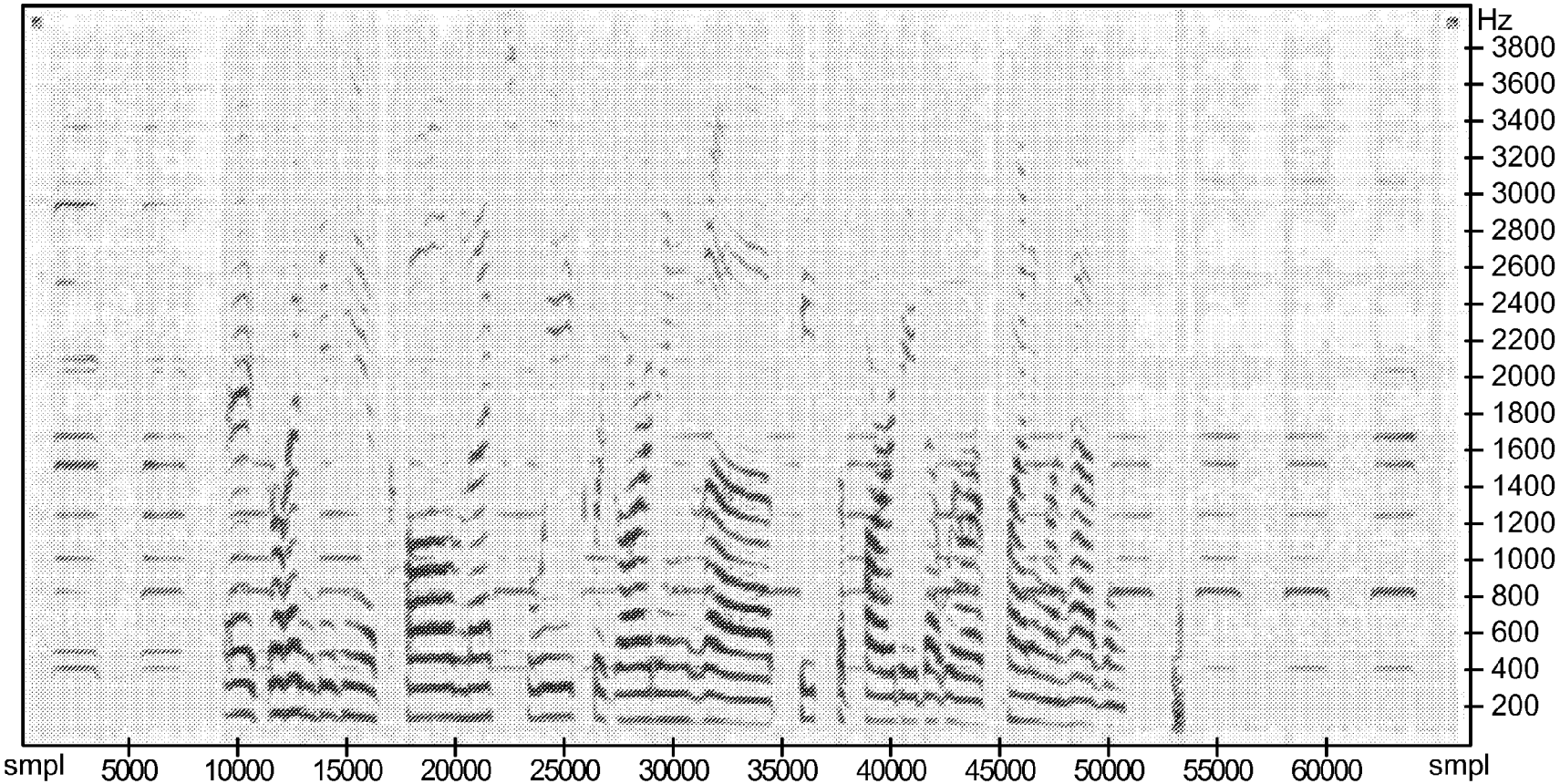
FIG. 7 shows a spectrogram of speech with a harmonic honk.
Figure 8:
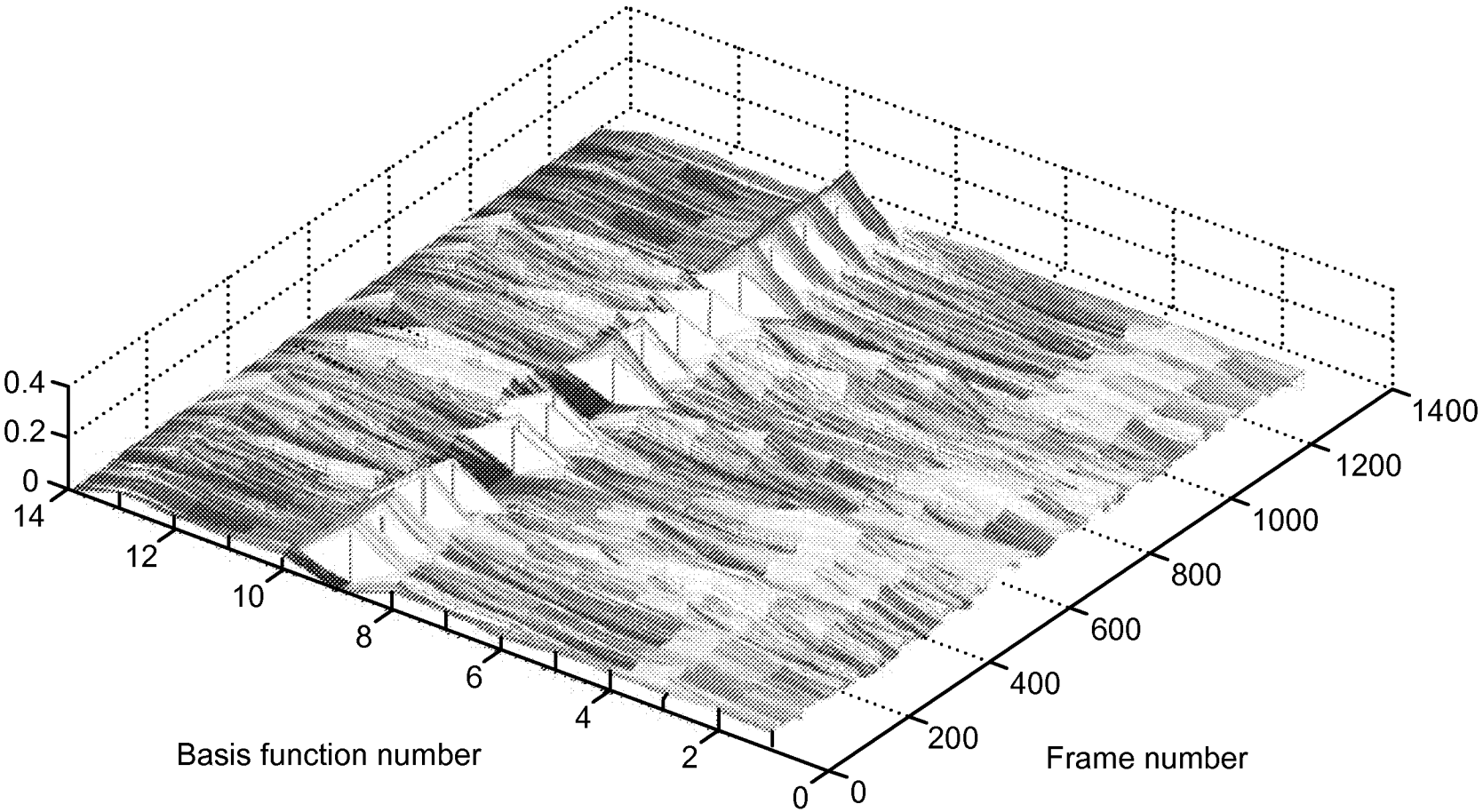
FIG. 8 shows a sparse representation of the spectrogram of FIG. 7 in the inventory of FIG. 6.

FIG. 6 shows an example of a plot (pitch index vs. frequency) for a set of fourteen basis functions for a particular harmonic instrument, in which each basis function of the set encodes a timbre of the instrument at a different corresponding pitch. In the context of a musical signal, a human voice may be considered as a musical instrument, such that the inventory may include a set of basis functions for each of one or more human voice models. FIG. 7 shows a spectrogram of speech with a harmonic honk (frequency in Hz vs. time in samples), and FIG. 8 shows a representation of this signal in the harmonic basis function set shown in FIG. 6.

The inventory of basis functions may be based on a generic musical instrument pitch database, learned from an ad hoc recorded individual instrument recording, and/or based on separated streams of mixtures (e.g., using a separation scheme such as independent component analysis (ICA), expectation-maximization (EM), etc.).

Figure 9:
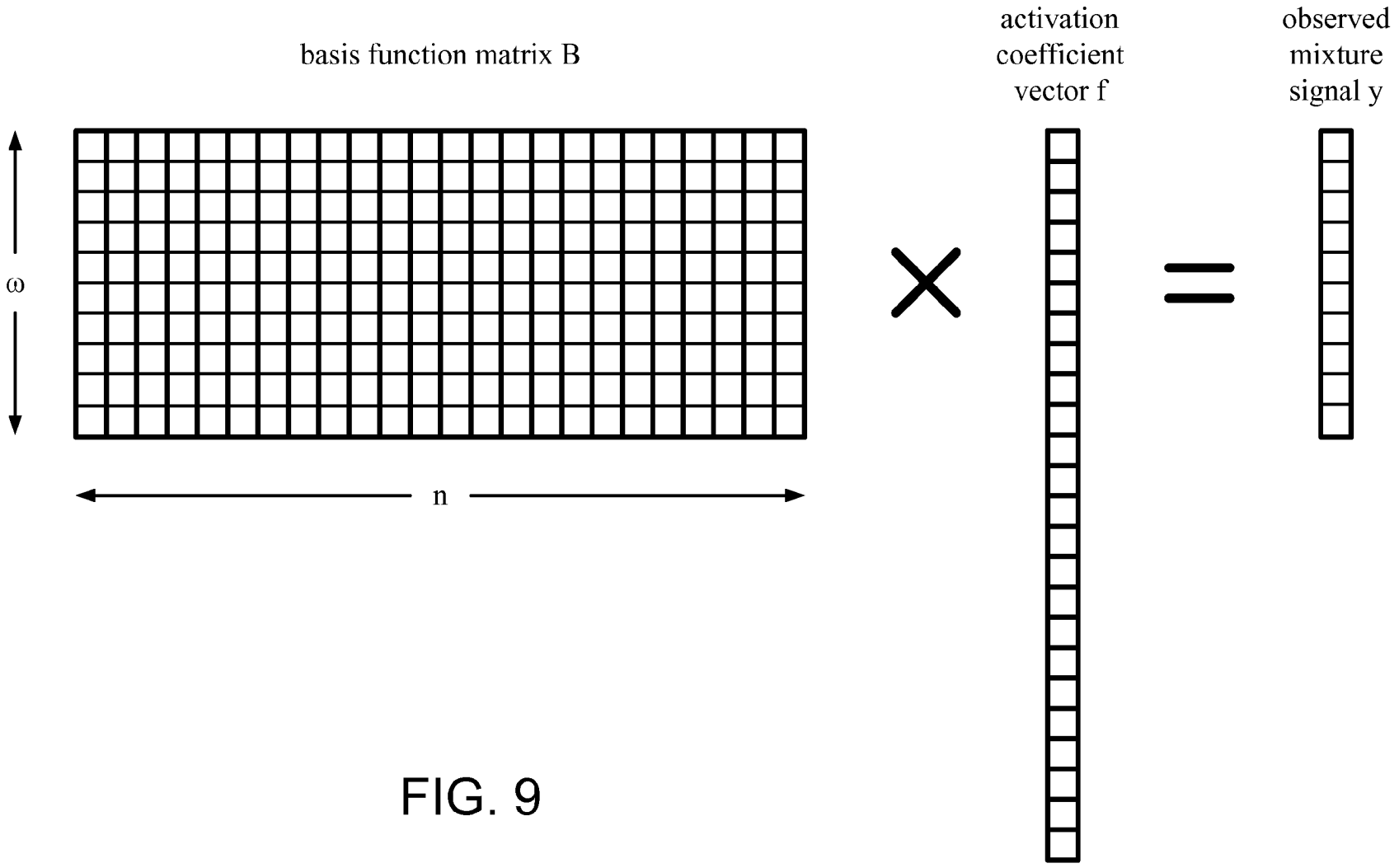
FIG. 9 illustrates a model Bf=y.

Based on the signal representation calculated by task T100 and on a plurality B of basis functions from the inventory A, task T200 calculates a vector of activation coefficients. Each coefficient of this vector corresponds to a different one of the plurality B of basis functions. For example, task T200 may be configured to calculate the vector such that it indicates the most probable model for the signal representation, according to the plurality B of basis functions. FIG. 9 illustrates such a model Bf=y in which the plurality B of basis functions is a matrix such that the columns of B are the individual basis functions, f is a column vector of basis function activation coefficients, and y is a column vector of a frame of the recorded mixture signal (e.g., a five-, ten-, or twenty-millisecond frame, in the form of a spectrogram frequency vector).

Task T200 may be configured to recover the activation coefficient vector for each frame of the audio signal by solving a linear programming problem. Examples of methods that may be used to solve such a problem include nonnegative matrix factorization (NNMF). A single-channel reference method that is based on NNMF may be configured to use expectation-maximization (EM) update rules (e.g., as described below) to compute basis functions and activation coefficients at the same time.

It may be desirable to decompose the audio mixture signal into individual instruments (which may include one or more human voices) by finding the sparsest activation coefficient vector in a known or partially known basis function space. For example, task T200 may be configured to use a set of known instrument basis functions to decompose an input signal representation into source components (e.g., one or more individual instruments) by finding the sparsest activation coefficient vector in the basis function inventory (e.g., using efficient sparse recovery algorithms)

It is known that the minimum L1-norm solution to an underdetermined system of linear equations (i.e., a system having more unknowns than equations) is often also the sparsest solution to that system. Sparse recovery via minimization of the L1-norm may be performed as follows.

We assume that our target vector $f_0$ is a sparse vector of length N having K<N nonzero entries (i.e., is "K-sparse") and that projection matrix (i.e., basis function matrix) A is incoherent (random-like) for a set of size~K. We observe the signal $y=Af_o$. Then solving $\min_f \|f\|_{l_1}$ subject to Af=y (where $\|f\|_{l_1}$ is defined as $\Sigma_{i=1}^{n}|f_i|$) will recover $f_0$ exactly. Moreover, we can recover $f_0$ from $M \gtrsim K \cdot \log N$ incoherent measurements by solving a tractable program. The number of measurements M is approximately equal to the number of active components.

One approach is to use sparse recovery algorithms from compressive sensing. In one example of compressive sensing (also called "compressed sensing") signal recovery Φx=y, y is an observed signal vector of length M, x is a sparse vector of length N having K<N nonzero entries (i.e., a "K-sparse model") that is a condensed representation of y, and Φ is a random projection matrix of size M×N. The random projection Φ is not full rank, but it is invertible for sparse/compressible signal models with high probability (i.e., it solves an ill-posed inverse problem).

Figure 10:
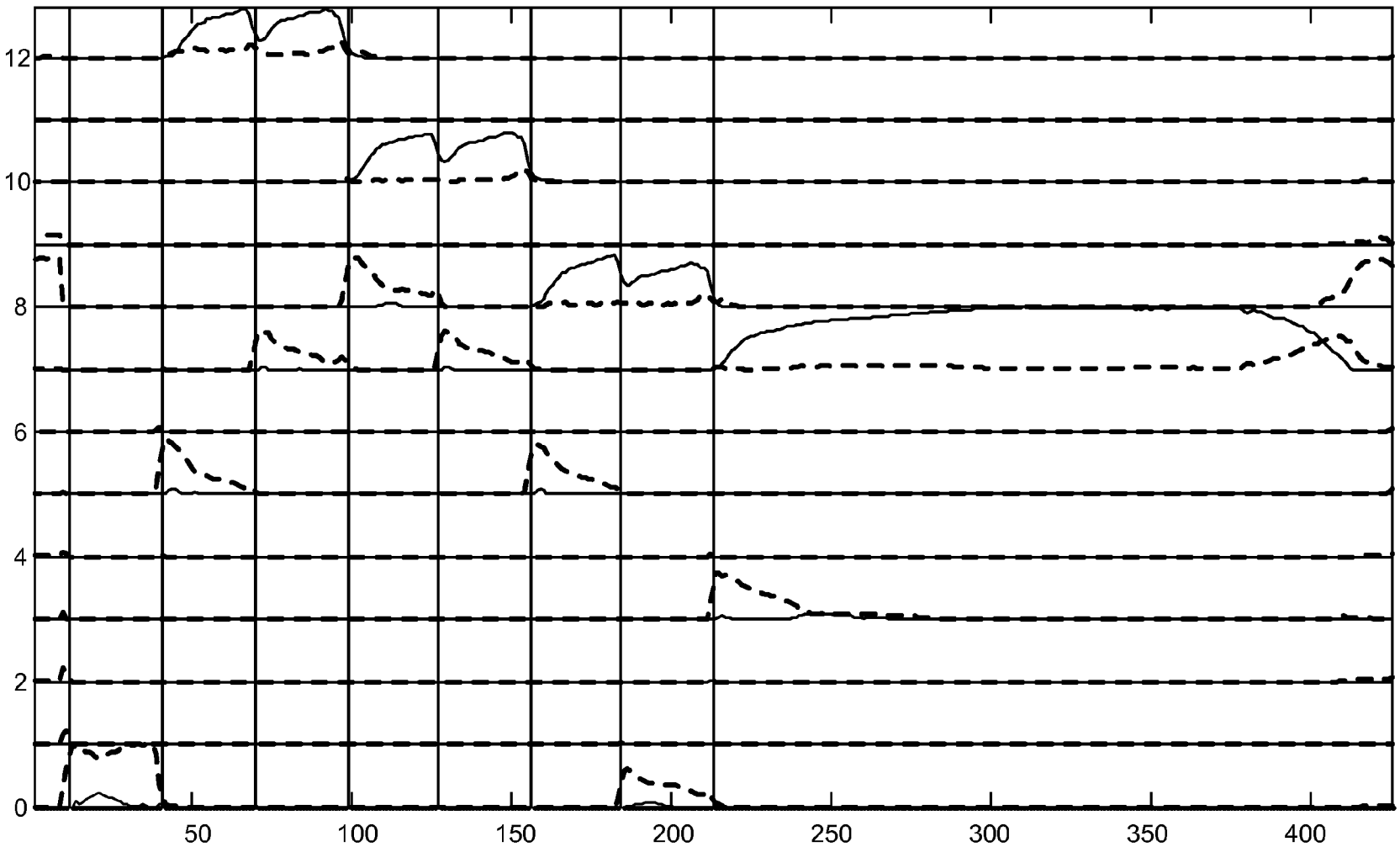
FIG. 10 shows a plot of a separation result produced by method M100.

FIG. 10 shows a plot (pitch index vs. frame index) of a separation result produced by a sparse recovery implementation of method M100. In this case, the input mixture signal includes a piano playing the sequence of notes C5-F5-G5-G#5-G5-F5-05-D#5, and a flute playing the sequence of notes C6-A#5-G#5-G5. The separated result for the piano is shown in dashed lines (the pitch sequence 0-5-7-8-7-5-0-3), and the separated result for the flute is shown in solid lines (the pitch sequence 12-10-8-7).

The activation coefficient vector f may be considered to include a subvector $f_n$ for each instrument n that includes the activation coefficients for the corresponding basis function set $A_n$. These instrument-specific activation subvectors may be processed independently (e.g., in a post-processing operation). For example, it may be desirable to enforce one or more sparsity constraints (e.g., at least half of the vector elements are zero, the number of nonzero elements in an instrument-specific subvector does not exceed a maximum value, etc.). Processing of the activation coefficient vector may include encoding the index number of each non-zero activation coefficient for each frame, encoding the index and value of each non-zero activation coefficient, or encoding the entire sparse vector. Such information may be used (e.g., at another time and/or location) to reproduce the mixture signal using the indicated active basis functions, or to reproduce only a particular part of the mixture signal (e.g., only the notes played by a particular instrument).

An audio signal produced by a musical instrument may be modeled as a series of events called notes. The sound of a harmonic instrument playing a note may be divided into different regions over time: for example, an onset stage (also called attack), a stationary stage (also called sustain), and an offset stage (also called release). Another description of the temporal envelope of a note (ADSR) includes an additional decay stage between attack and sustain. In this context, the duration of a note may be defined as the interval from the start of the attack stage to the end of the release stage (or to another event that terminates the note, such as the start of another note on the same string). A note is assumed to have a single pitch, although the inventory may also be implemented to model notes having a single attack and multiple pitches (e.g., as produced by a pitch-bending effect, such as vibrato or portamento). Some instruments (e.g., a piano, guitar, or harp) may produce more than one note at a time in an event called a chord.

Notes produced by different instruments may have similar timbres during the sustain stage, such that it may be difficult to identify which instrument is playing during such a period. The timbre of a note may be expected to vary from one stage to another, however. For example, identifying an active instrument may be easier during an attack or release stage than during a sustain stage.

Figure 12:
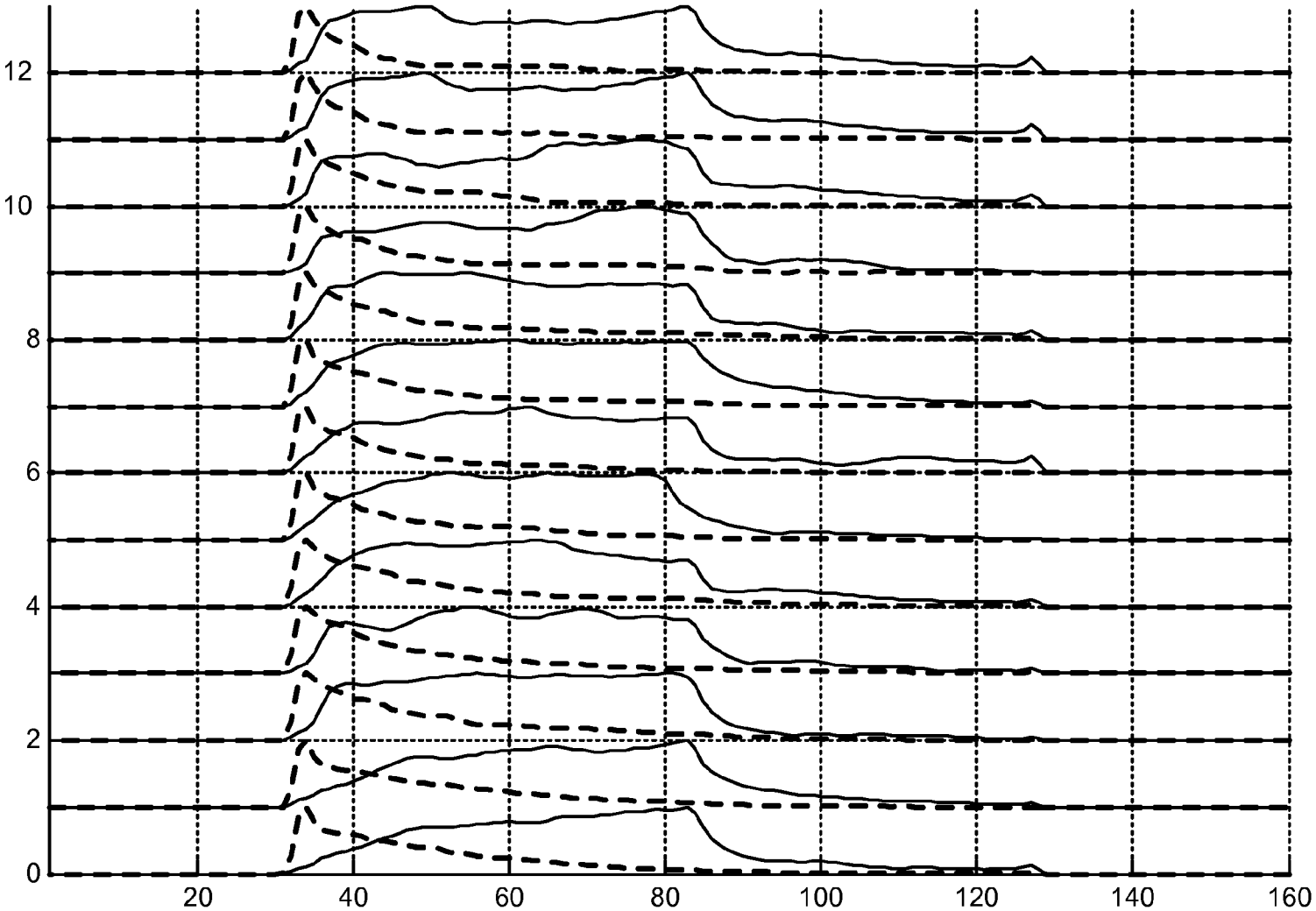
FIG. 12 shows a plot of time-domain evolutions of basis functions during the pendency of a note for a piano and for a flute.

FIG. 12 shows a plot (pitch index vs. time-domain frame index) of the time-domain evolutions of basis functions for the twelve different pitches in the octave C5-C6 for a piano (dashed lines) and for a flute (solid lines). It may be seen, for example, that the relation between the attack and sustain stages for a piano basis function is significantly different than the relation between the attack and sustain stages for a flute basis function.

To increase the likelihood that the activation coefficient vector will indicate an appropriate basis function, it may be desirable to maximize differences between the basis functions. For example, it may be desirable for a basis function to include information relating to changes in the spectrum of a note over time.

It may be desirable to select a basis function based on a change in timbre over time. Such an approach may include encoding information relating to such time-domain evolution of the timbre of a note into the basis function inventory. For example, the set $A_n$ of basis functions for a particular instrument n may include two or more corresponding signal representations at each pitch, such that each of these signal representations corresponds to a different time in the evolution of the note (e.g., one for attack stage, one for sustain stage, and one for release stage). These basis functions may be extracted from corresponding frames of a recording of the instrument playing the note.

Figure 1B:
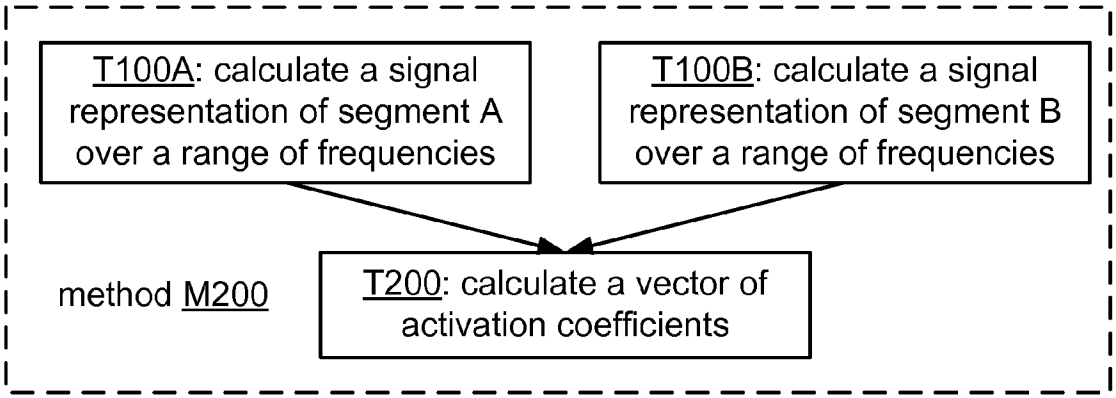
FIG. 1B shows a flowchart of an implementation M200 of method M100.
Figure 1C:
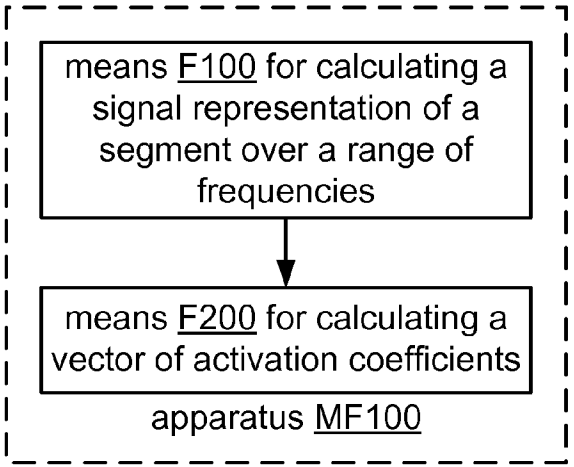
FIG. 1C shows a block diagram for an apparatus MF100 for decomposing an audio signal according to a general configuration.

FIG. 1C shows a block diagram for an apparatus MF100 for decomposing an audio signal according to a general configuration. Apparatus MF100 includes means F100 for calculating, based on information from a frame of the audio signal, a corresponding signal representation over a range of frequencies (e.g., as described herein with reference to task T100). Apparatus MF100 also includes means F200 for calculating a vector of activation coefficients, based on the signal representation calculated by means F100 and on a plurality of basis functions, in which each of the activation coefficients corresponds to a different one of the plurality of basis functions (e.g., as described herein with reference to task T200).

Figure 1D:
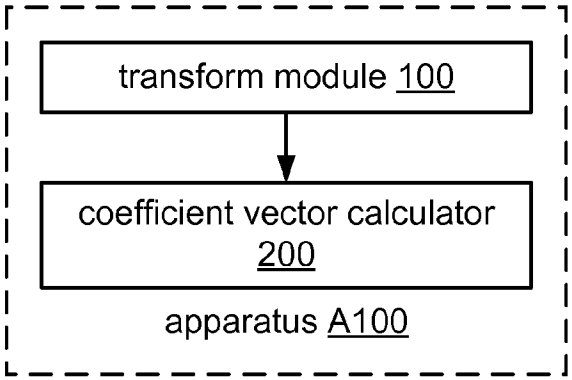
FIG. 1D shows a block diagram for an apparatus A100 for decomposing an audio signal according to another general configuration.

FIG. 1D shows a block diagram for an apparatus A100 for decomposing an audio signal according to another general configuration that includes transform module 100 and coefficient vector calculator 200. Transform module 100 is configured to calculate, based on information from a frame of the audio signal, a corresponding signal representation over a range of frequencies (e.g., as described herein with reference to task T100). Coefficient vector calculator 200 is configured to calculate a vector of activation coefficients, based on the signal representation calculated by transform module 100 and on a plurality of basis functions, in which each of the activation coefficients corresponds to a different one of the plurality of basis functions (e.g., as described herein with reference to task T200).

FIG. 1B shows a flowchart of an implementation M200 of method M100 in which the basis function inventory includes multiple signal representations for each instrument at each pitch. Each of these multiple signal representations describes a plurality of different distributions of energy (e.g., a plurality of different timbres) over the range of frequencies. The inventory may also be configured to include different multiple signal representations for different time-related modalities. In one such example, the inventory includes multiple signal representations for a string being bowed at each pitch and different multiple signal representations for the string being plucked (e.g., pizzicato) at each pitch.

Figure 11:
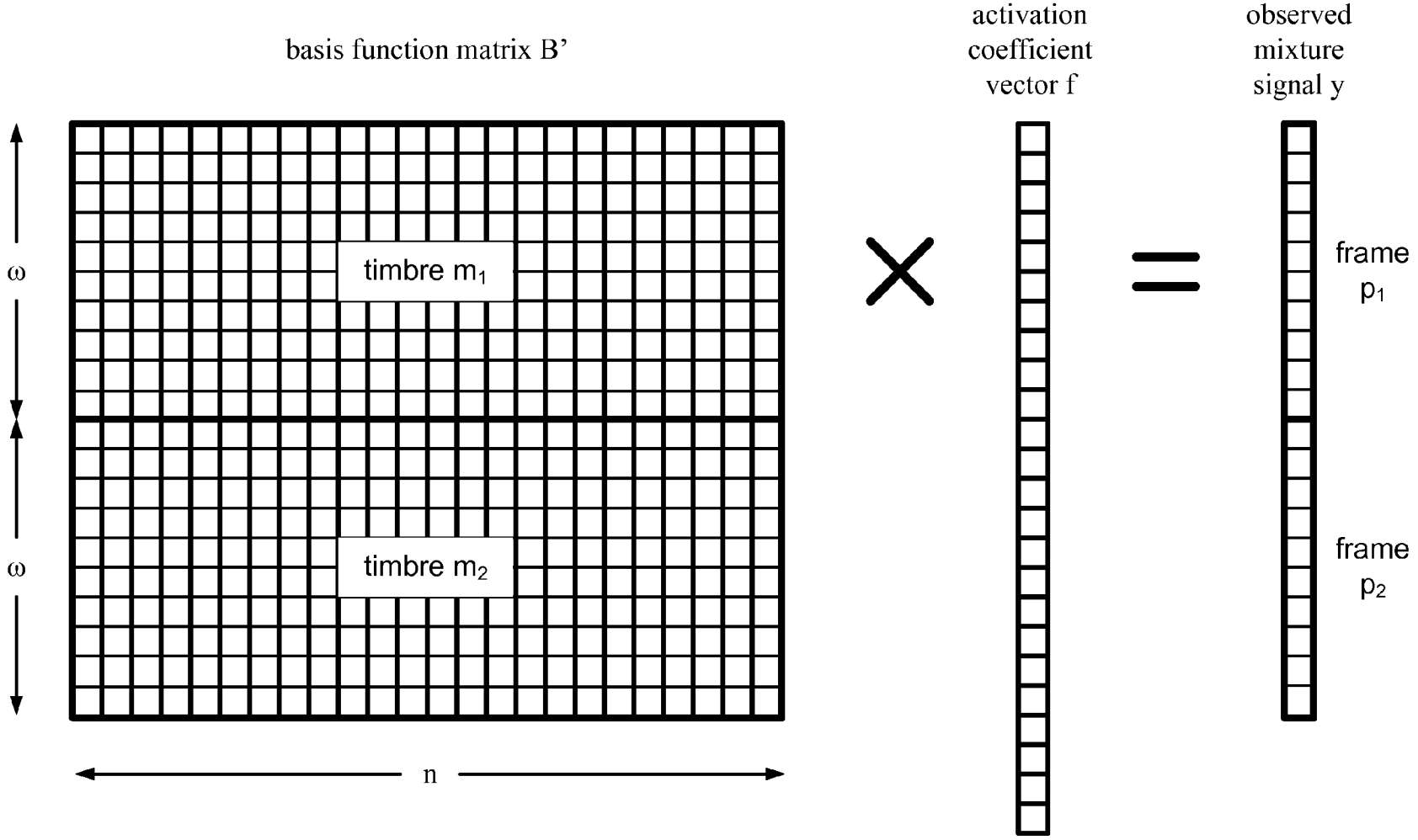
FIG. 11 illustrates a modification B'f=y of the model of FIG. 9.

Method M200 includes multiple instances of task T100 (in this example, tasks T100A and T100B), wherein each instance calculates, based on information from a corresponding different frame of the audio signal, a corresponding signal representation over a range of frequencies. The various signal representations may be concatenated, and likewise each basis function may be a concatenation of multiple signal representations. In this example, task T200 matches the concatenation of mixture frames against the concatenations of the signal representations at each pitch. FIG. 11 shows an example of a modification B'f=y of the model Bf=y of FIG. S5 in which frames p1, p2 of the mixture signal y are concatenated for matching.

The inventory may be constructed such that the multiple signal representations at each pitch are taken from consecutive frames of a training signal. In other implementations, it may be desirable for the multiple signal representations at each pitch to span a larger window in time (e.g., to include frames that are separated in time rather than consecutive). For example, it may be desirable for the multiple signal representations at each pitch to include signal representations from at least two among an attack stage, a sustain stage, and a release stage. By including more information regarding the time-domain evolution of the note, the difference between the sets of basis functions for different notes may be increased.

Figure 14:
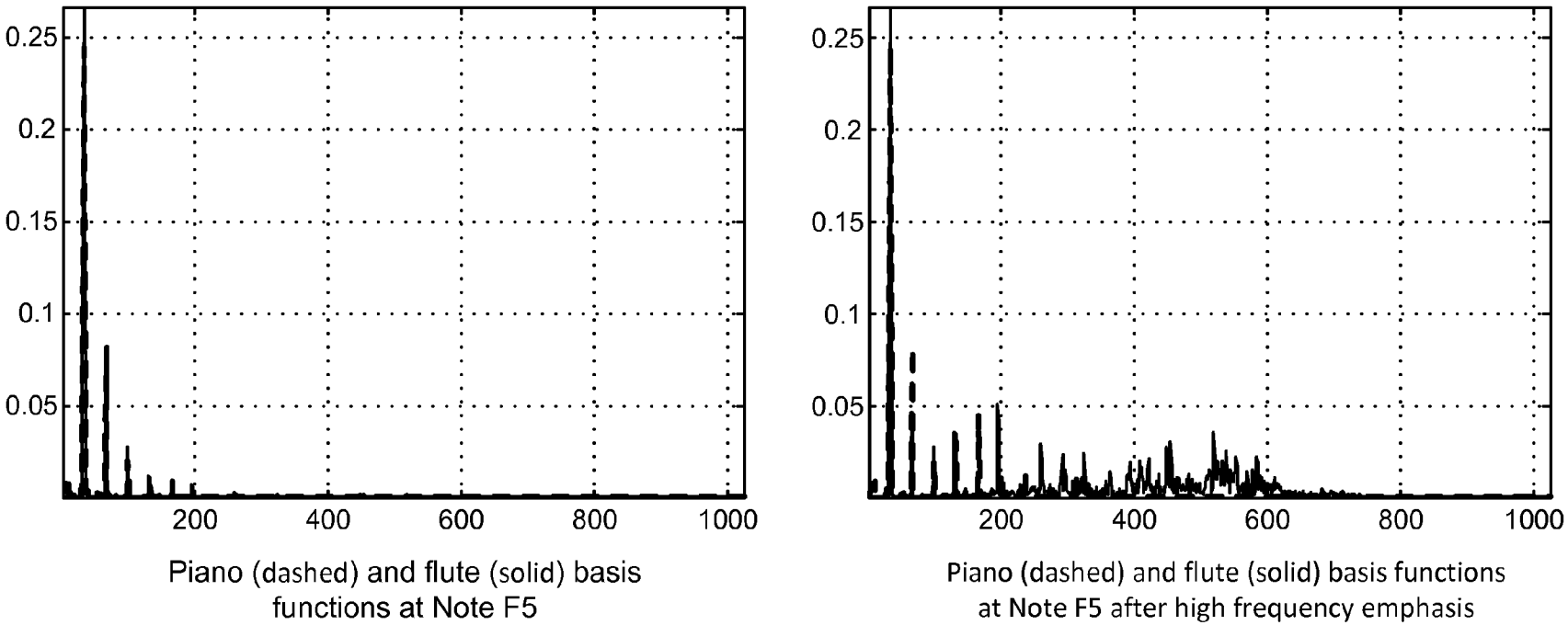
FIG. 14 shows a plot of basis functions for a piano and a flute at note F5 (left) and a plot of pre-emphasized basis functions for a piano and a flute at note F5 (right).

On the left, FIG. 14 shows a plot (amplitude vs. frequency) of a basis function for a piano at note F5 (dashed line) and a basis function for a flute at note F5 (solid line). It may be seen that these basis functions, which indicate the timbres of the instruments at this particular pitch, are very similar Consequently, some degree of mismatching among them may be expected in practice. For a more robust separation result, it may be desirable to maximize the differences among the basis functions of the inventory.

The actual timbre of a flute contains more high-frequency energy than that of a piano, although the basis functions shown in the left plot of FIG. 14 do not encode this information. On the right, FIG. 14 shows another plot (amplitude vs. frequency) of a basis function for a piano at note F5 (dashed line) and a basis function for a flute at note F5 (solid line). In this case, the basis functions are derived from the same source signals as the basis functions in the left plot, except that the high-frequency regions of the source signals have been pre-emphasized. Because the piano source signal contains significantly less high-frequency energy than the flute source signal, the difference between the basis functions shown in the right plot is appreciably greater than the difference between the basis functions shown in the left plot.

Figure 2B:
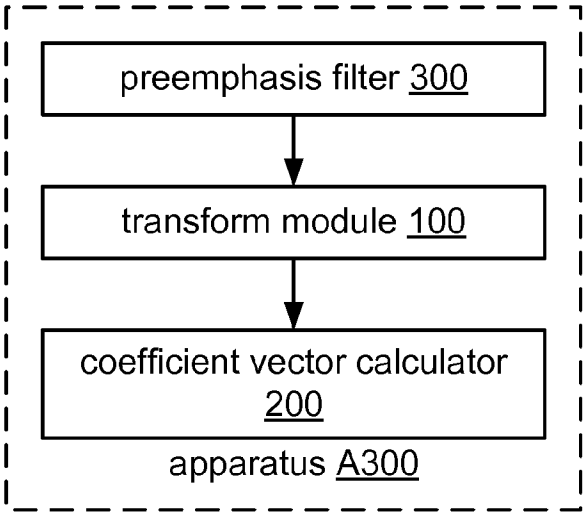
FIG. 2B shows a block diagram of an implementation A300 of apparatus A100.
Figure 2C:
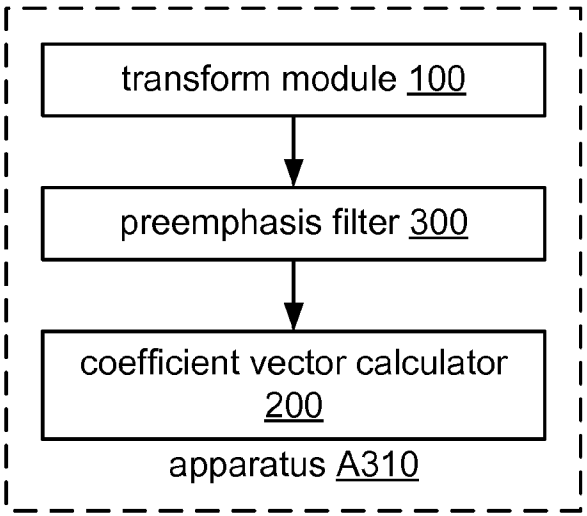
FIG. 2C shows a block diagram of another implementation A310 of apparatus A100.
Figure 2A:
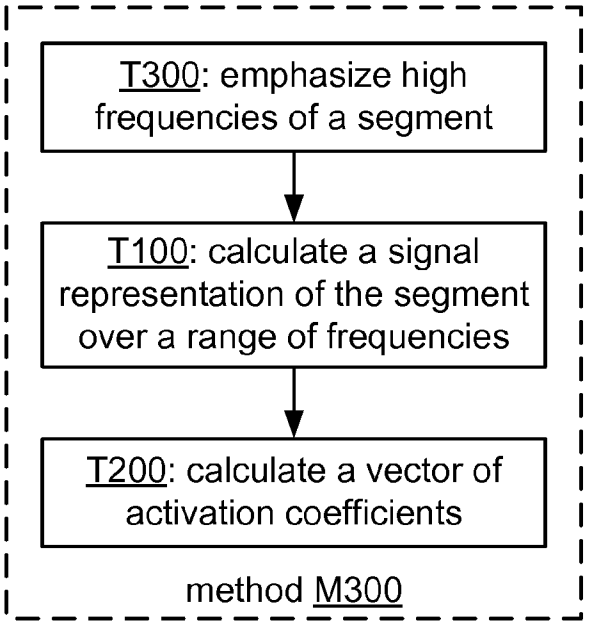
FIG. 2A shows a flowchart of an implementation M300 of method M100.
Figure 3A:
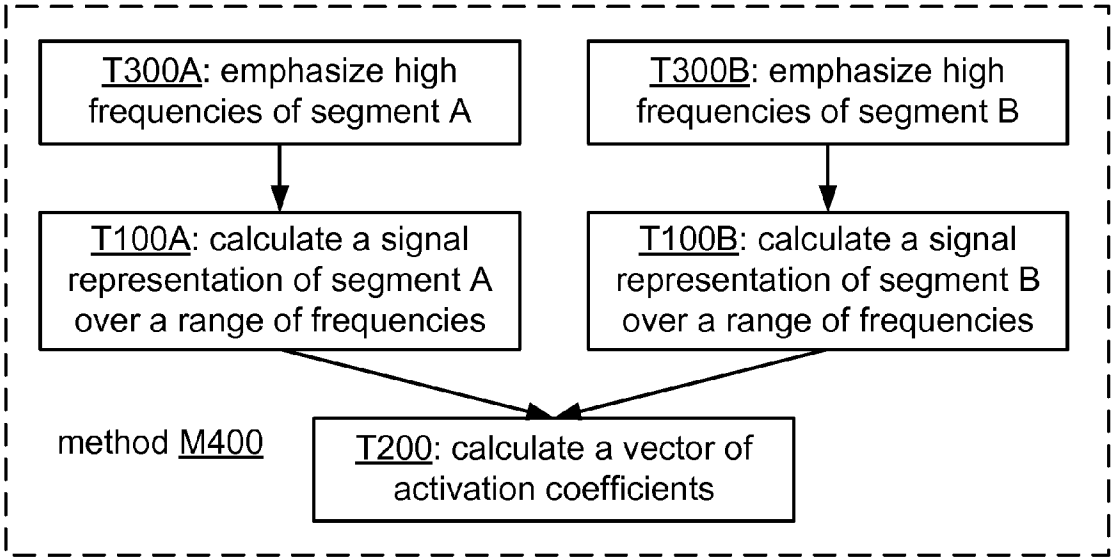
FIG. 3A shows a flowchart of an implementation M400 of method M200.

FIG. 2A shows a flowchart of an implementation M300 of method M100 that includes a task T300 which emphasizes high frequencies of the segment. In this example, task T100 is arranged to calculate the signal representation of the segment after preemphasis. FIG. 3A shows a flowchart of an implementation M400 of method M200 that includes multiple instances T300A, T300B of task T300. In one example, preemphasis task T300 increases the ratio of energy above 200 Hz to total energy.

Figure 13:
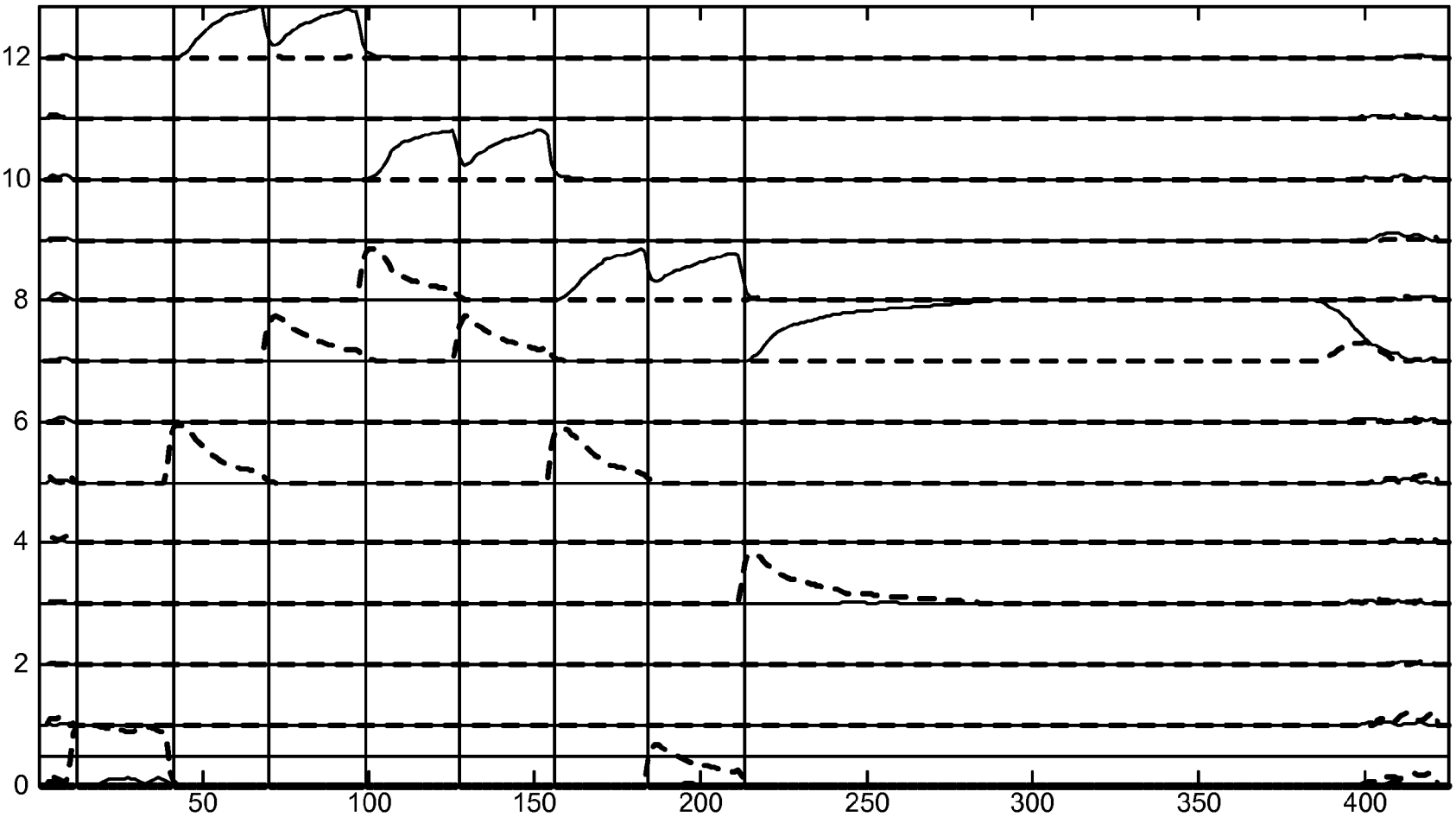
FIG. 13 shows a plot of a separation result produced by method M400.

FIG. 2B shows a block diagram of an implementation A300 of apparatus A100 that includes a preemphasis filter 300 (e.g., a highpass filter, such as a first-order highpass filter) that is arranged to perform high-frequency emphasis on the audio signal upstream of transform module 100. FIG. 2C shows a block diagram of another implementation A310 of apparatus A100 in which preemphasis filter 300 is arranged to perform high-frequency preemphasis on the transform coefficients. In these cases, it may also be desirable to perform high-frequency pre-emphasis (e.g., highpass filtering) on the plurality B of basis functions. FIG. 13 shows a plot (pitch index vs. frame index) of a separation result produced by method M300 on the same input mixture signal as the separation result of FIG. 10.

A musical note may include coloration effects, such as vibrato and/or tremolo. Vibrato is a frequency modulation, with a modulation rate that is typically in a range of from four or five to seven, eight, ten, or twelve Hertz. A pitch change due to vibrato may vary between 0.6 to two semitones for singers, and is generally less than ±0.5 semitone for wind and string instruments (e.g., between 0.2 and 0.35 semitones for string instruments). Tremolo is an amplitude modulation typically having a similar modulation rate.

It may be difficult to model such effects in the basis function inventory. It may be desirable to detect the presence of such effects. For example, the presence of vibrato may be indicated by a frequency-domain peak in the range of 4-8 Hz. It may also be desirable to record a measure of the level of the detected effect (e.g., as the energy of this peak), as such a characteristic may be used to restore the effect during reproduction. Similar processing may be performed in the time domain for tremolo detection and quantification. Once the effect has been detected and possibly quantified, it may be desirable to remove the modulation by smoothing the frequency over time for vibrato or by smoothing the amplitude over time for tremolo.

Figure 4A:
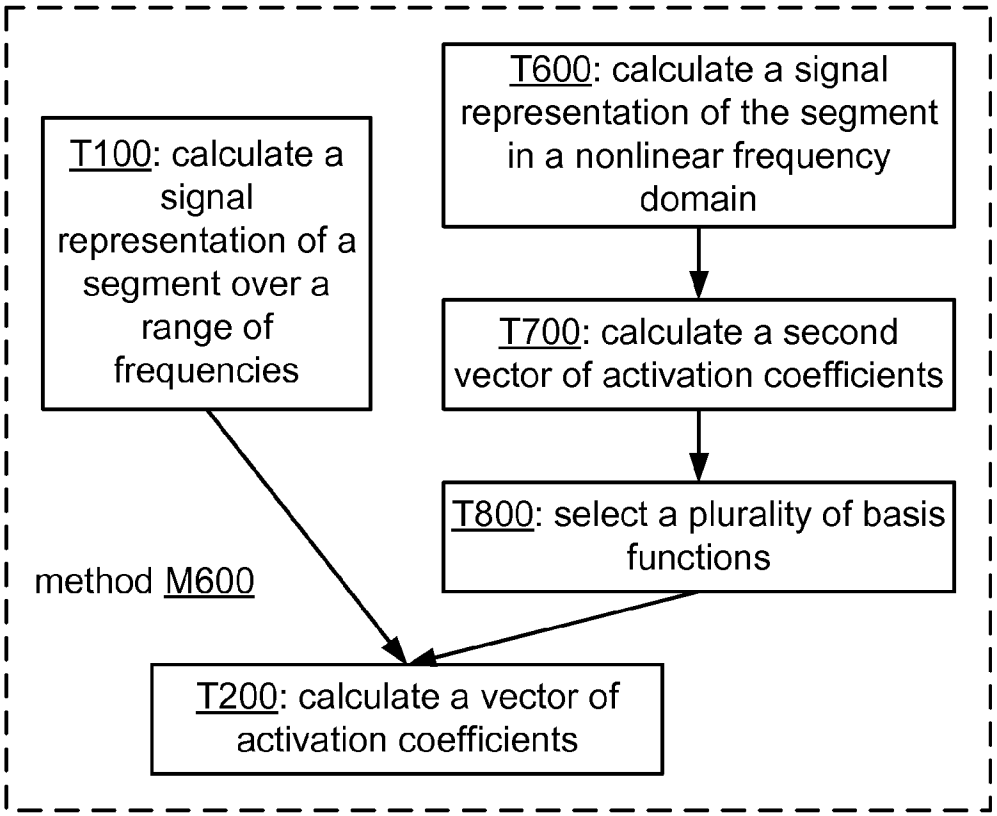
FIG. 4A shows a flowchart for an implementation M600 of method M100
Figure 4B:
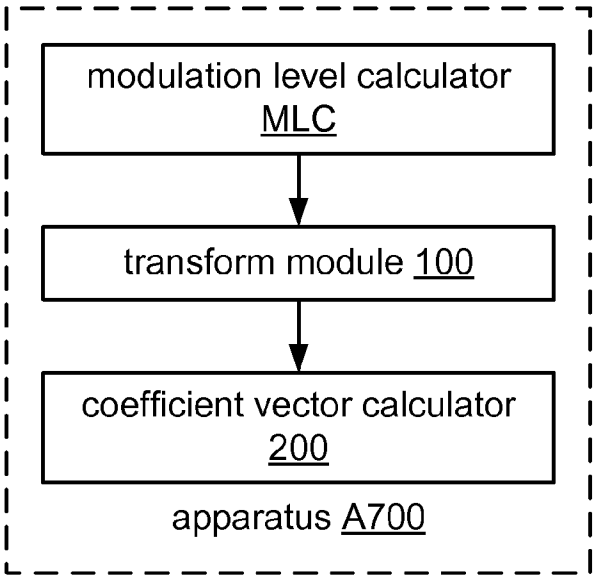
FIG. 4B shows a block diagram of an implementation A700 of apparatus A100.

FIG. 4B shows a block diagram of an implementation A700 of apparatus A100 that includes a modulation level calculator MLC. Calculator MLC is configured to calculate, and possibly to record, a measure of a detected modulation (e.g., an energy of a detected modulation peak in the time or frequency domain) in a segment of the audio signal as described above.

This disclosure describes methods that may be used to enable a use case for a music application in which multiple sources may be active at the same time. In such case, it may be desirable to separate the sources, if possible, before calculating the activation coefficient vector. To achieve this goal, a combination of multi- and single-channel techniques is proposed.

Figure 3B:
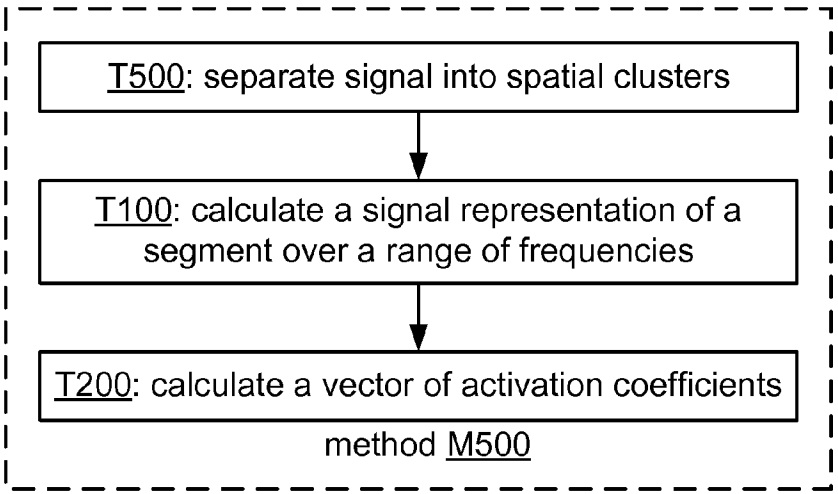
FIG. 3B shows a flowchart of an implementation M500 of method M200.

FIG. 3B shows a flowchart of an implementation M500 of method M100 that includes a task T500 which separates the signal into spatial clusters. Task T500 may be configured to isolate the sources into as many spatial clusters as possible. In one example, task T500 uses multi-microphone processing to separate the recorded acoustic scenario into as many spatial clusters as possible. Such processing may be based on gain differences and/or phase differences between the microphone signals, where such differences may be evaluated across an entire frequency band or at each of a plurality of different frequency subbands or frequency bins.

Figure 16:
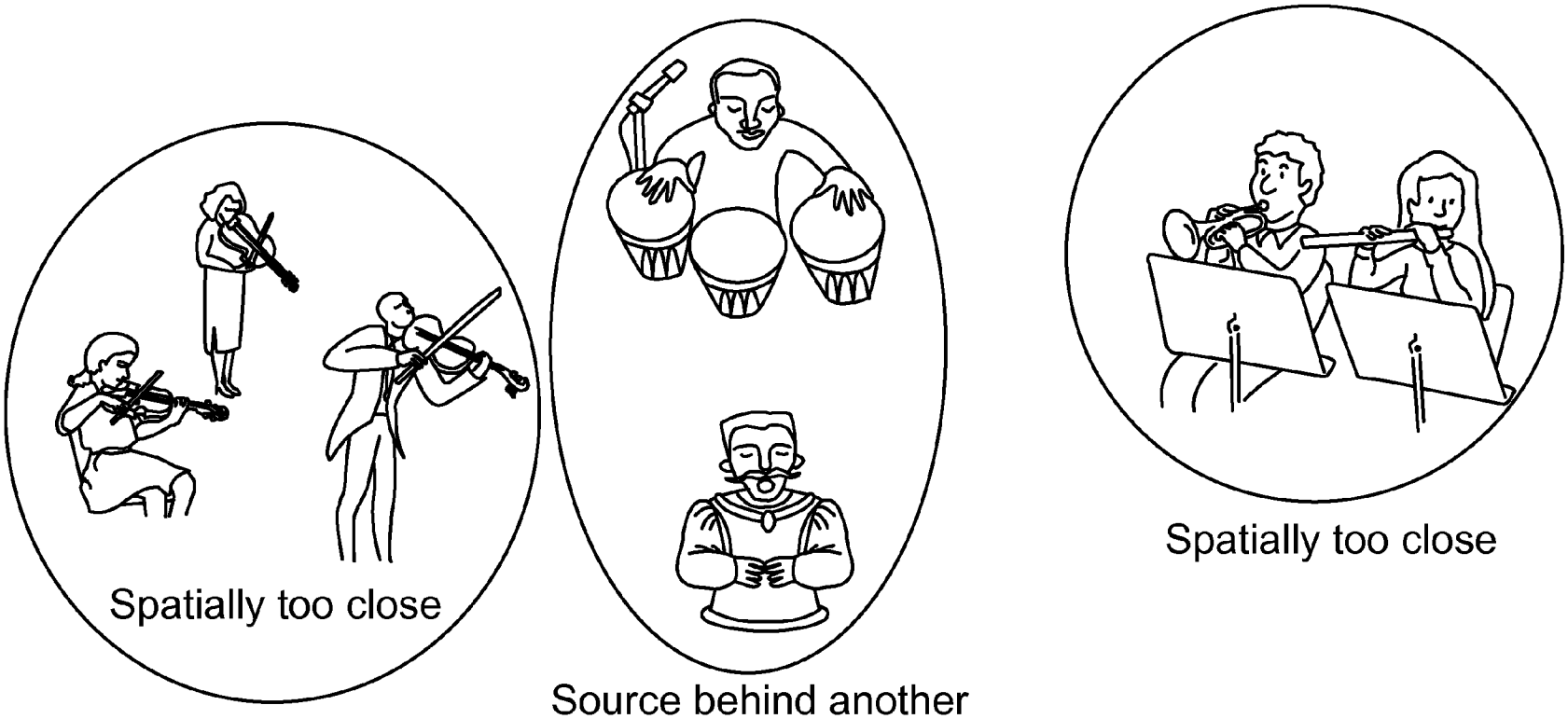
FIG. 16 illustrates a scenario in which sources are located close together and a source is located behind another source.
Figure 17:
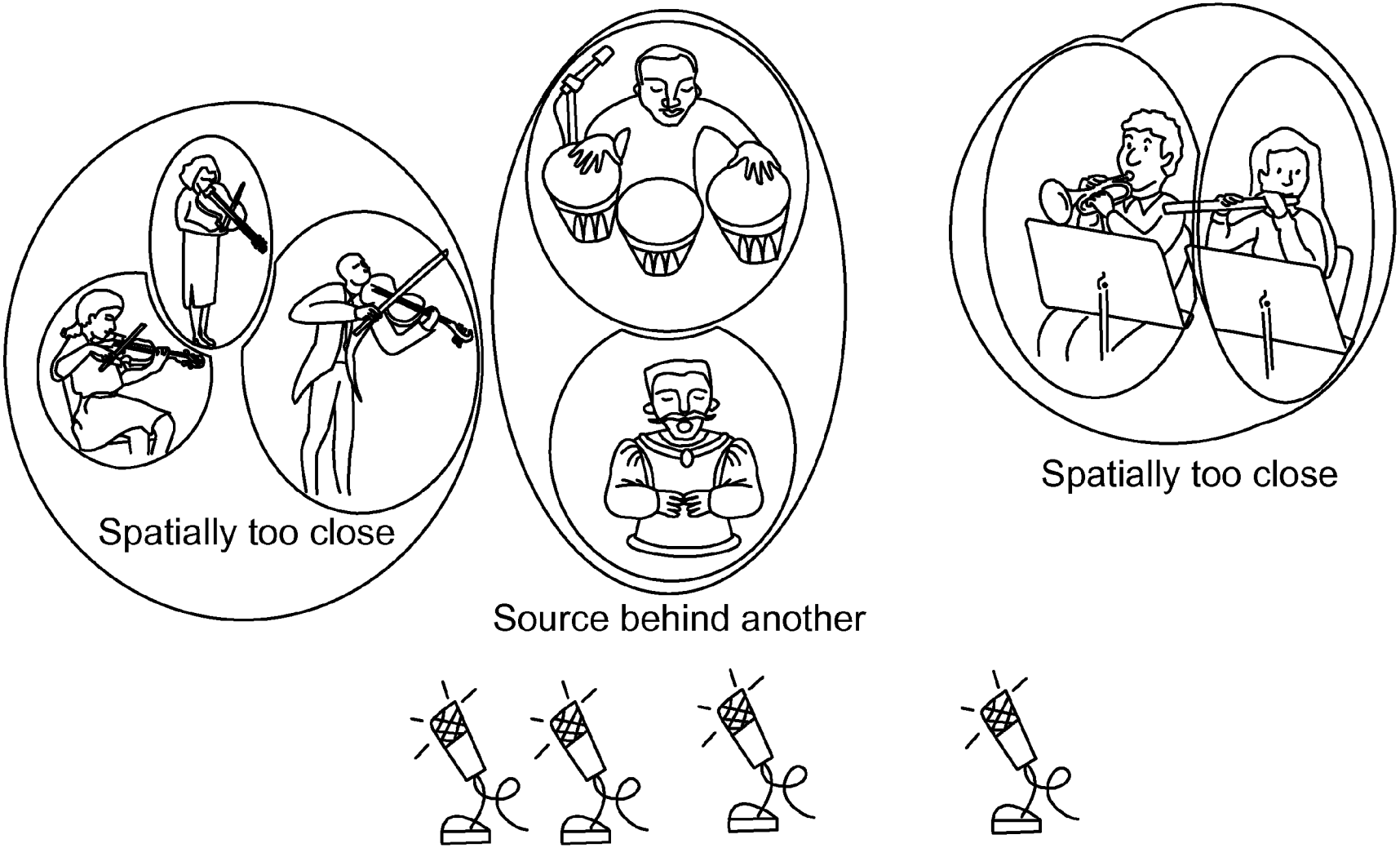
FIG. 17 illustrates a result of analyzing individual spatial clusters.

Spatial separation methods alone may be insufficient to achieve a desired level of separation. For example, some sources may be too close or otherwise suboptimally arranged with respect to the microphone array (e.g. multiple violinists and/or harmonic instruments may be located in one corner; percussionists are usually located in the back). In a typical music-band scenario, sources may be located close together or even behind other sources (e.g., as shown in FIG. 16), such that using spatial information alone to process a signal captured by an array of microphones that are in the same general direction to the band may fail to discriminate all of the sources from one another. Tasks T100 and T200 analyze the individual spatial clusters using single-channel, basis-function inventory-based sparse recovery (e.g., sparse decomposition) techniques as described herein to separate the individual instruments (e.g., as shown in FIG. 17).

For computational tractability, it may be desirable for the plurality B of basis functions to be considerably smaller than the inventory A of basis functions. It may be desirable to narrow down the inventory for a given separation task, starting from a large inventory. In one example, such a reduction may be performed by determining whether a segment includes sound from percussive instruments or sound from harmonic instruments, and selecting an appropriate plurality B of basis functions from the inventory for matching. Percussive instruments tend to have impulse-like spectrograms (e.g., vertical lines) as opposed to horizontal lines for harmonic sounds.

A harmonic instrument may typically be characterized in the spectrogram by a certain fundamental pitch and associated timbre, and a corresponding higher-frequency extension of this harmonic pattern. Consequently, in another example it may be desirable to reduce the computational task by only analyzing lower octaves of these spectra, as their higher frequency replica may be predicted based on the low-frequency ones. After matching, the active basis functions may be extrapolated to higher frequencies and subtracted from the mixture signal to obtain a residual signal that may be encoded and/or further decomposed.

Such a reduction may also be performed through user selection in a graphical user interface and/or by pre-classification of most likely instruments and/or pitches based on a first sparse recovery run or maximum likelihood fit. For example, a first run of the sparse recovery operation may be performed to obtain a first set of recovered sparse coefficients, and based on this first set, the applicable note basis functions may be narrowed down for another run of the sparse recovery operation.

One reduction approach includes detecting the presence of certain instrument notes by measuring sparsity scores in certain pitch intervals. Such an approach may include refining the spectral shape of one or more basis functions, based on initial pitch estimates, and using the refined basis functions as the plurality B in method M100.

A reduction approach may be configured to identify pitches by measuring sparsity scores of the music signal projected into corresponding basis functions. Given the best pitch scores, the amplitude shapes of basis functions may be optimized to identify instrument notes. The reduced set of active basis functions may then be used as the plurality B in method M100.

Figure 18:
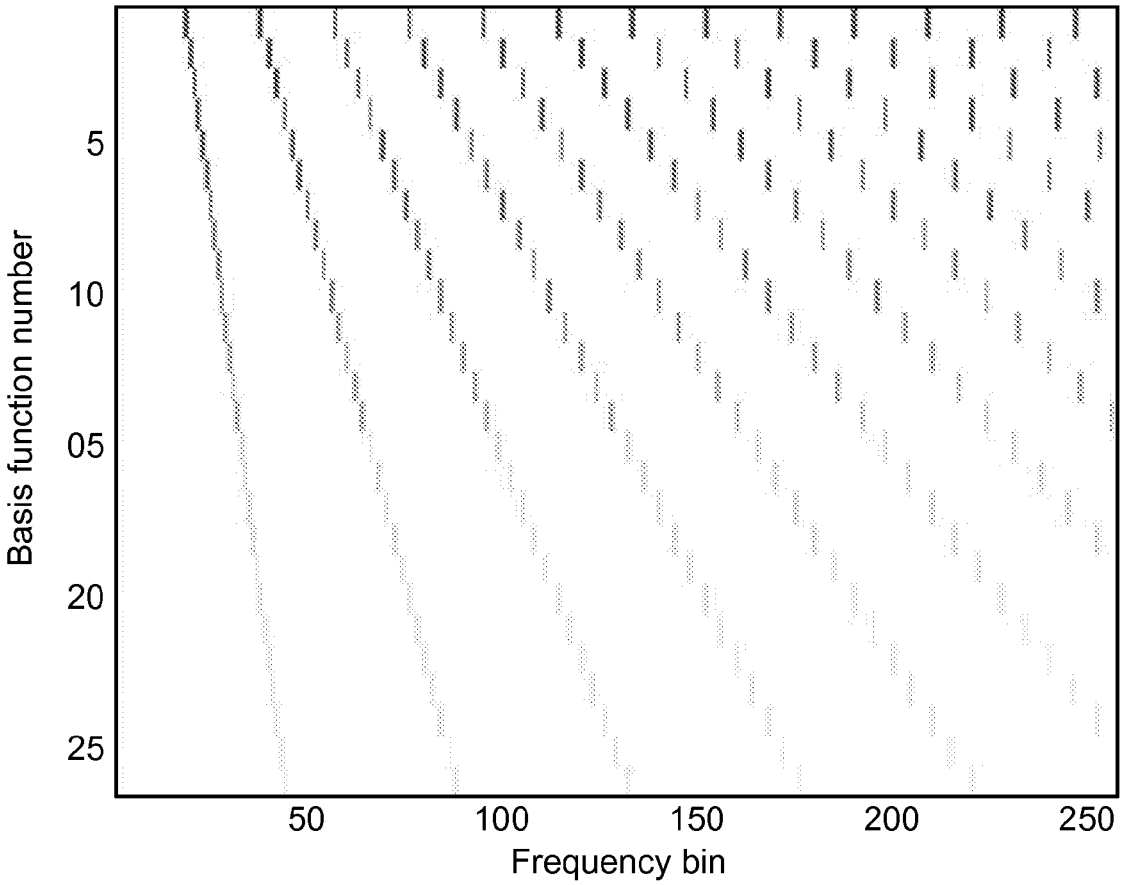
FIG. 18 shows a first example of a basis function inventory.
Figure 19:
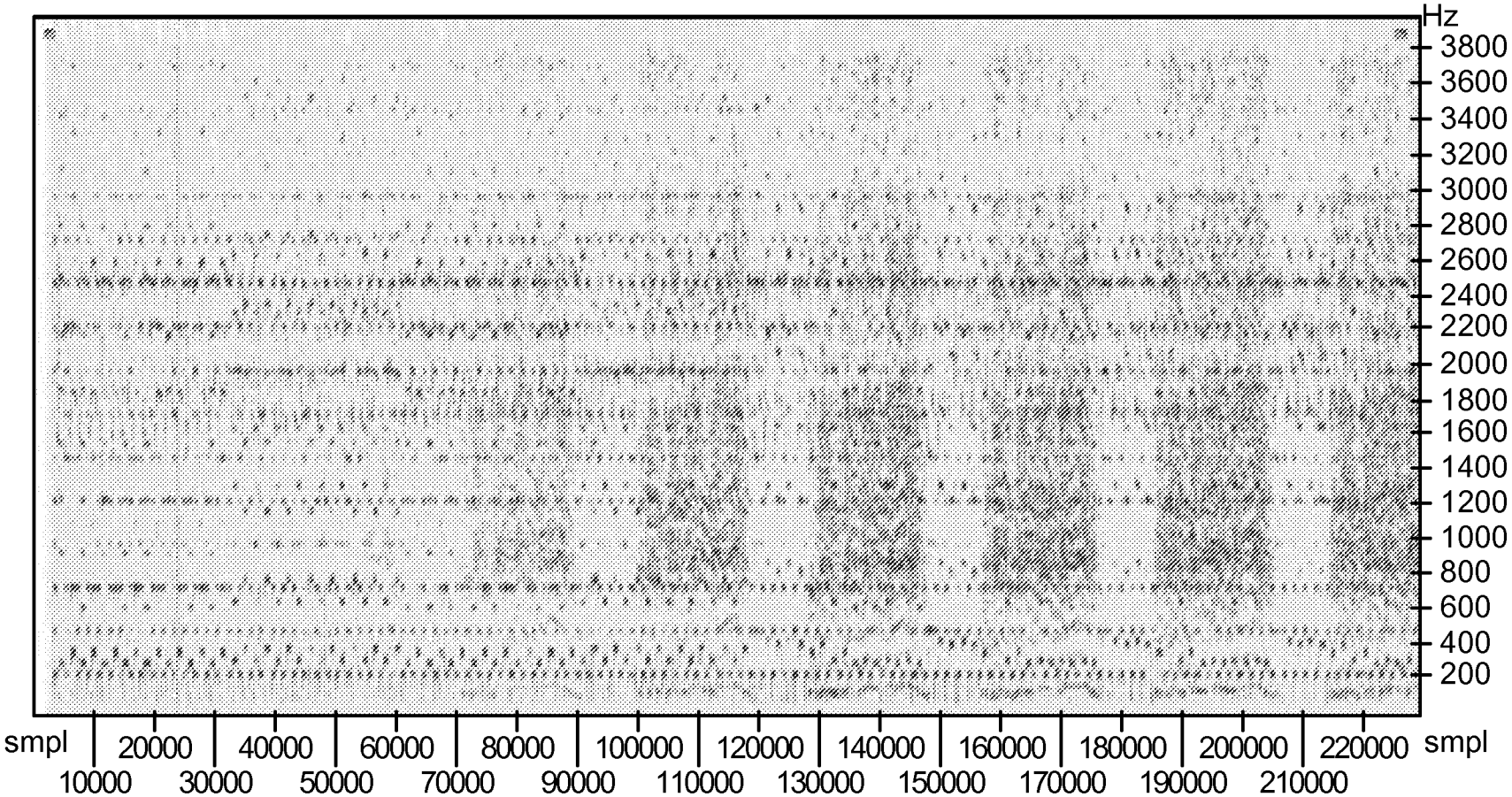
FIG. 19 shows a spectrogram of guitar notes.
Figure 20:
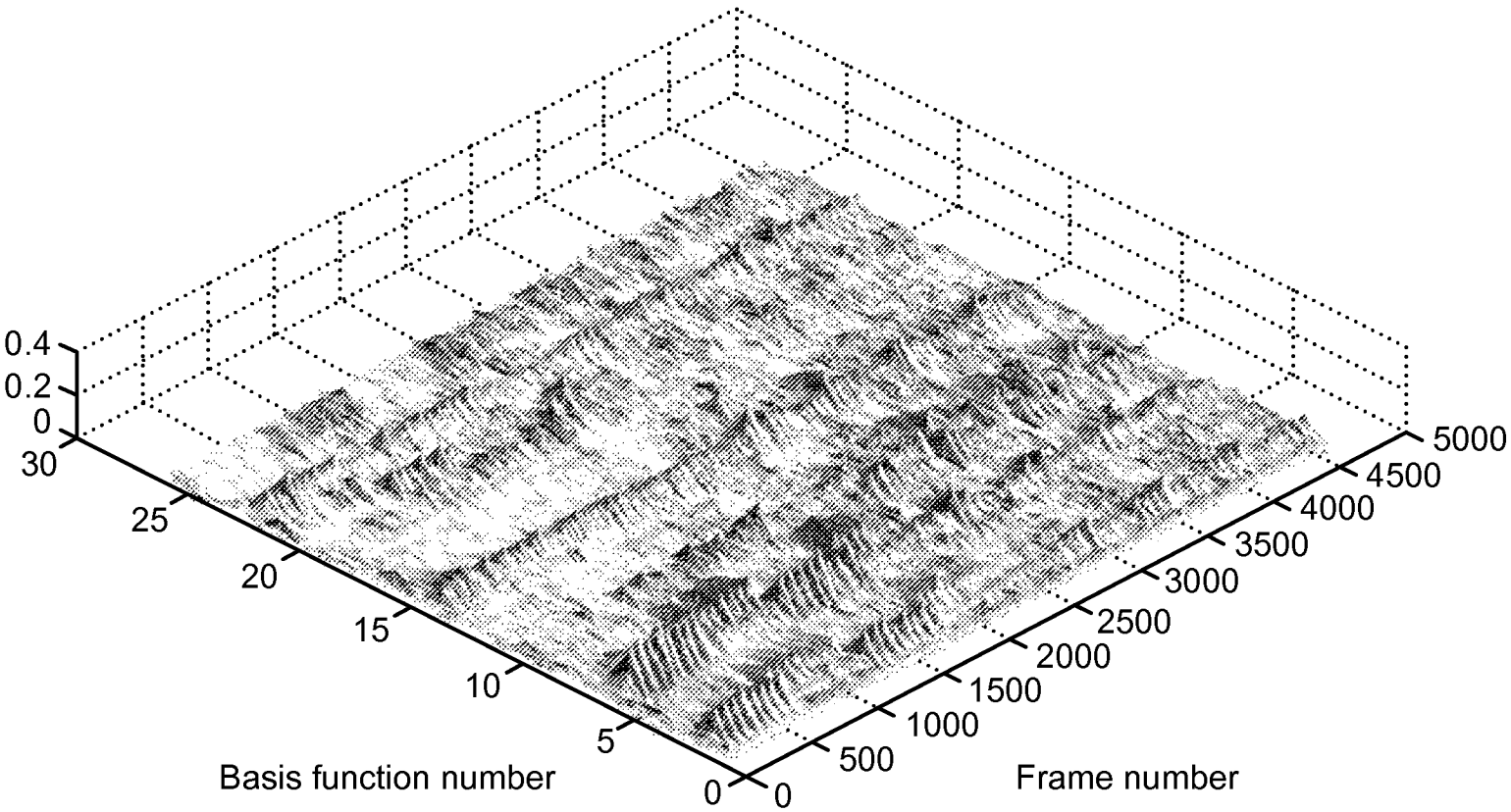
FIG. 20 shows a sparse representation of the spectrogram of FIG. 19 in the inventory of FIG. 18.

FIG. 18 shows an example of a basis function inventory for sparse harmonic signal representation that may be used in a first-run approach. FIG. 19 shows a spectrogram of guitar notes (frequency in Hz vs. time in samples), and FIG. 20 shows a sparse representation of this spectrogram (basis function number vs. time in frames) in the set of basis functions shown in FIG. 18.

FIG. 4A shows a flowchart for an implementation M600 of method M100 that includes such a first-run inventory reduction. Method M600 includes a task T600 that calculates a signal representation of a segment in a nonlinear frequency domain (e.g., in which the frequency distance between adjacent elements increases with frequency, as in a mel or Bark scale). In one example, task T600 is configured to calculate the nonlinear signal representation using a constant-Q transform. Method M600 also includes a task T700 that calculates a second vector of activation coefficients, based on the nonlinear signal representation and on a plurality of similarly nonlinear basis functions. Based on information from the second activation coefficient vector (e.g., from the identities of the activated basis functions, which may indicate an active pitch range), task T800 selects the plurality B of basis functions for use in task T200. It is expressly noted that methods M200, M300, and M400 may also be implemented to include such tasks T600, T700, and T800.

Figure 5:
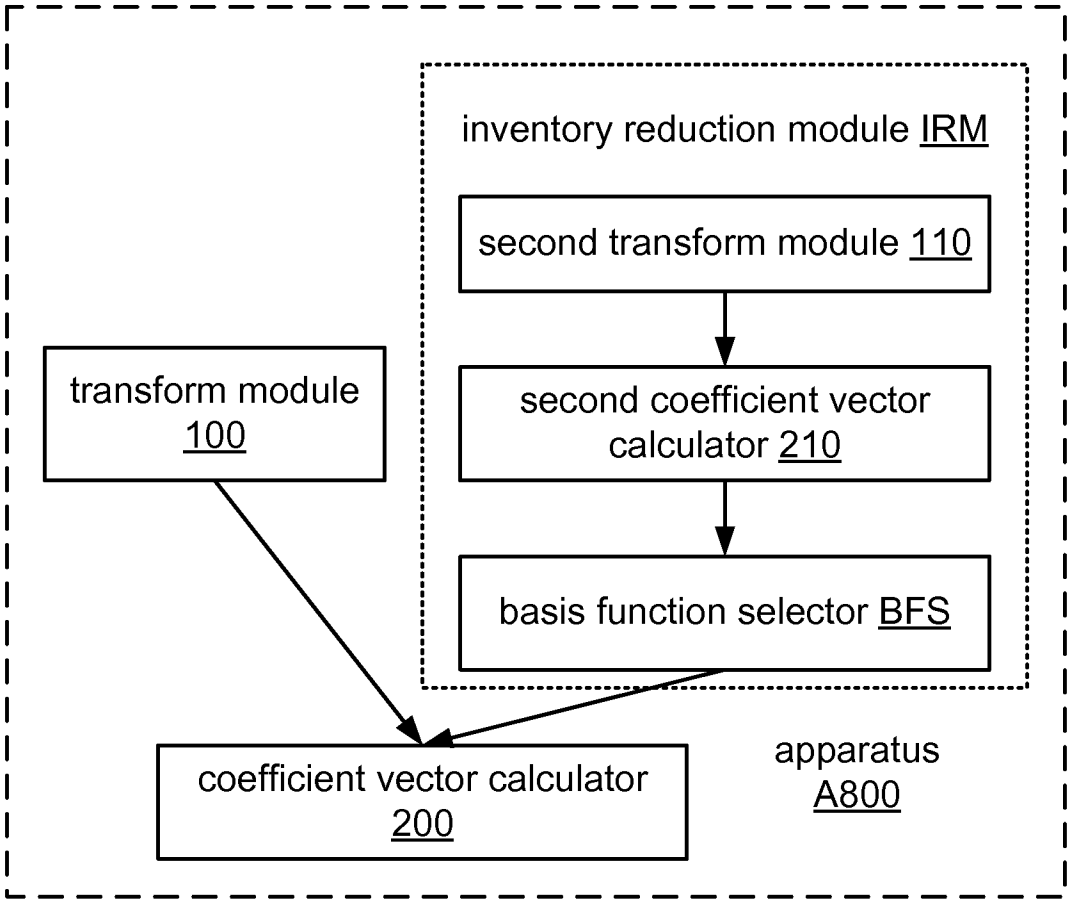
FIG. 5 shows a block diagram of an implementation A800 of apparatus A100.

FIG. 5 shows a block diagram of an implementation A800 of apparatus A100 that includes an inventory reduction module IRM configured to select the plurality of basis functions from a larger set of basis functions (e.g., from an inventory). Module IRM includes a second transform module 110 configured to calculate a signal representation for a segment in a nonlinear frequency domain (e.g., according to a constant-Q transform). Module IRM also includes a second coefficient vector calculator configured to calculate a second vector of activation coefficients, based on the calculated signal representation in the nonlinear frequency domain and on a second plurality of basis functions as described herein. Module IRM also includes a basis function selector that is configured to select the plurality of basis functions from among an inventory of basis functions, based on information from the second activation coefficient vector as described herein.

It may be desirable for method M100 to include onset detection (e.g., detecting the onset of a musical note) and post-processing to refine harmonic instrument sparse coefficients. The activation coefficient vector f may be considered to include a corresponding subvector $f_n$ for each instrument n that includes the activation coefficients for the instrument-specific basis function set $B_n$, and these subvectors may be processed independently. FIGS. 21 to 46 illustrate aspects of music decomposition using such a scheme on a composite signal example 1 (a piano and flute playing in the same octave) and a composite signal example 2 (a piano and flute playing in the same octave with percussion).

Figure 21:
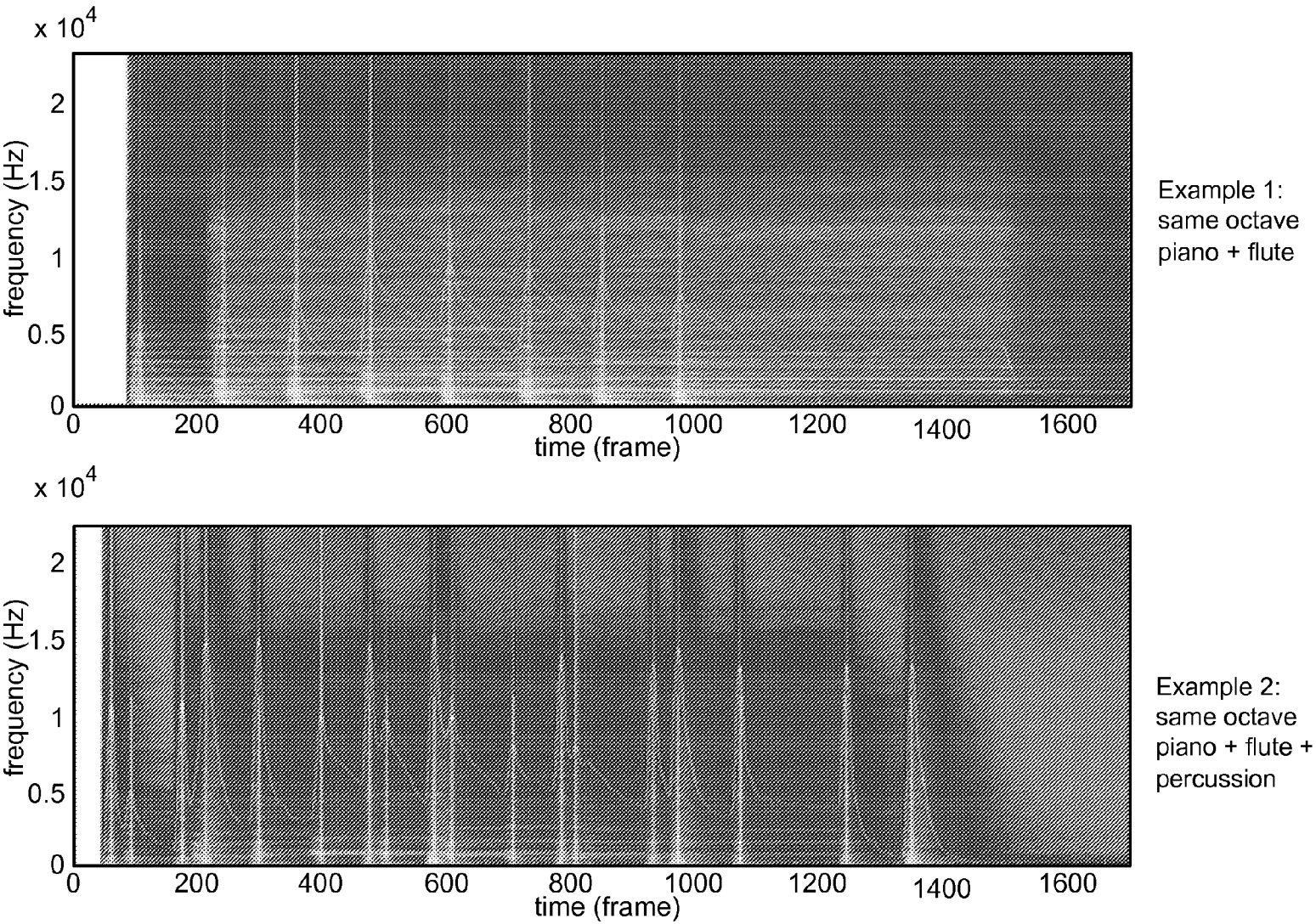
FIG. 21 shows spectrograms of results of applying an onset detection method to two different composite signal examples.

A general onset detection method may be based on spectral magnitude (e.g., energy difference). For example, such a method may include finding peaks based on spectral energy and/or peak slope. FIG. 21 shows spectrograms (frequency in Hz vs. time in frames) of results of applying such a method to composite signal example 1 (a piano and flute playing in the same octave) and composite signal example 2 (a piano and flute playing in the same octave with percussion), respectively, where the vertical lines indicate detected onsets.

It may be desirable also to detect an onset of each individual instrument. For example, a method of onset detection among harmonic instruments may be based on corresponding coefficient difference in time. In one such example, onset detection of a harmonic instrument n is triggered if the index of the highest-magnitude element of the coefficient vector for instrument n (subvector $f_n$) for the current frame is not equal to the index of the highest-magnitude element of the coefficient vector for instrument n for the previous frame. Such an operation may be iterated for each instrument.

It may be desirable to perform post-processing of the sparse coefficient vector of a harmonic instrument. For example, for harmonic instruments it may be desirable to keep a coefficient of the corresponding subvector that has a high magnitude and/or an attack profile that meets a specified criterion (e.g., is sufficiently sharp), and/or to remove (e.g., to zero out) residual coefficients.

For each harmonic instrument, it may be desirable to post-process the coefficient vector at each onset frame (e.g., when onset detection is indicated) such that the coefficient that has the dominant magnitude and an acceptable attack time is kept and residual coefficients are zeroed. The attack time may be evaluated according to a criterion such as average magnitude over time. In one such example, each coefficient for the instrument for the current frame t is zeroed out (i.e., the attack time is not acceptable) if the current average value of the coefficient is less than a past average value of the coefficient (e.g., if the sum of the values of the coefficient over a current window, such as from frame (t−5) to frame (t+4)) is less than the sum of the values of the coefficient over a past window, such as from frame (t−15) to frame (t−6)). Such post-processing of the coefficient vector for a harmonic instrument at each onset frame may also include keeping the coefficient with the largest magnitude and zeroing out the other coefficients. For each harmonic instrument at each non-onset frame, it may be desirable to post-process the coefficient vector to keep only the coefficient whose value in the previous frame was non-zero, and to zero out the other coefficients of the vector.

Figure 22:
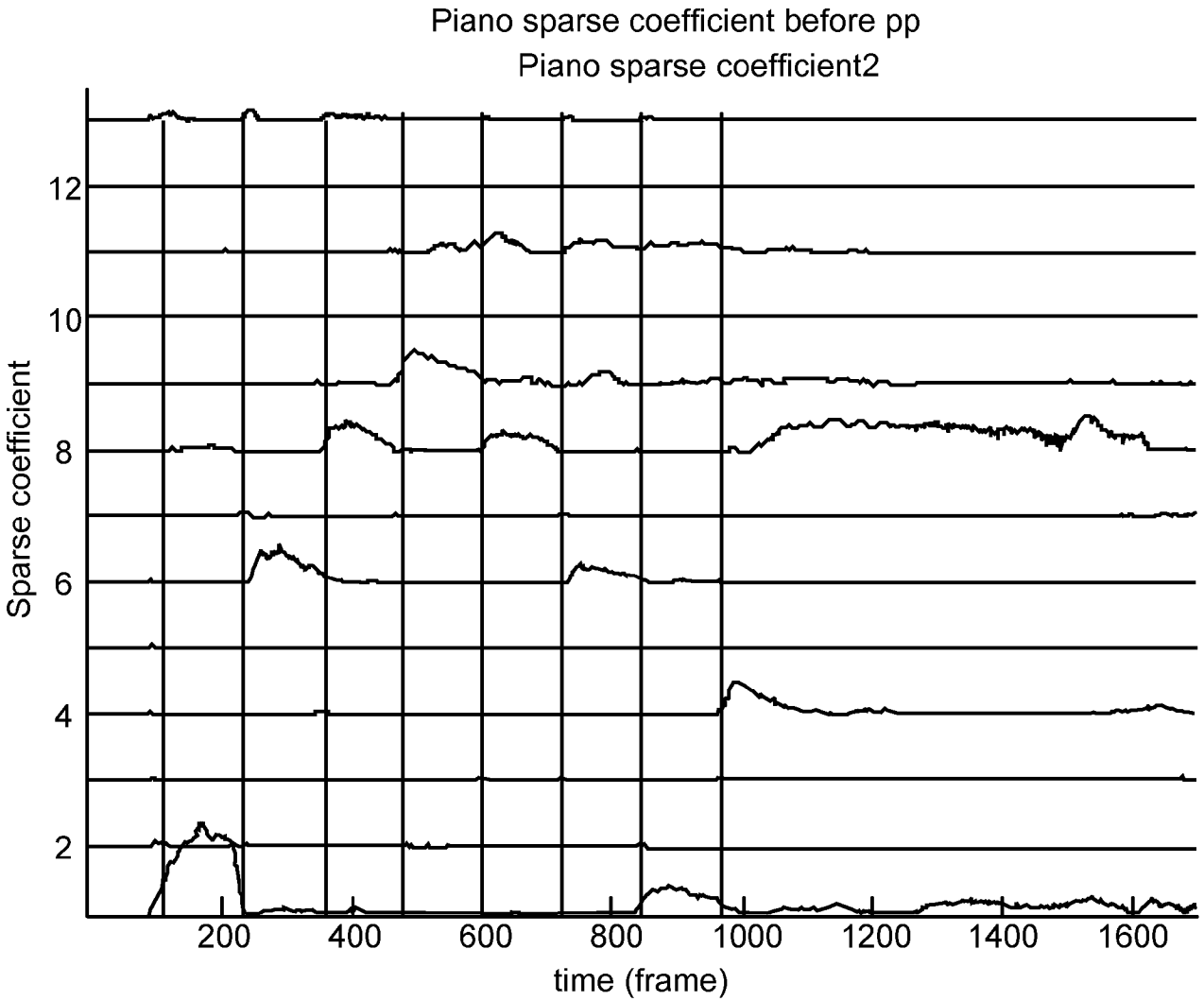
FIGS. 22-25 demonstrate results of applying onset-detection-based post-processing to a first composite signal example.
Figure 23:
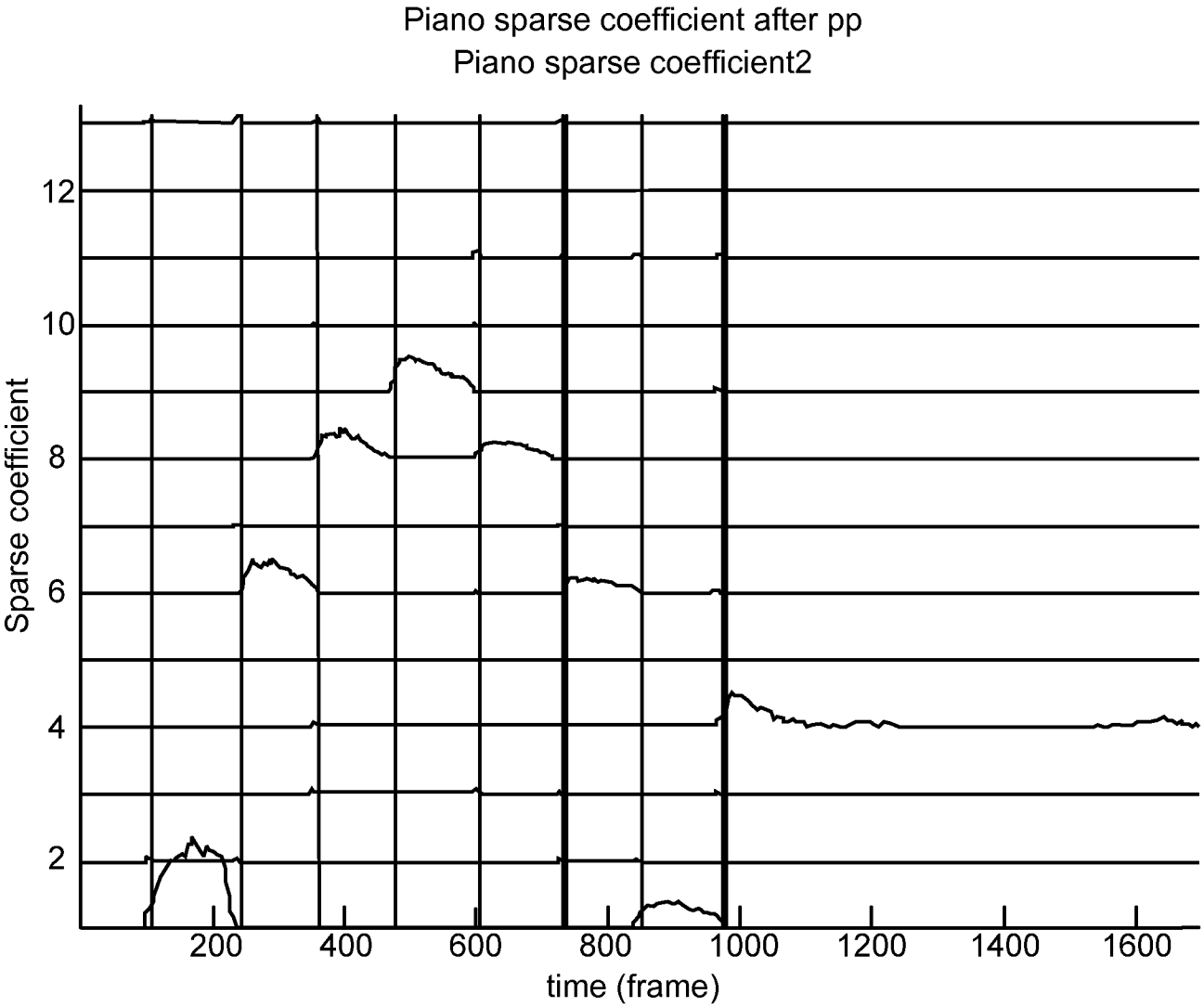
Figure 24:
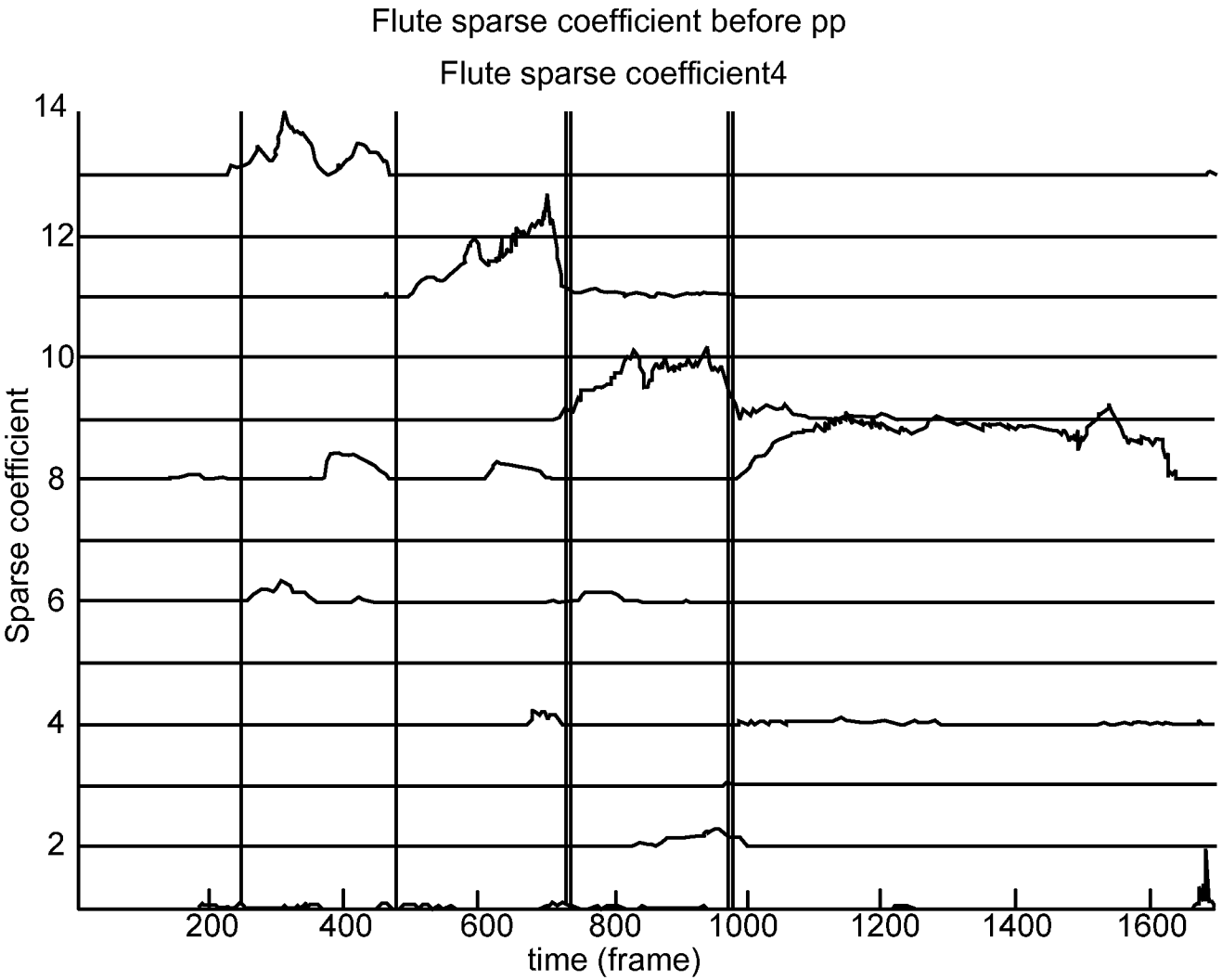
Figure 25:
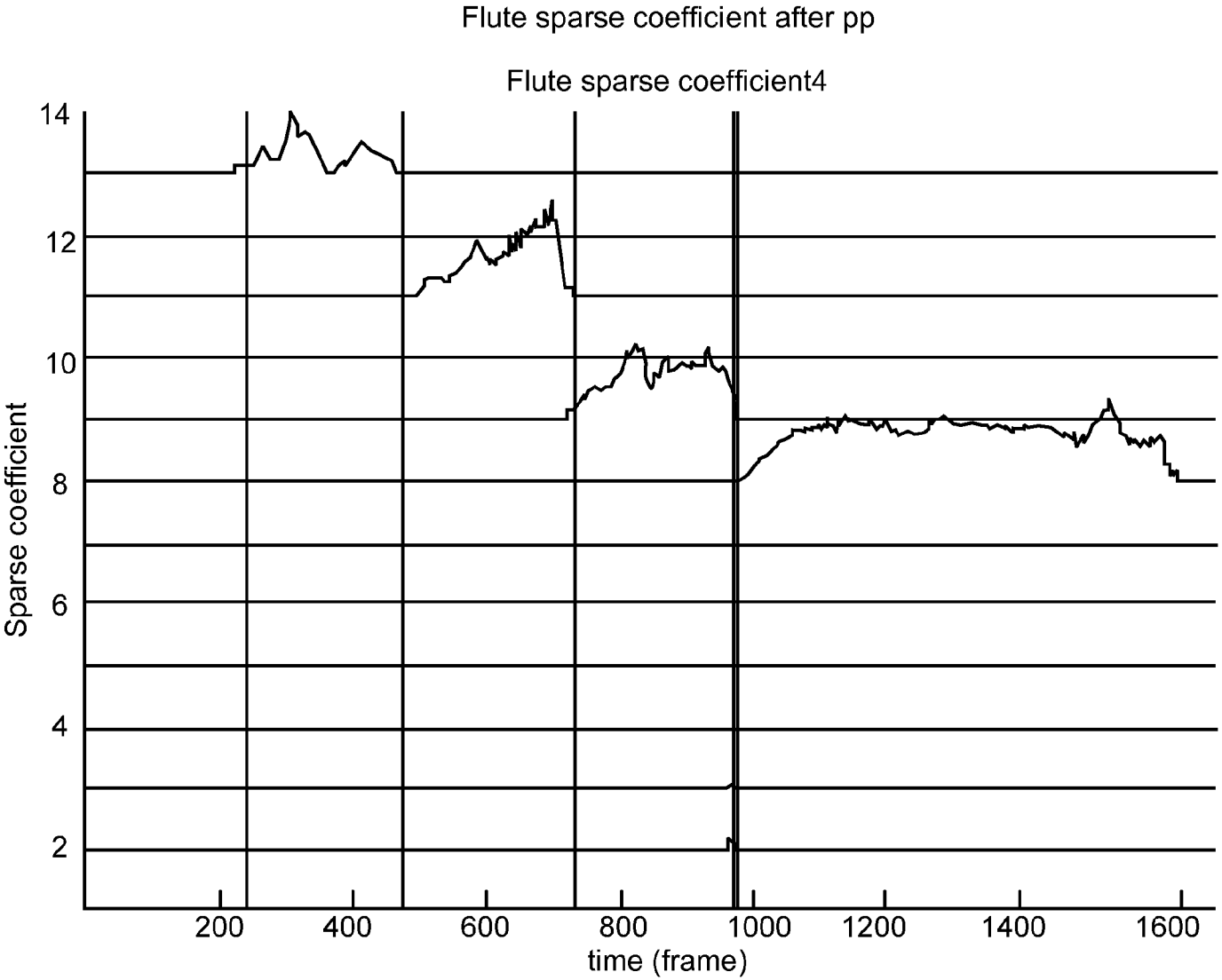

FIGS. 22-25 demonstrate results of applying onset-detection-based post-processing to composite signal example 1 (a piano and flute in playing the same octave). In these figures, the vertical axis is sparse coefficient index, the horizontal axis is time in frames, and the vertical lines indicate frames at which onset detection is indicated. FIGS. 22 and 23 show piano sparse coefficients before and after post-processing, respectively. FIGS. 24 and 25 show flute sparse coefficients before and after post-processing, respectively.

Figure 26:
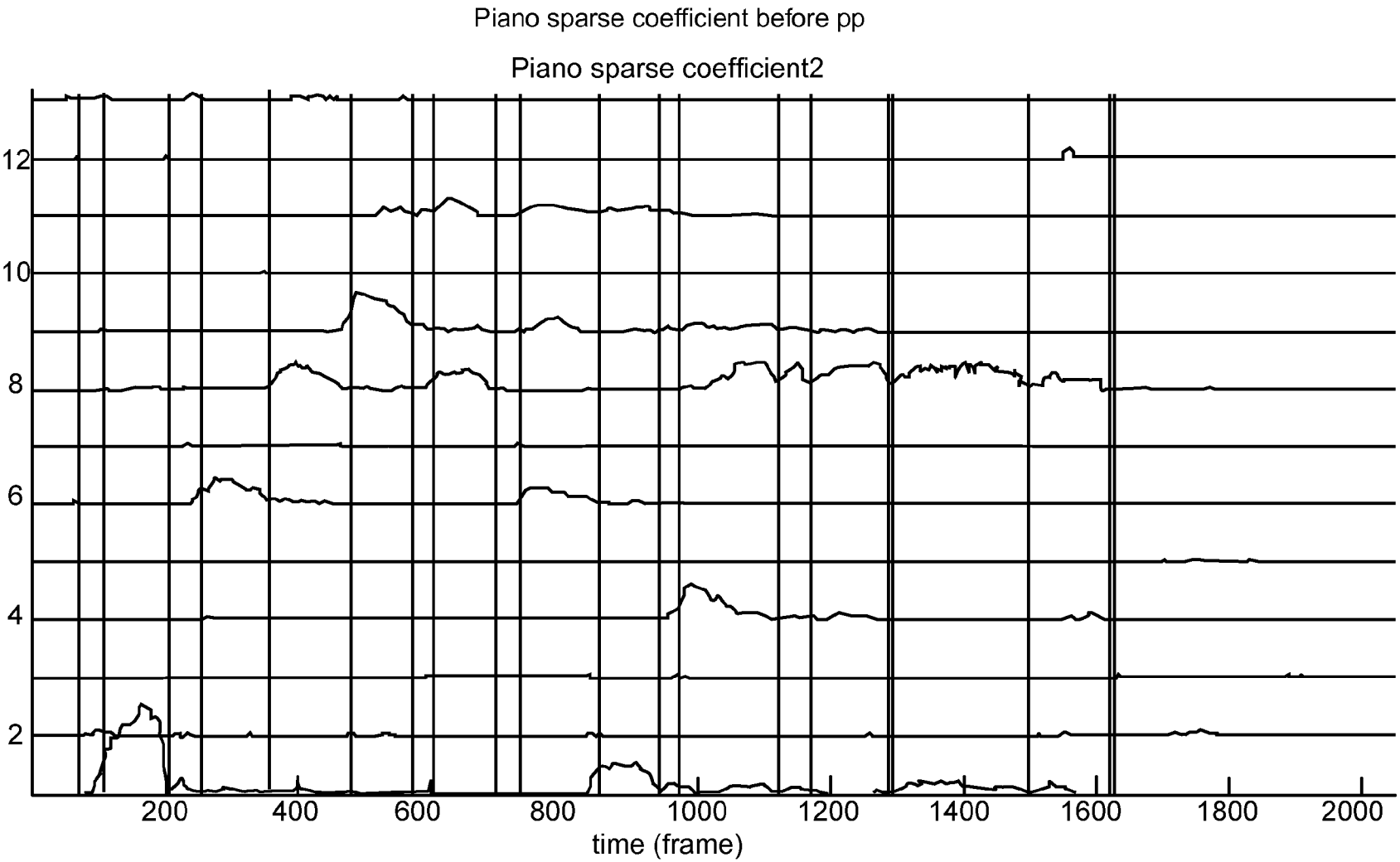
FIGS. 26-32 demonstrate results of applying onset-detection-based post-processing to a second composite signal example.
Figure 27:
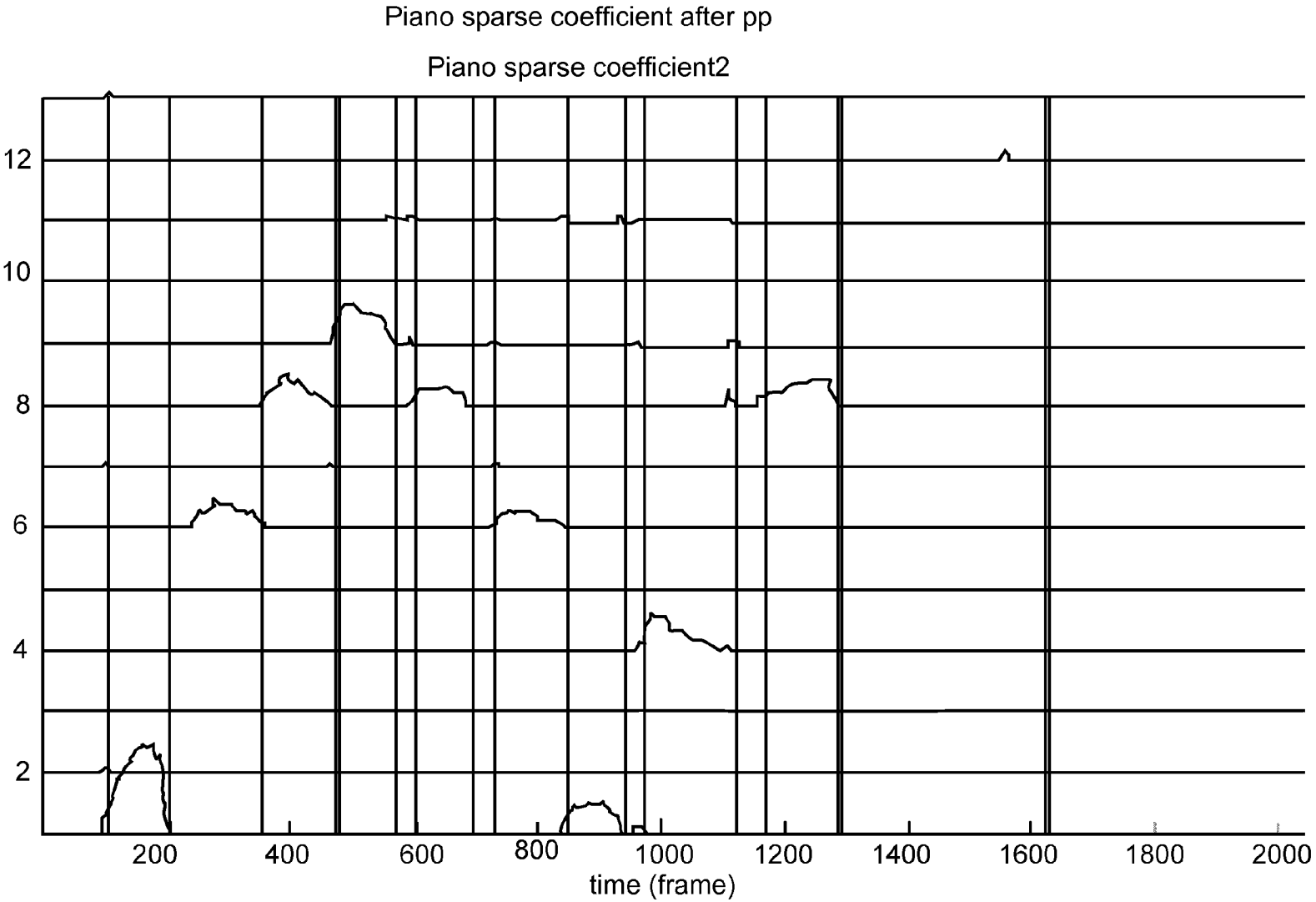
Figure 28:
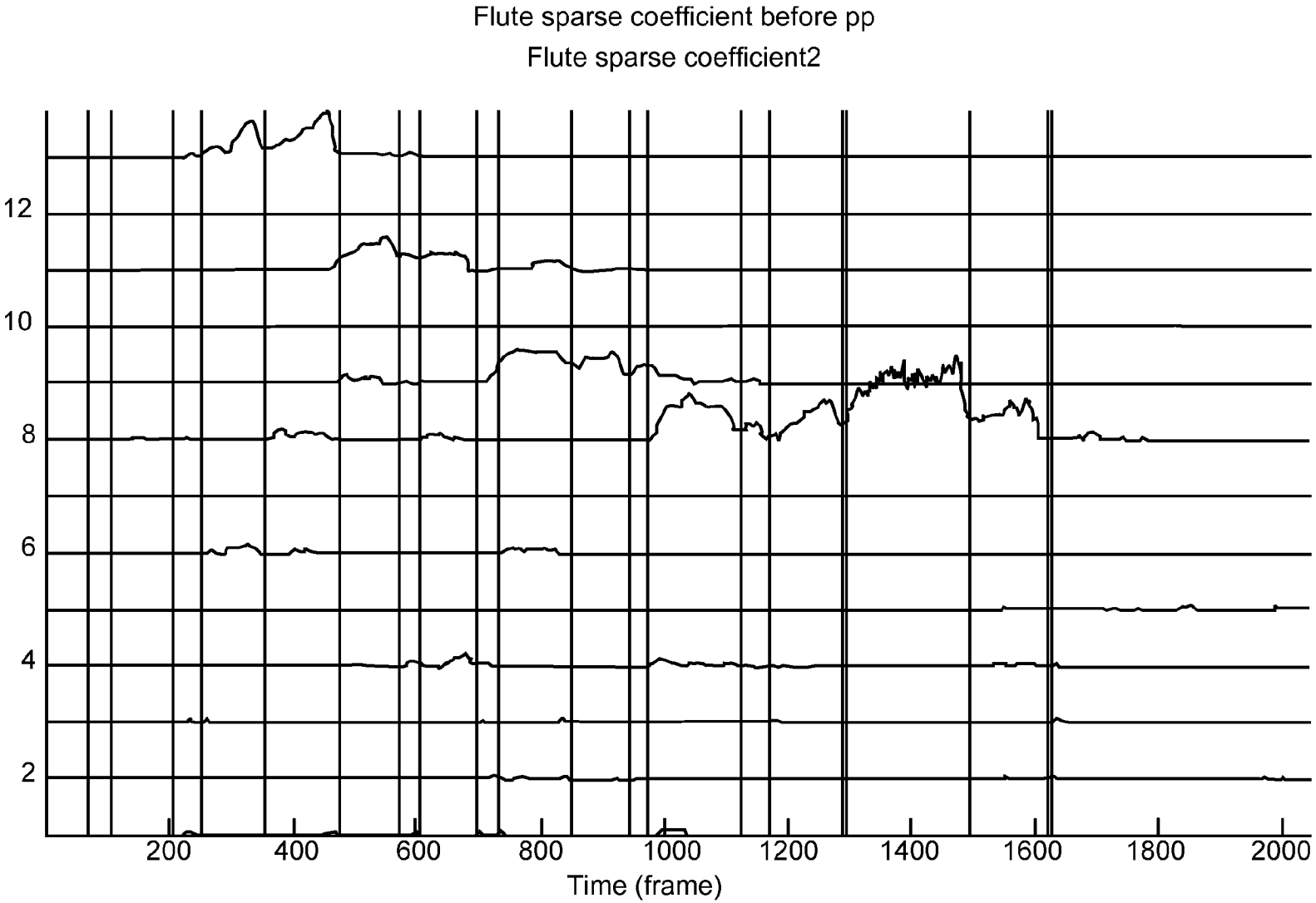
Figure 29:
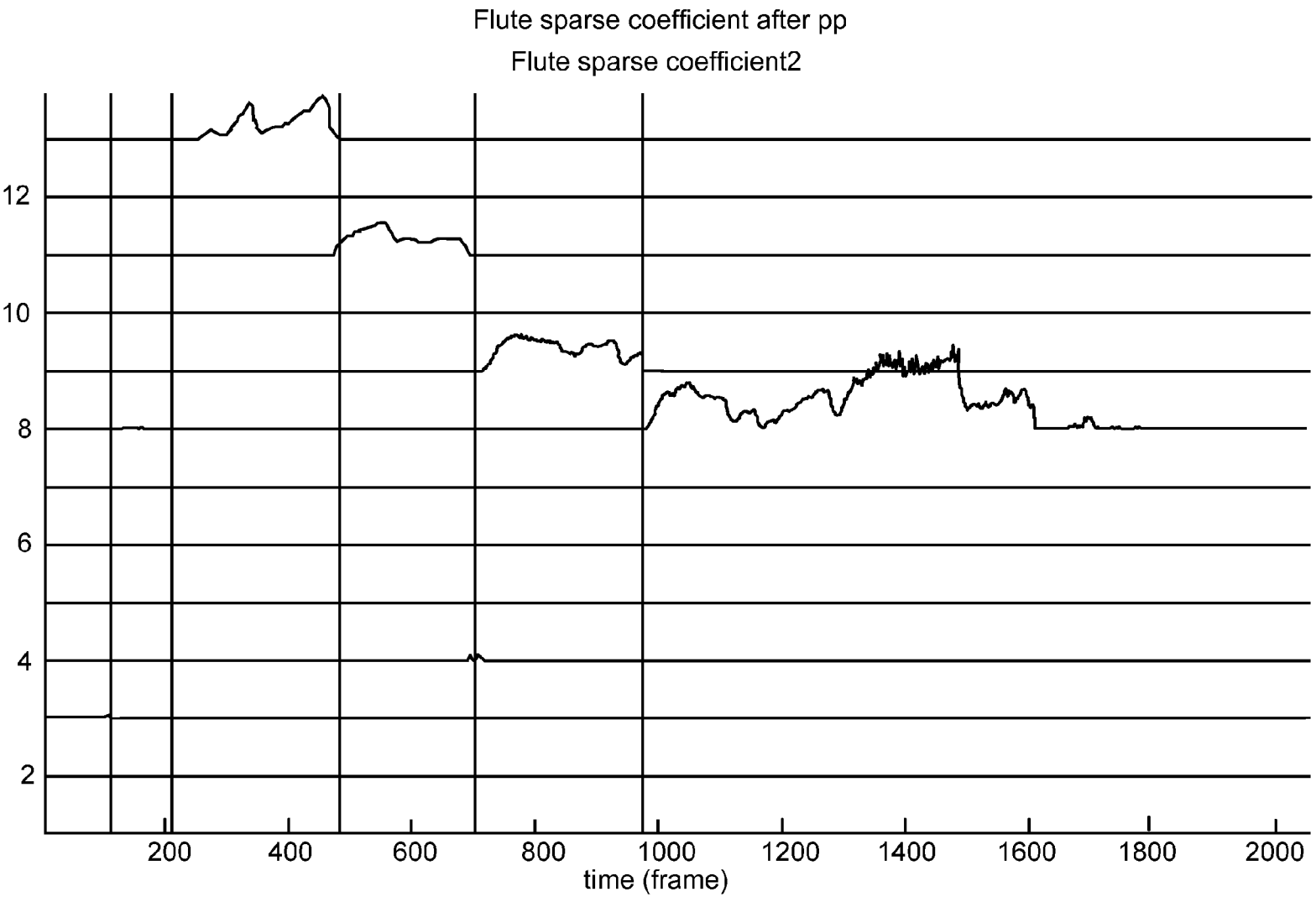
Figure 30:
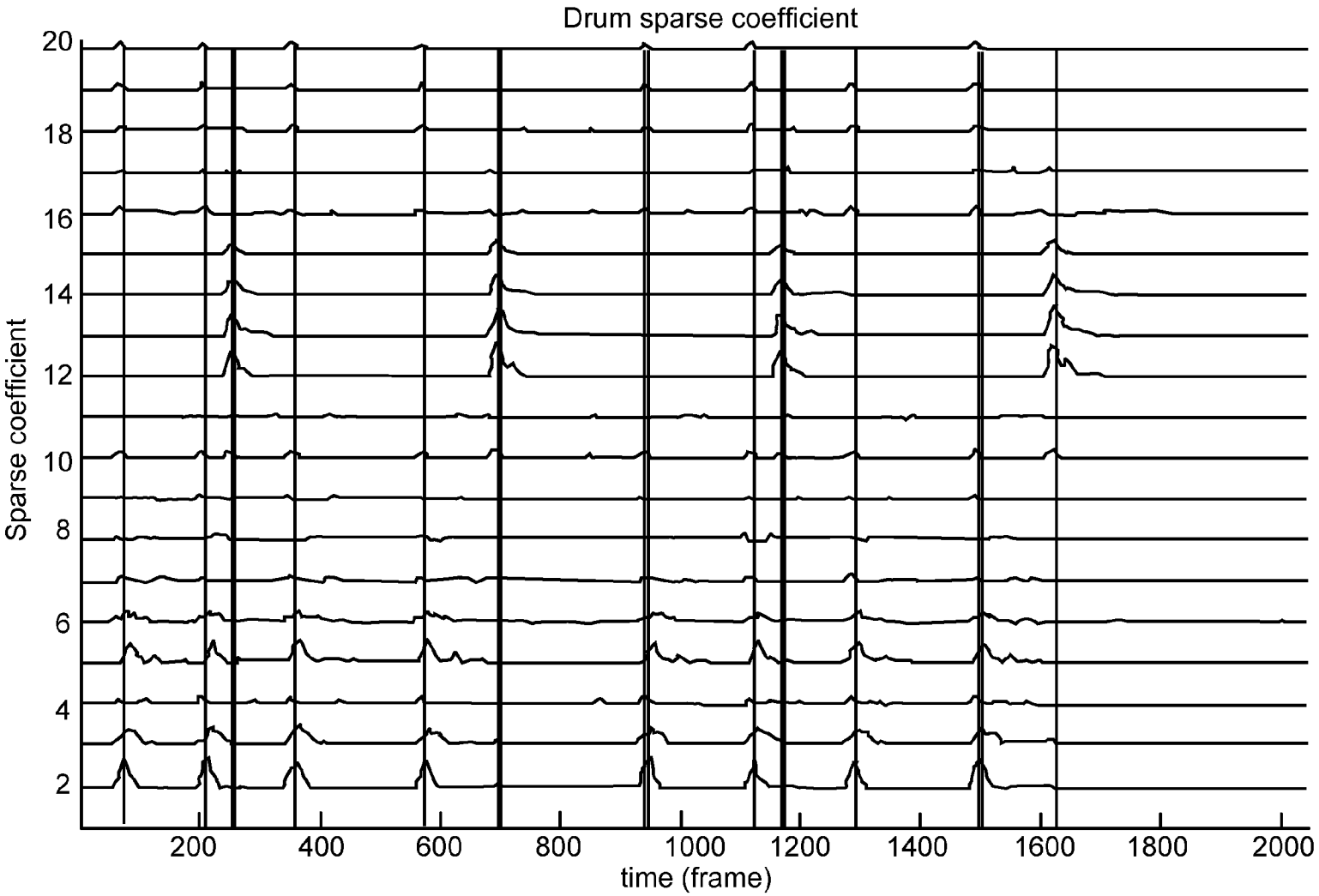

FIGS. 26-30 demonstrate results of applying onset-detection-based post-processing to composite signal example 2 (a piano and flute playing in the same octave with percussion). In these figures, the vertical axis is sparse coefficient index, the horizontal axis is time in frames, and the vertical lines indicate frames at which onset detection is indicated. FIGS. 26 and 27 show piano sparse coefficients before and after post-processing, respectively. FIGS. 28 and 29 show flute sparse coefficients before and after post-processing, respectively. FIG. 30 shows drum sparse coefficients.

Figure 31:
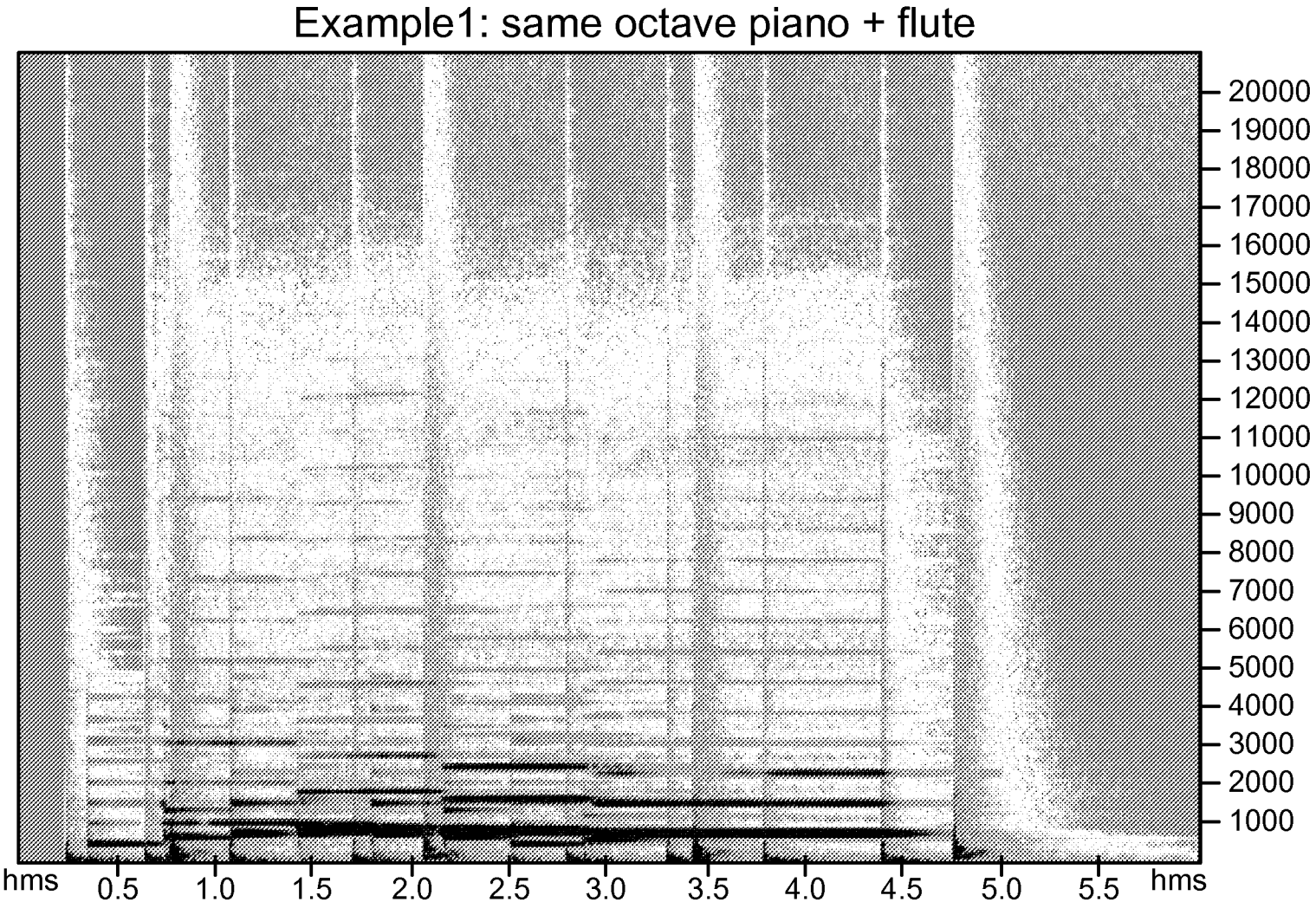
Figure 32:
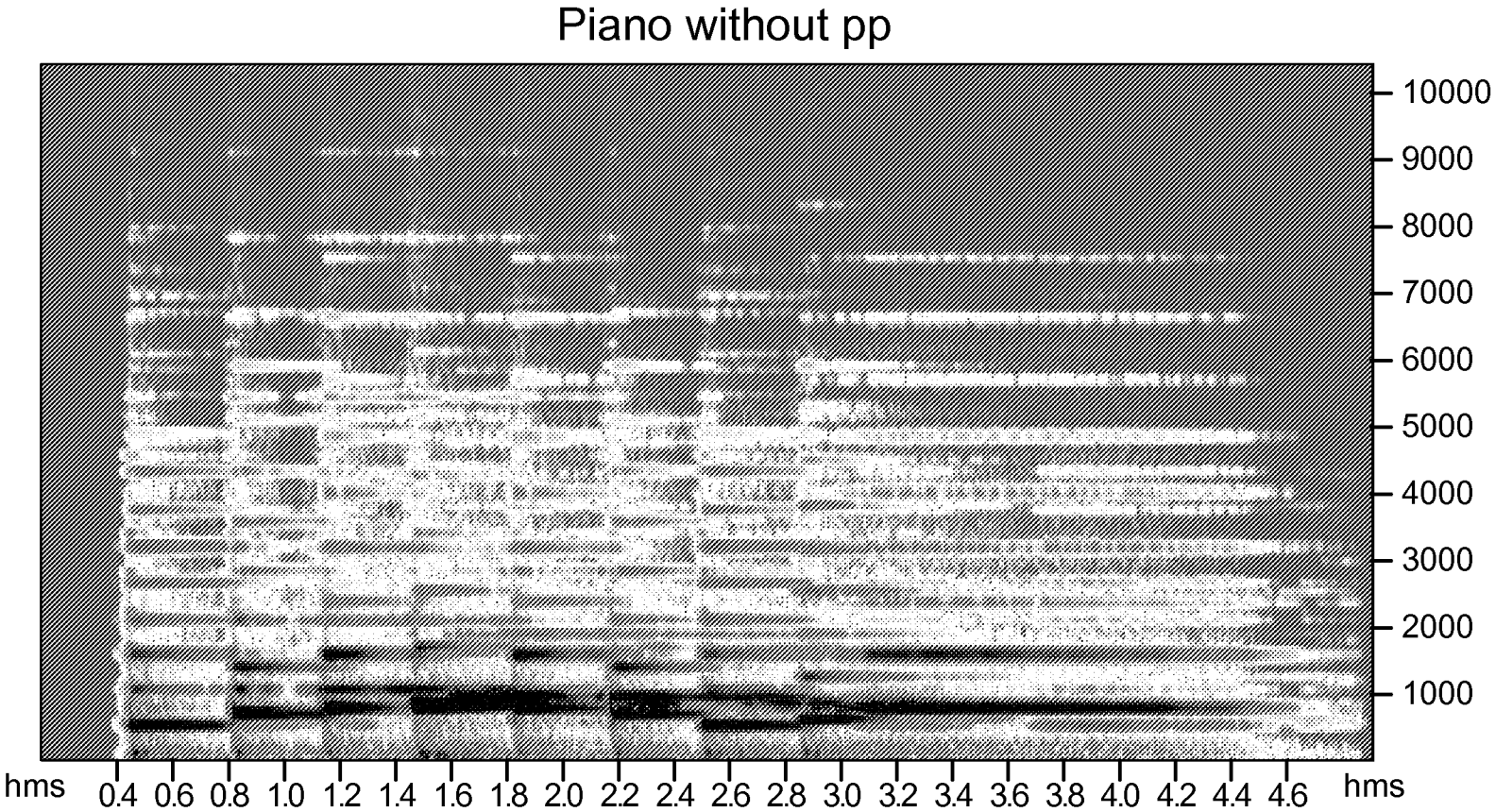
Figure 33:
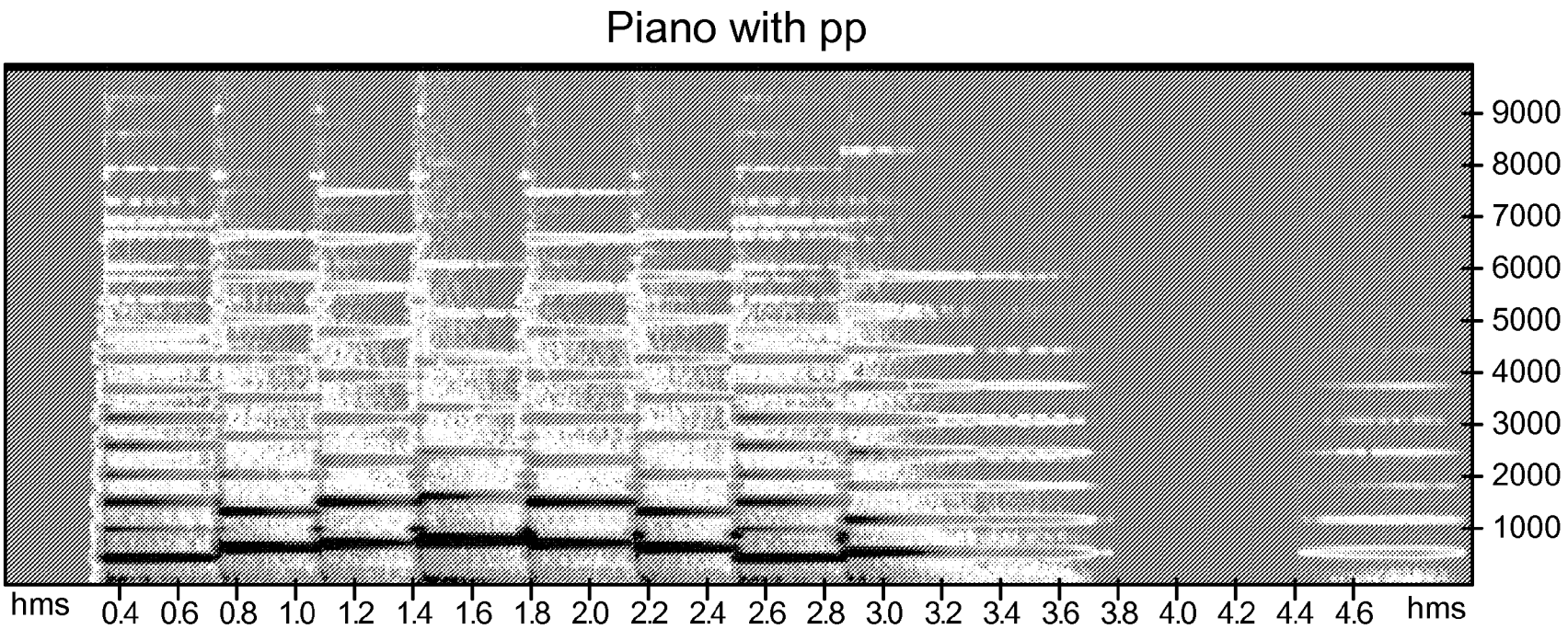
FIGS. 33-39 are spectrograms that demonstrate results of applying onset-detection-based post-processing to a first composite signal example.
Figure 34:
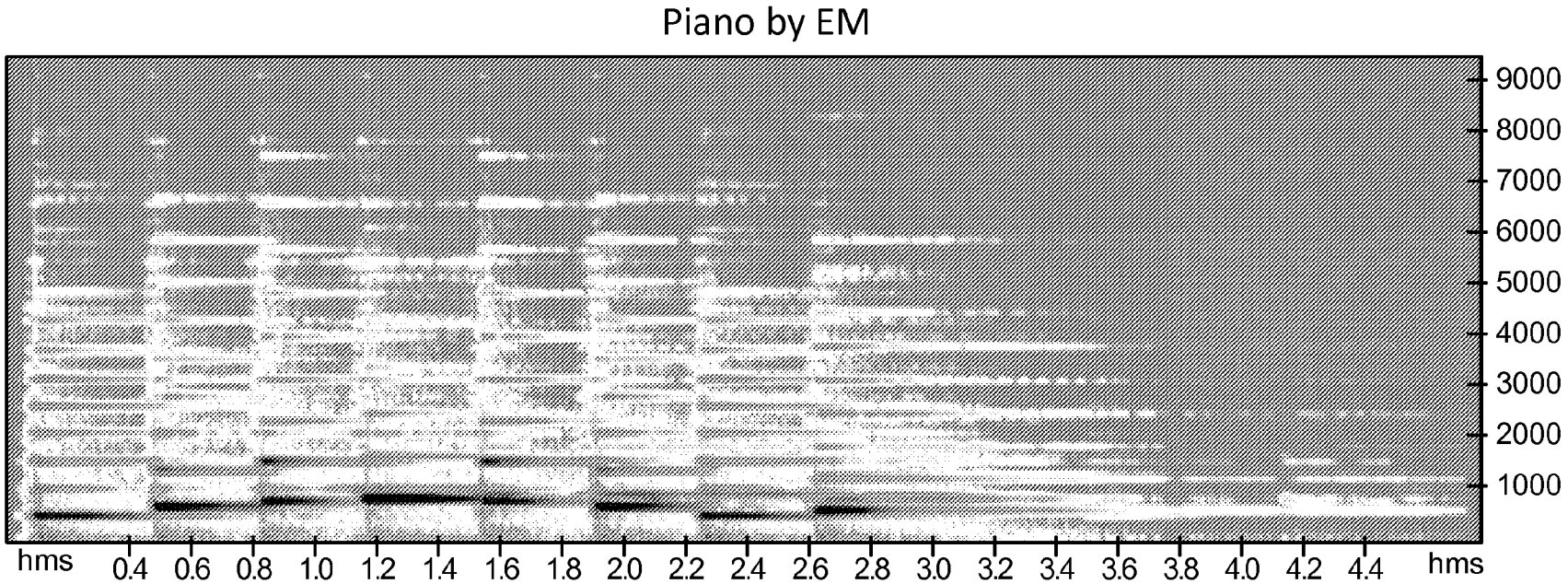
Figure 35:
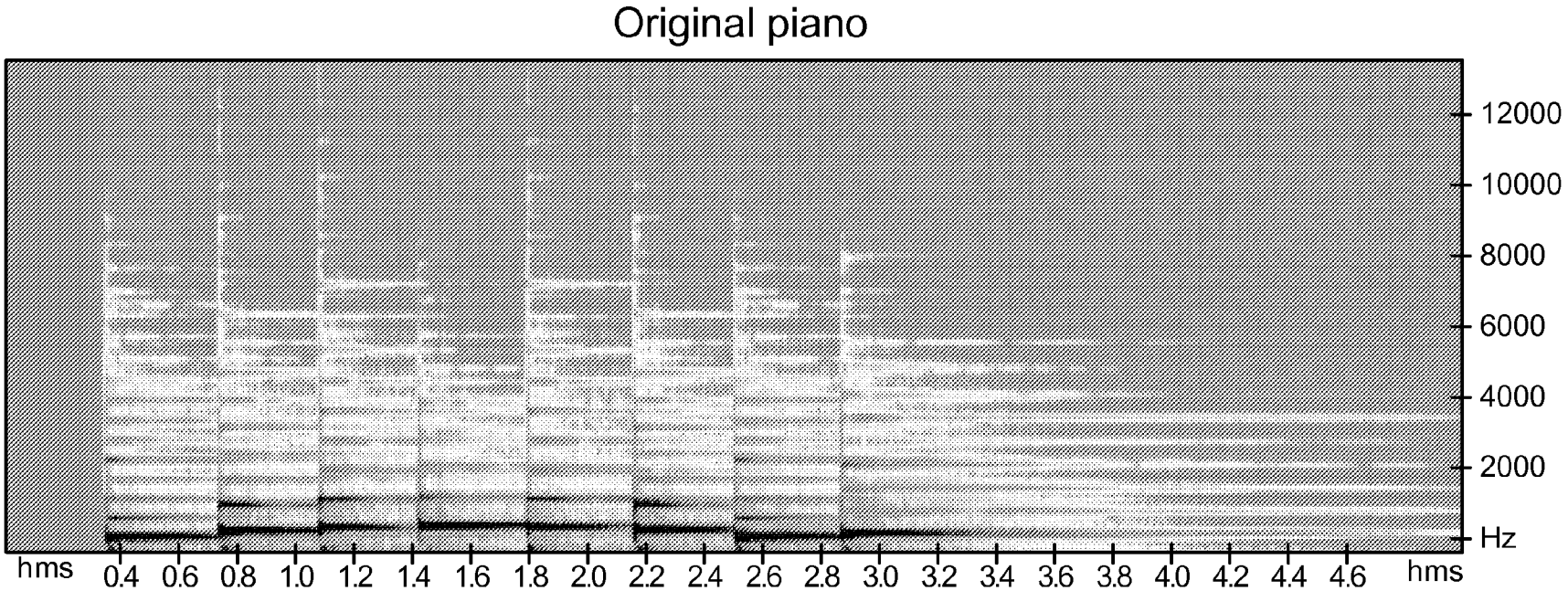
Figure 36:
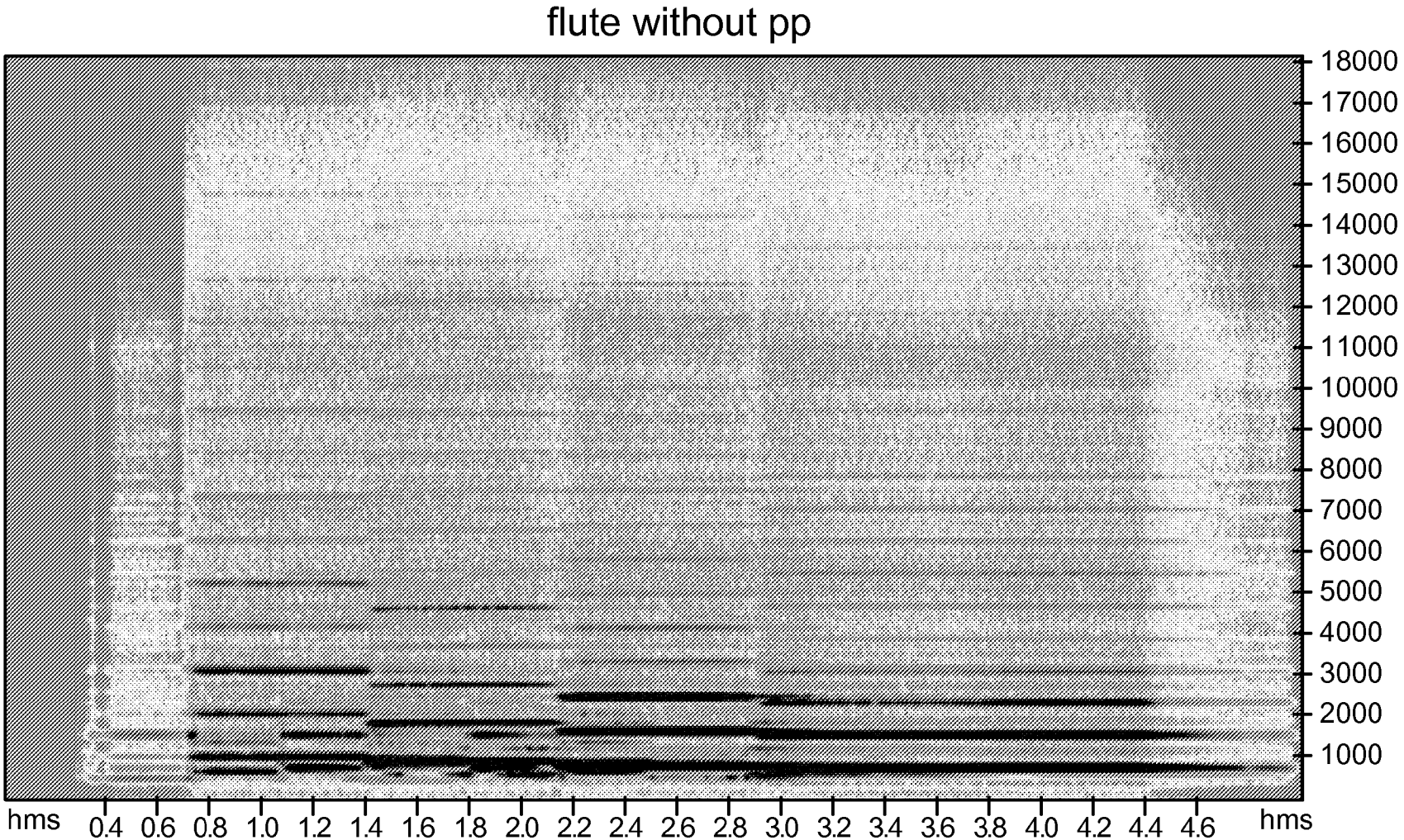
Figure 37:
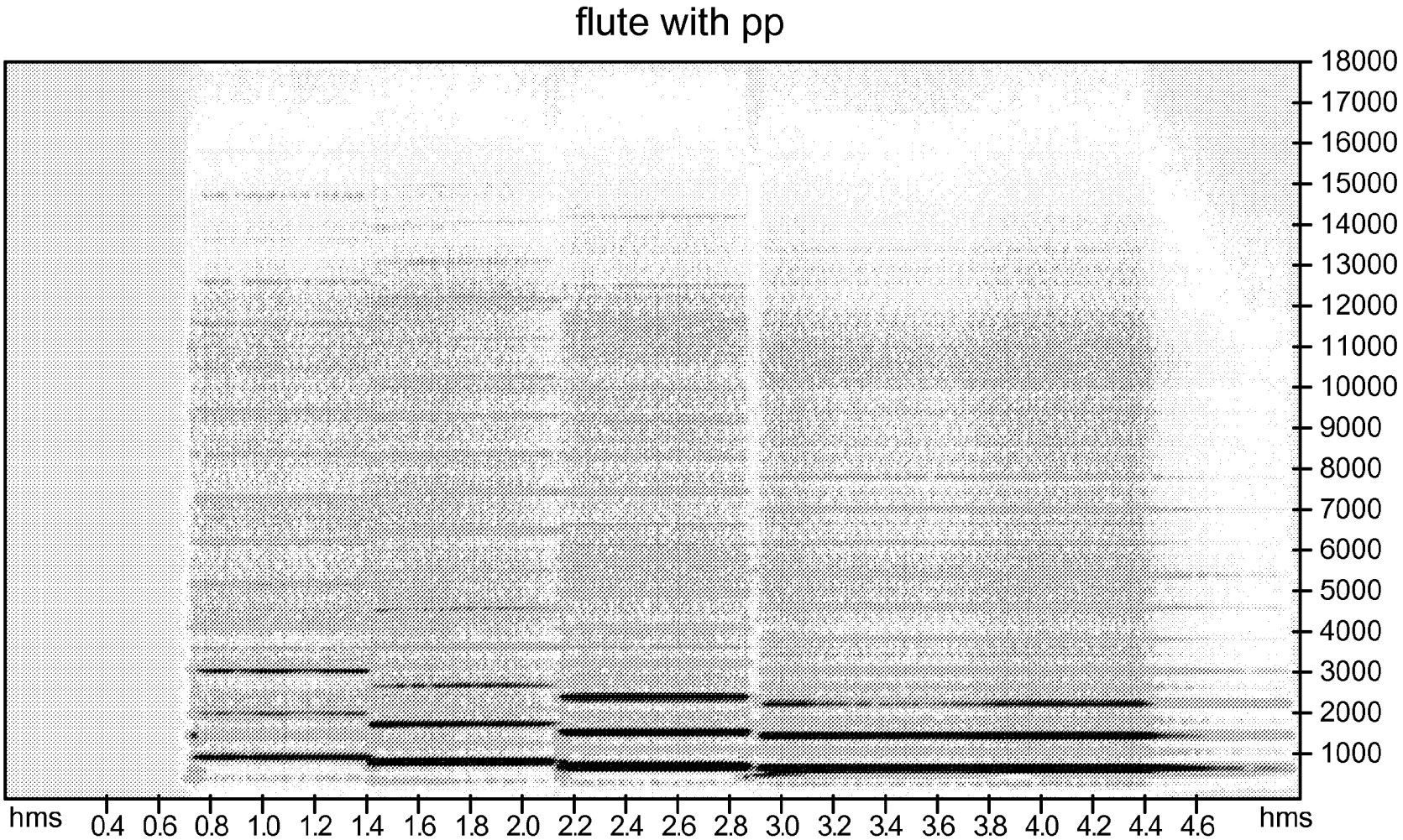
Figure 38:
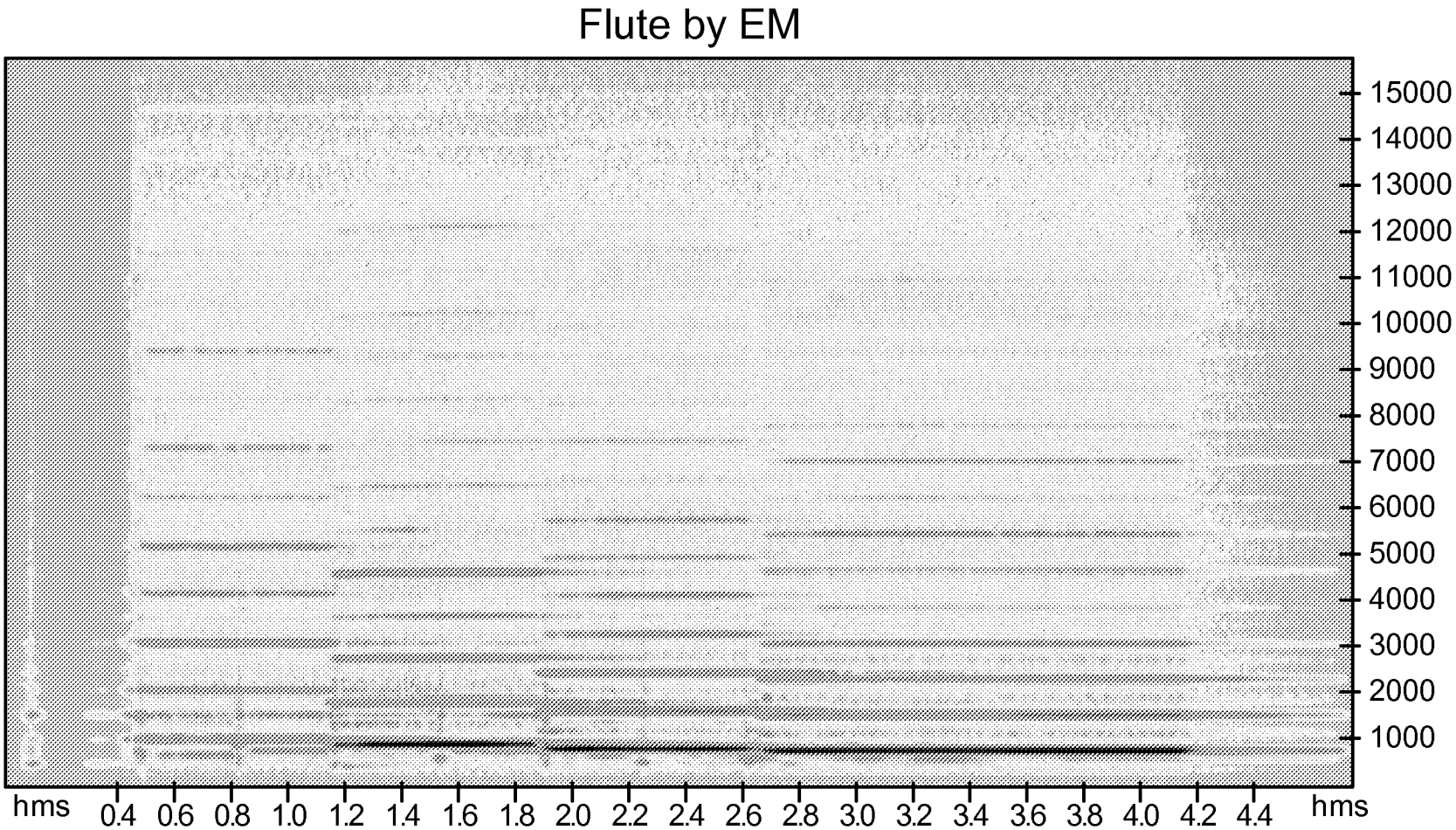
Figure 39:
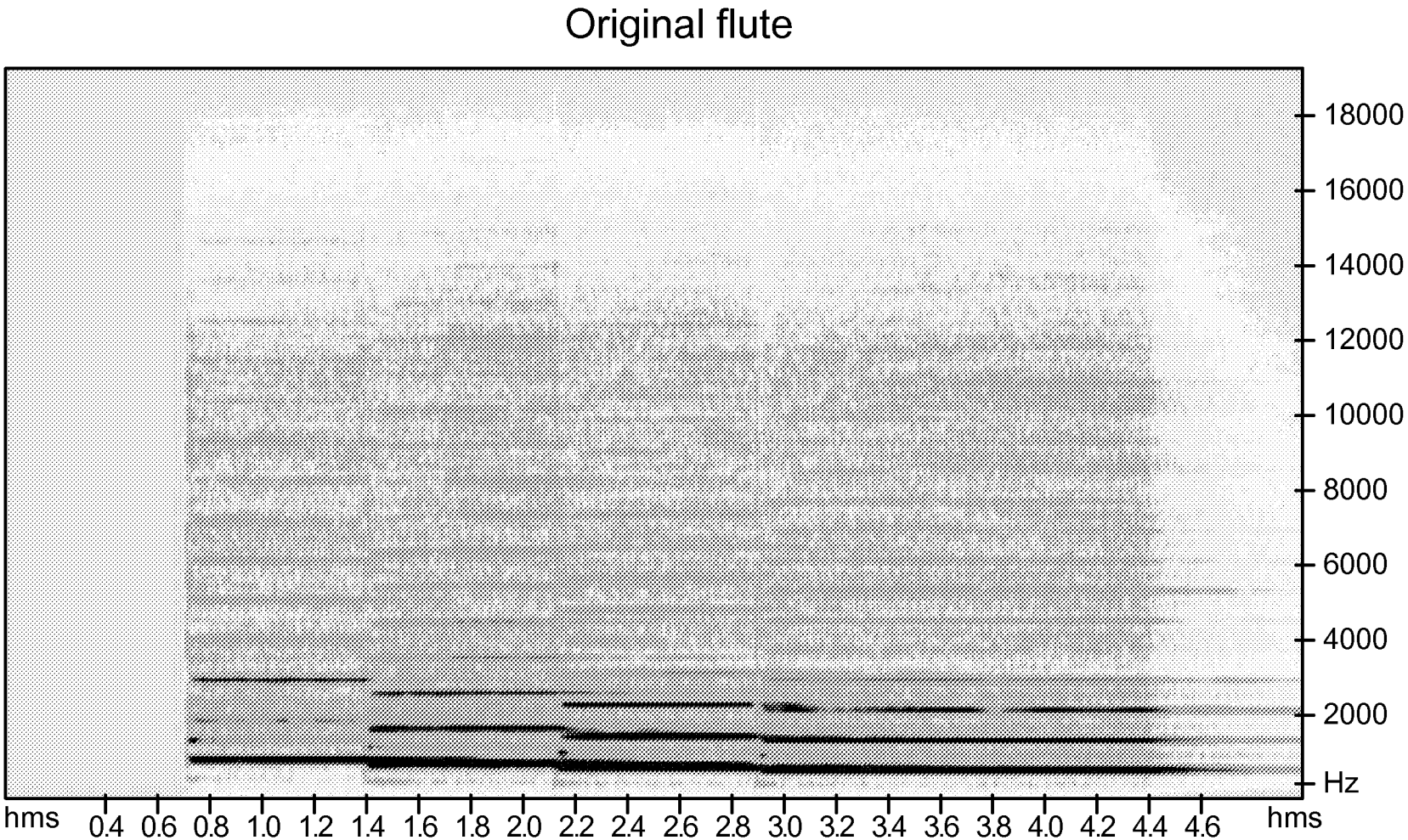

FIGS. 31-39 are spectrograms that demonstrate results of applying an onset detection method as described herein to composite signal example 1 (a piano and flute playing in the same octave). FIG. 31 shows a spectrogram of the original composite signal. FIG. 32 shows a spectrogram of the piano component reconstructed without post-processing. FIG. 33 shows a spectrogram of the piano component reconstructed with post-processing. FIG. 34 shows piano as modeled by an inventory obtained using an EM algorithm FIG. 35 shows original piano. FIG. 36 shows a spectrogram of the flute component reconstructed without post-processing. FIG. 37 shows a spectrogram of the flute component reconstructed with post-processing. FIG. 38 shows a flute as modeled by an inventory obtained using an EM algorithm FIG. 39 shows a spectrogram of the original flute component.

Figure 40:
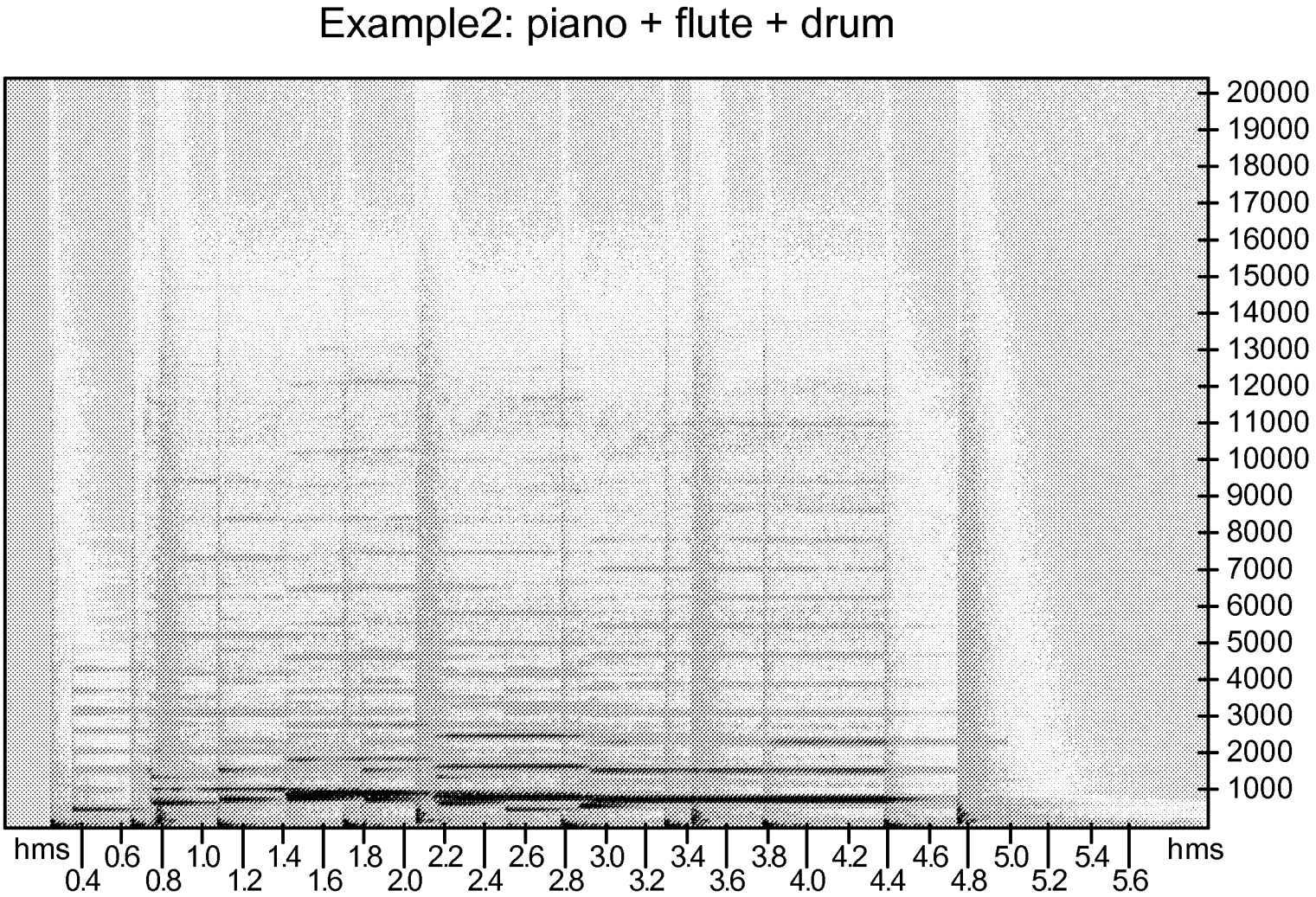
FIGS. 40-46 are spectrograms that demonstrate results of applying onset-detection-based post-processing to a second composite signal example.
Figure 41:
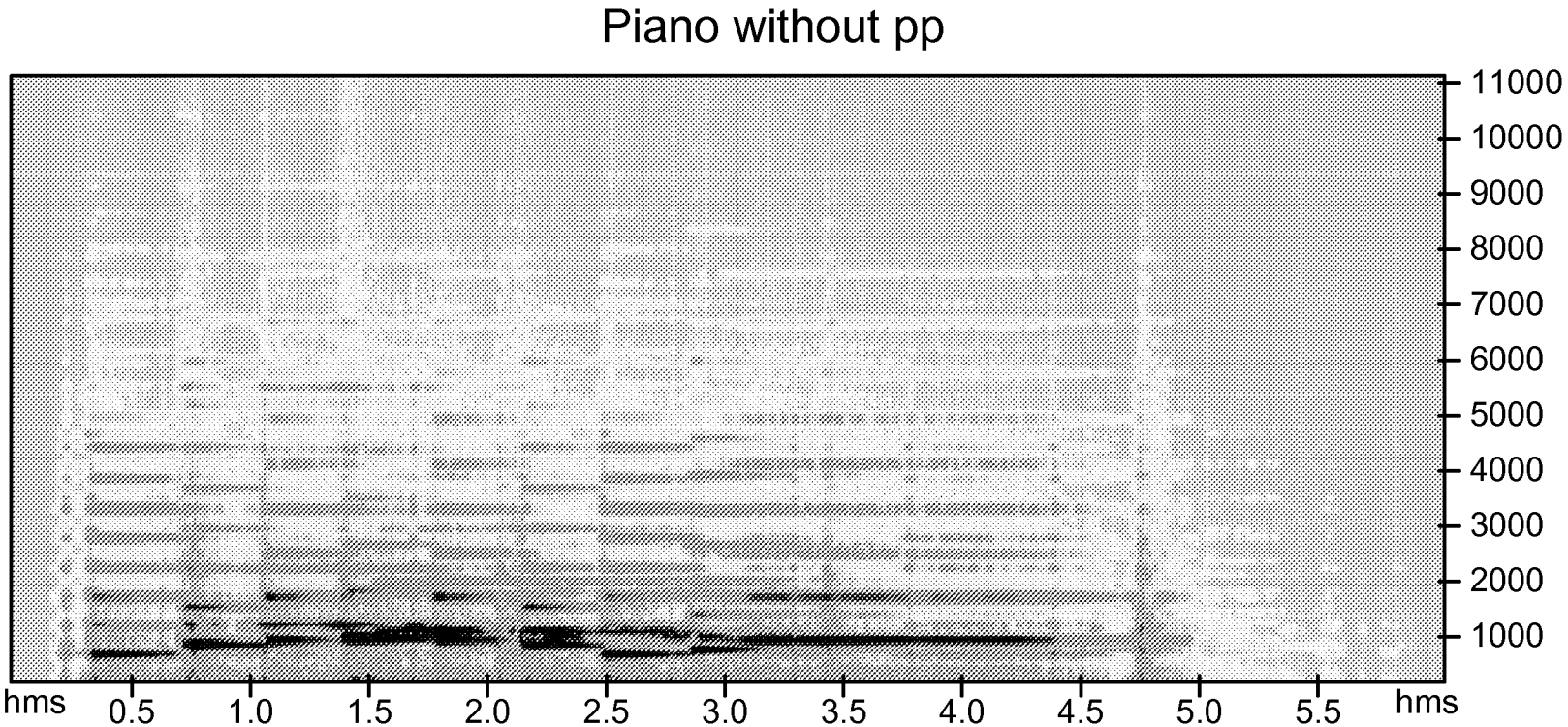
Figure 42:
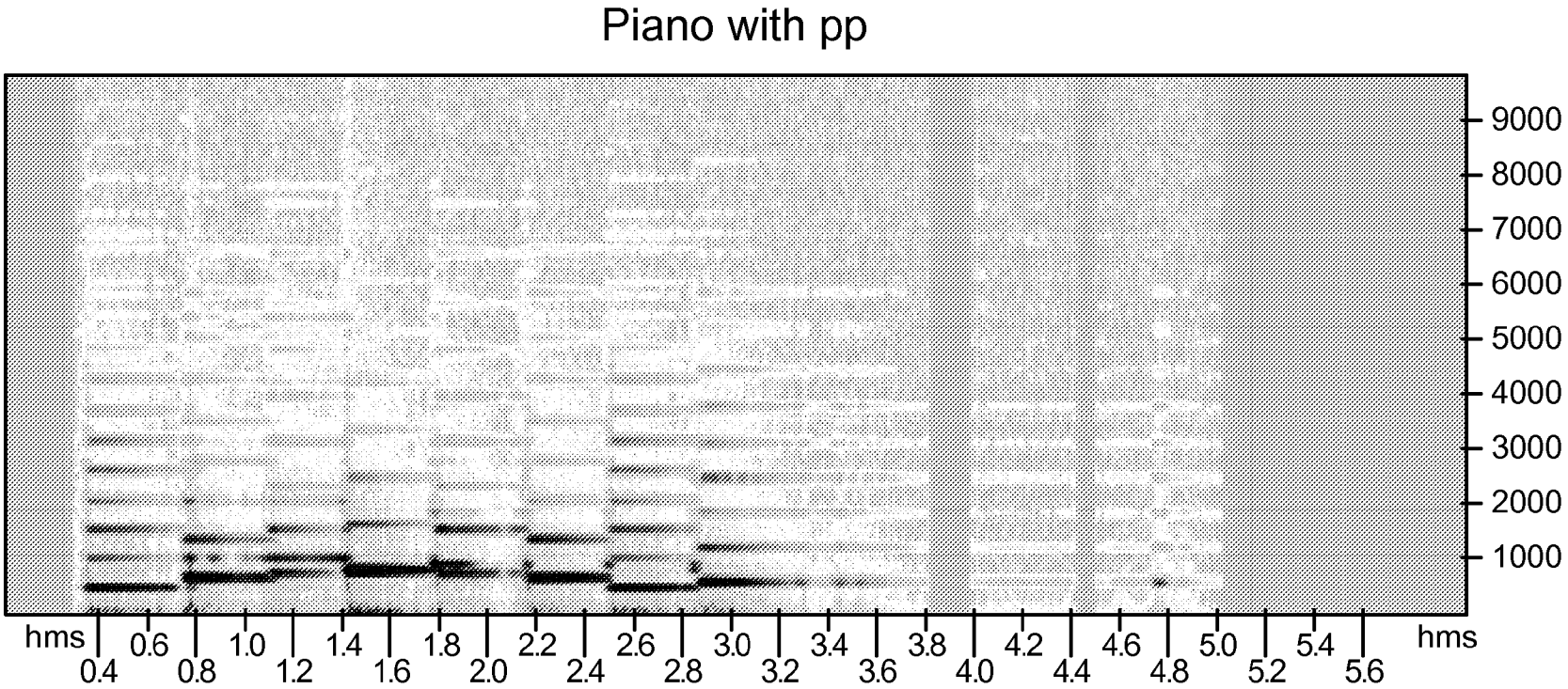
Figure 43:
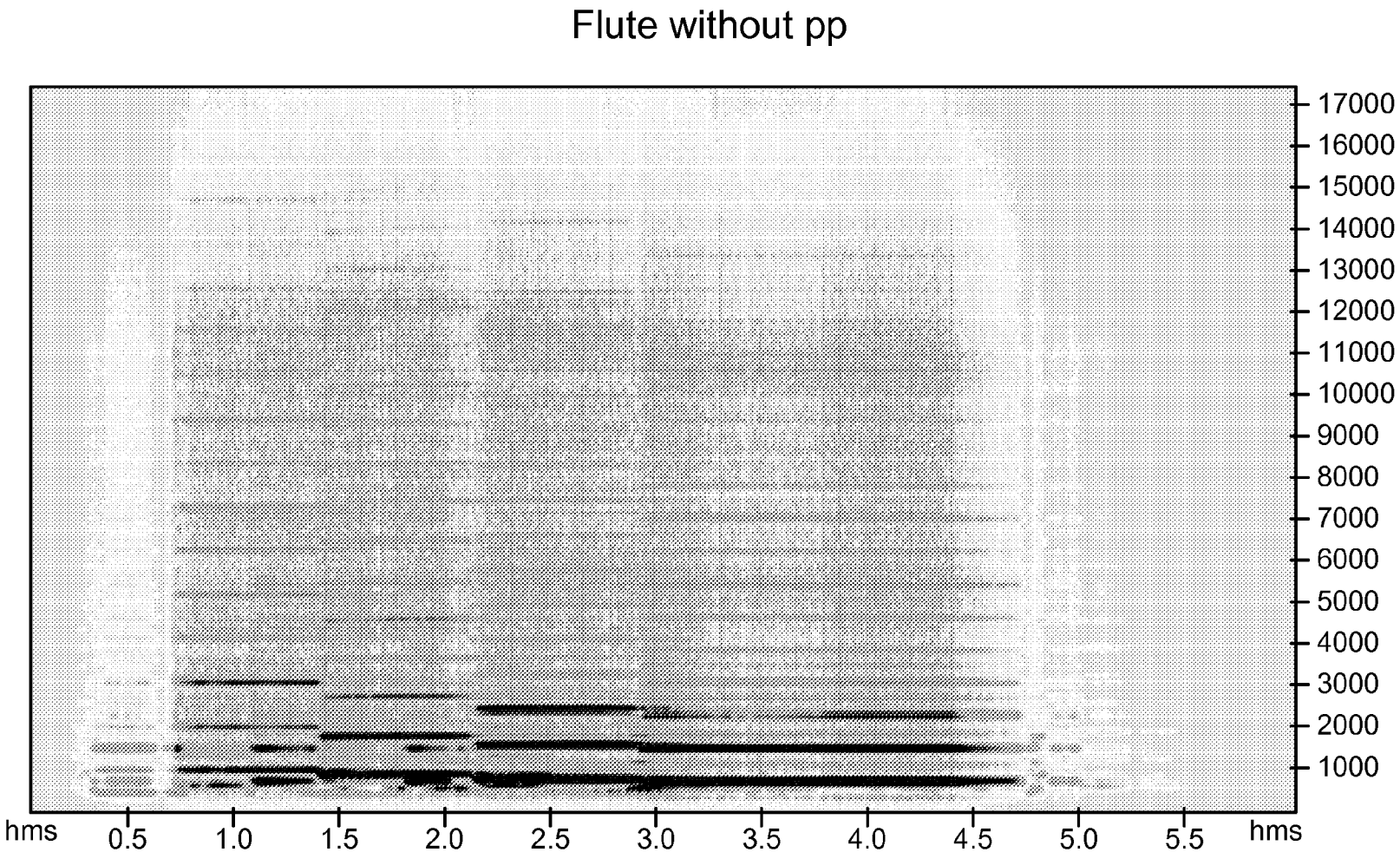
Figure 44:
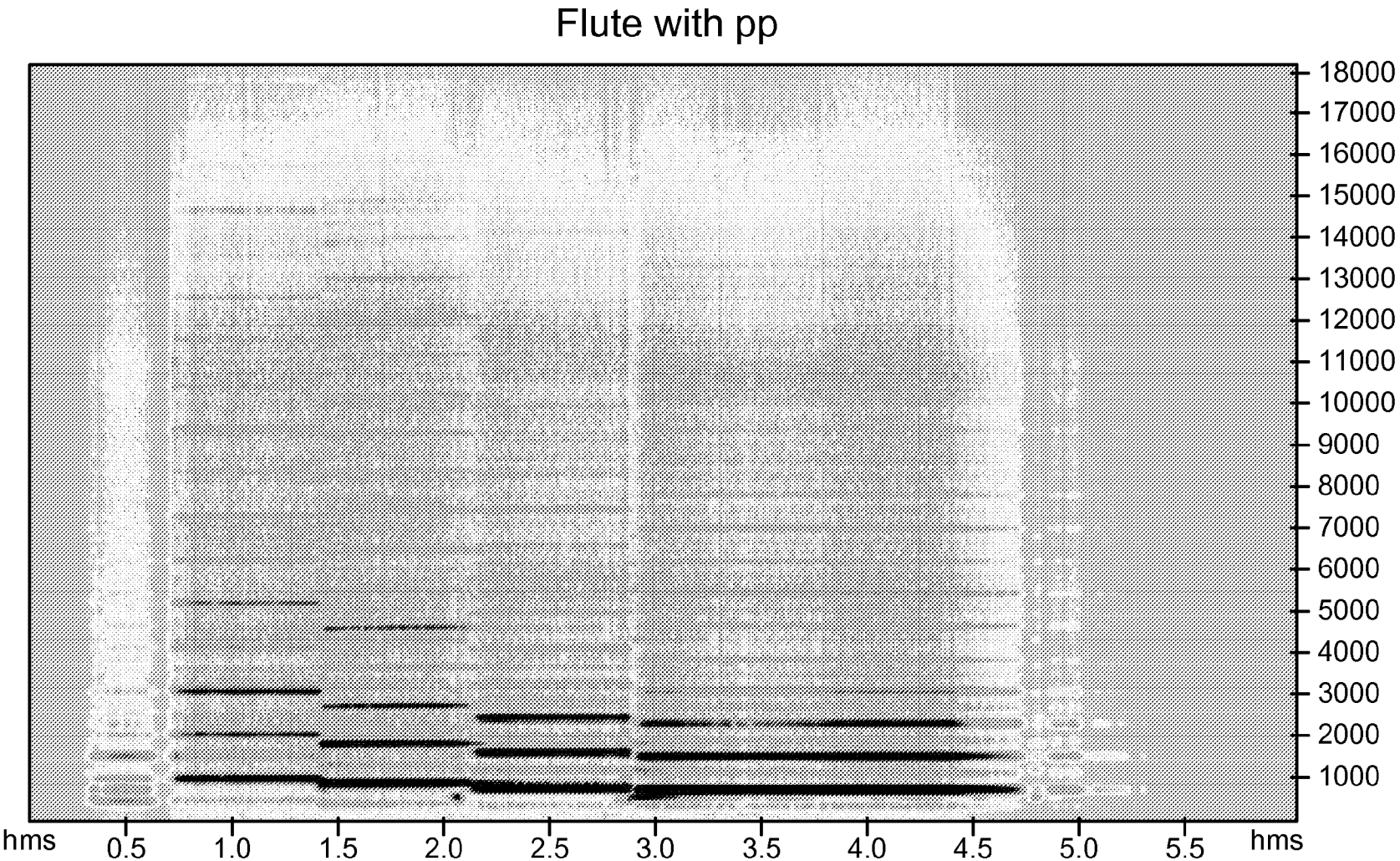
Figure 45:
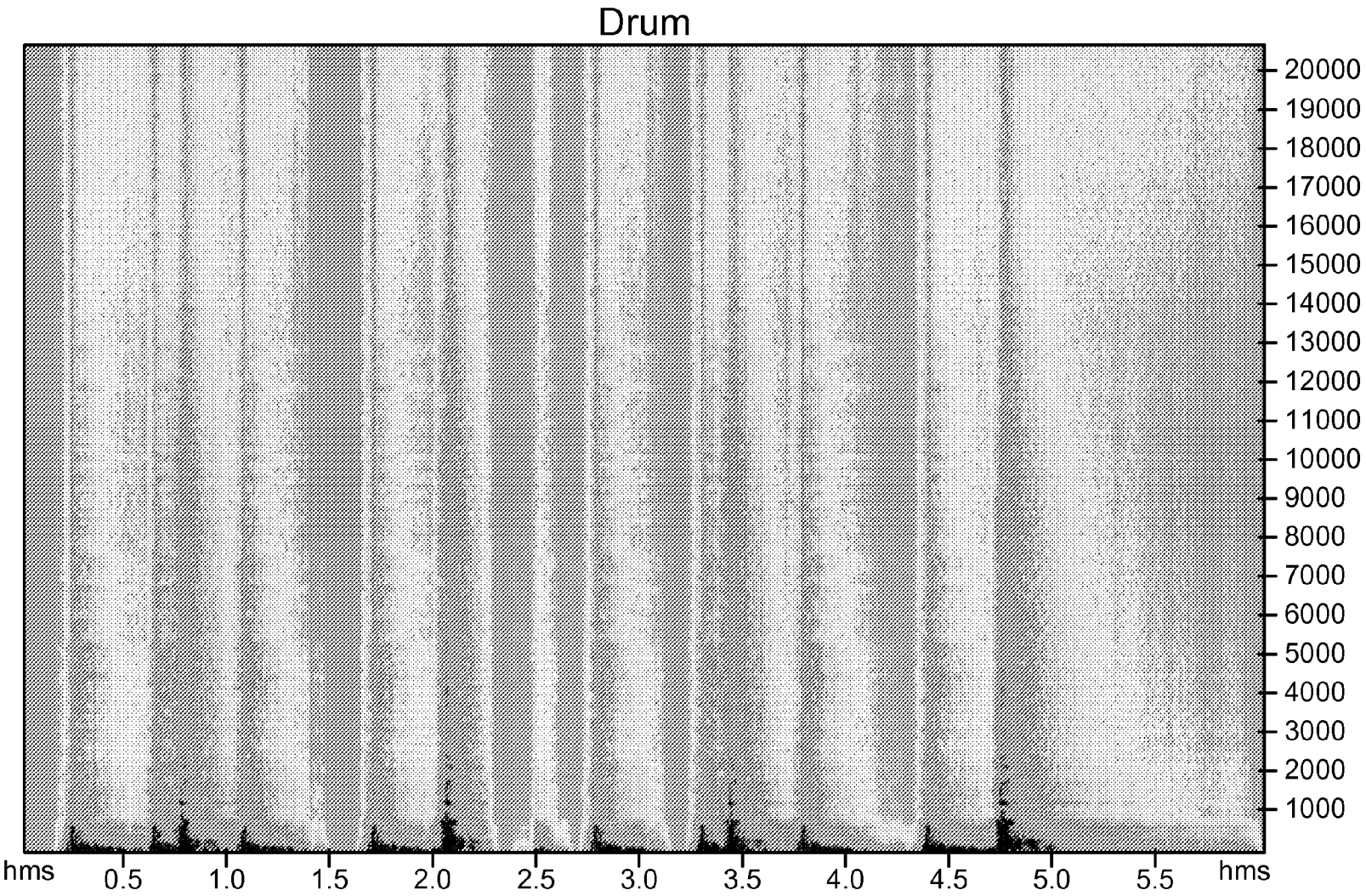
Figure 46:
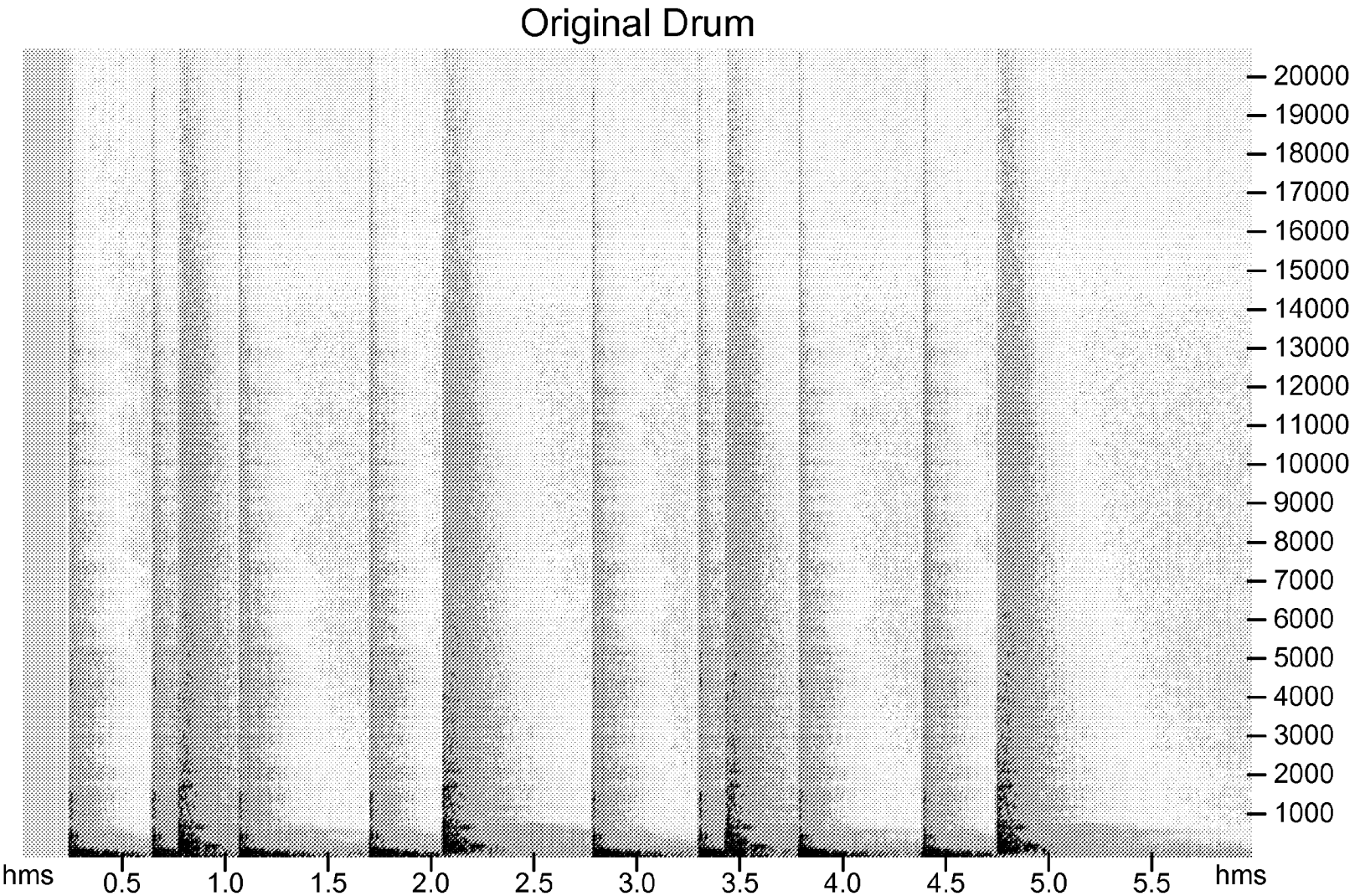

FIGS. 40-46 are spectrograms that demonstrate results of applying an onset detection method as described herein to composite signal example 2 (a piano and flute playing in the same octave, and a drum). FIG. 40 shows a spectrogram of the original composite signal. FIG. 41 shows a spectrogram of the piano component reconstructed without post-processing. FIG. 42 shows a spectrogram of the piano component reconstructed with post-processing. FIG. 43 shows a spectrogram of the flute component reconstructed without post-processing. FIG. 44 shows a spectrogram of the flute component reconstructed with post-processing. FIGS. 45 and 46 show spectrograms of the reconstructed and original drum component, respectively.

Figures 47A, 47B:
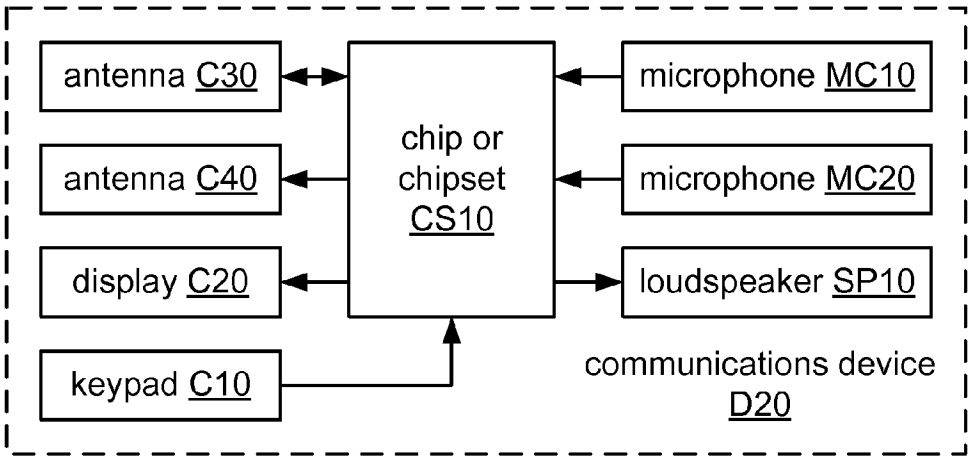
FIG. 47A shows results of evaluating the performance of an onset detection method as applied to a piano-flute test case.
FIG. 47B shows a block diagram of a communications device D20.

FIG. 47A shows results of evaluating the performance of an onset detection method as described herein as applied to a piano-flute test case, using evaluation metrics described by Vincent et al. (Performance Measurement in Blind Audio Source Separation, IEEE Trans. ASSP, vol. 14, no. 4, July 2006, pp. 1462-1469). The signal-to-interference ratio (SIR) is a measure of the suppression of the unwanted source and is defined as $10 \log_{10}(\|s_{target}\|^2/\|e_{interf}\|^2)$. The signal-to-artifact ratio (SAR) is a measure of artifacts (such as musical noise) that have been introduced by the separation process and is defined as $10 \log^{10}(\|s_{target}+e_{interf}\|^2/\|e_{artif}\|^2)$. The signal-to-distortion ratio (SDR) is an overall measure of performance, as it accounts for both of the above criteria, and is defined as $10 \log^{10}(\|s_{target}\|^2/\|e_{artif}+e_{interf}\|^2)$. This quantitative evaluation shows robust source separation with acceptable level of artifact generation.

An EM algorithm may be used to generate an initial basis function matrix and/or to update the basis function matrix (e.g., based on the activation coefficient vectors). An example of update rules for an EM approach is now described. Given a spectrogram $V_{ft}$, we wish to estimate spectral basis vectors $P(f|z)$ and weight vectors $P_t(z)$ for each time frame. These distributions give us a matrix decomposition.

We apply the EM algorithm as follows: First, randomly initialize weight vectors $P_t(z)$ and spectral basis vectors $P(f|z)$. Then iterate between the following steps until convergence: 1) Expectation (E) step—estimate the posterior distribution $P_t(z|f)$, given the spectral basis vectors $P(f|z)$ and the weight vectors $P_t(z)$. This estimation may be expressed as follows:

$$P_t(z \mid f) = \frac{P_t(f \mid z)P(z)}{\sum_z P_t(f \mid z)P(z)}.$$

2) Maximization (M) step—estimate the weight vectors $P_t(z)$ and the spectral basis vectors $P(f|z)$, given the posterior distribution $P_t(z|f)$. Estimation of the weight vectors may be expressed as follows:

$$P_t(z) = \frac{\sum_f V_{ft} P_t(z \mid f)}{\sum_z \sum_f V_{ft} P_t(z \mid f)}.$$

Estimation of the spectral basis vector may be expressed as follows:

$$P(f \mid z) = \frac{\sum_f V_{ft} P_t(z \mid f)}{\sum_t \sum_f V_{ft} P_t(z \mid f)}.$$

It may be desirable to perform a method as described herein within a portable audio sensing device that has an array of two or more microphones configured to receive acoustic signals. Examples of a portable audio sensing device that may be implemented to include such an array and may be used for audio recording and/or voice communications applications include a telephone handset (e.g., a cellular telephone handset); a wired or wireless headset (e.g., a Bluetooth headset); a handheld audio and/or video recorder; a personal media player configured to record audio and/or video content; a personal digital assistant (PDA) or other handheld computing device; and a notebook computer, laptop computer, netbook computer, tablet computer, or other portable computing device. The class of portable computing devices currently includes devices having names such as laptop computers, notebook computers, netbook computers, ultra-portable computers, tablet computers, mobile Internet devices, smartbooks, and smartphones. Such a device may have a top panel that includes a display screen and a bottom panel that may include a keyboard, wherein the two panels may be connected in a clamshell or other hinged relationship. Such a device may be similarly implemented as a tablet computer that includes a touchscreen display on a top surface. Other examples of audio sensing devices that may be constructed to perform such a method and may be used for audio recording and/or voice communications applications include television displays, set-top boxes, and audio- and/or video-conferencing devices.

FIG. 47B shows a block diagram of a communications device D20. Device D20 includes a chip or chipset CS10 (e.g., a mobile station modem (MSM) chipset) that includes an implementation of apparatus A100 (or MF100) as described herein. Chip/chipset CS10 may include one or more processors, which may be configured to execute all or part of the operations of apparatus A100 or MF100 (e.g., as instructions).

Chip/chipset CS10 includes a receiver which is configured to receive a radio-frequency (RF) communications signal (e.g., via antenna C40) and to decode and reproduce (e.g., via loudspeaker SP10) an audio signal encoded within the RF signal. Chip/chipset CS10 also includes a transmitter which is configured to encode an audio signal that is based on an output signal produced by apparatus A100 and to transmit an RF communications signal (e.g., via antenna C40) that describes the encoded audio signal. For example, one or more processors of chip/chipset CS10 may be configured to perform a decomposition operation as described above on one or more channels of the multichannel audio input signal such that the encoded audio signal is based on the decomposed signal. In this example, device D20 also includes a keypad C10 and display C20 to support user control and interaction.

Figure 48:
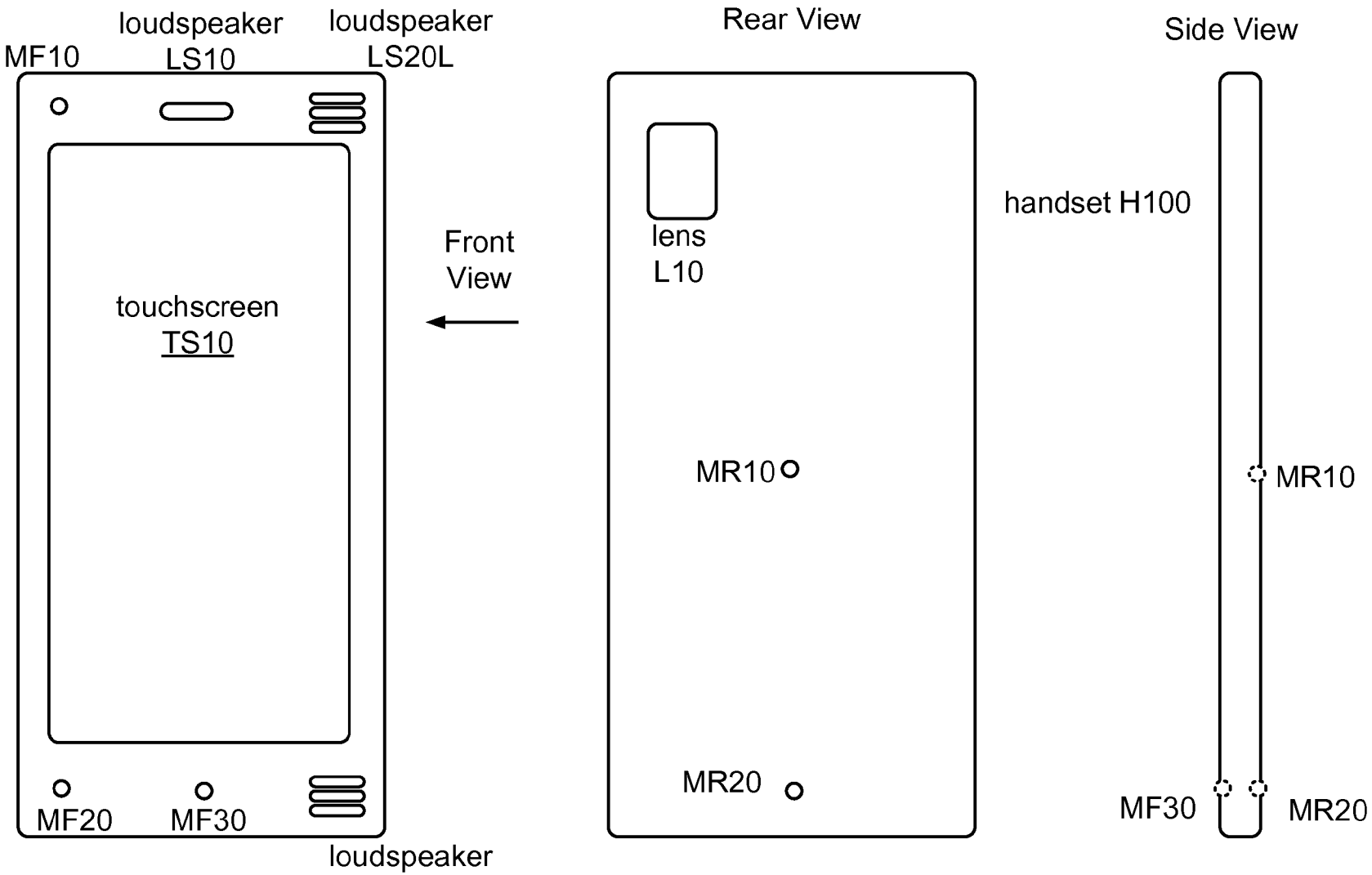
FIG. 48 shows front, rear, and side views of a handset H100.

FIG. 48 shows front, rear, and side views of a handset H100 (e.g., a smartphone) that may be implemented as an instance of device D20. Handset H100 includes three microphones MF10, MF20, and MF30 arranged on the front face; and two microphones MR10 and MR20 and a camera lens L10 arranged on the rear face. A loudspeaker LS10 is arranged in the top center of the front face near microphone MF10, and two other loudspeakers LS20L, LS20R are also provided (e.g., for speakerphone applications). A maximum distance between the microphones of such a handset is typically about ten or twelve centimeters. It is expressly disclosed that applicability of systems, methods, and apparatus disclosed herein is not limited to the particular examples noted herein.

The methods and apparatus disclosed herein may be applied generally in any transceiving and/or audio sensing application, including mobile or otherwise portable instances of such applications and/or sensing of signal components from far-field sources. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

An apparatus as disclosed herein (e.g., apparatus A100, A300, A310, A700, and MF100) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of the elements of the apparatus may be implemented within the same array or arrays. Such an array or arrays may be implemented within one or more chips (for example, within a chipset including two or more chips).

One or more elements of the various implementations of the apparatus disclosed herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a music decomposition procedure as described herein, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general-purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., method M100 and other methods disclosed by way of description of the operation of the various apparatus described herein) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor-readable storage medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein (e.g., apparatus A100 or MF100) may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of decomposing an audio signal, said method comprising:

for each of a plurality of segments in time of the audio signal, calculating a corresponding signal representation over a range of frequencies; and based on the plurality of calculated signal representations and on a plurality of basis functions, calculating a vector of activation coefficients, wherein each activation coefficient of the vector corresponds to a different basis function of the plurality of basis functions, and wherein each of the plurality of basis functions comprises a first corresponding signal representation over the range of frequencies and a second corresponding signal representation over the range of frequencies that is different than said first corresponding signal representation.

2. The method according to claim 1, wherein, for at least one of the plurality of segments, a ratio of (A) total energy at frequencies above two hundred Hertz to (B) total energy over the range of frequencies is higher in the calculated corresponding signal representation than in the corresponding segment.

3. The method according to claim 1, wherein, for at least one of the plurality of segments, a level of a modulation in the calculated corresponding signal representation is lower than a level of said modulation in the corresponding segment, said modulation being at least one among an amplitude modulation and a pitch modulation.

4. The method according to claim 3, wherein, for said at least one of the plurality of segments, said calculating the corresponding signal representation comprises recording a measure of said level of the modulation.

5. The method according to claim 1, wherein at least fifty percent of the activation coefficients of the vector are zero-valued.

6. The method according to claim 1, wherein said calculating the vector of activation coefficients comprises calculating a solution to a system of linear equations of the form Bf=y, wherein y is a vector that includes the plurality of calculated signal representations, B is a matrix that includes the plurality of basis functions, and f is the vector of activation coefficients.

7. The method according to claim 1, wherein said calculating the vector of activation coefficients comprises minimizing an L1 norm of the vector of activation coefficients.

8. The method according to claim 1, wherein at least one of the plurality of segments is separated in the audio signal from each other segment of the plurality of segments by at least one segment of the audio signal that is not among said plurality of segments.

9. The method according to claim 1, wherein, for each basis function of the plurality of basis functions:

said first corresponding signal representation describes a first timbre of a corresponding musical instrument over the range of frequencies, and said second corresponding signal representation describes a second timbre of the corresponding musical instrument, over the range of frequencies, that is different than the first timbre.

10. The method according to claim 9, wherein, for each basis function of the plurality of basis functions:

said first timbre is a timbre during a first time interval of a corresponding note, and said first timbre is a timbre during a second time interval of the corresponding note that is different than the first time interval.

11. The method according to claim 1, wherein, for each of the plurality of segments, the corresponding signal representation is based on a corresponding frequency-domain vector.

12. The method according to claim 1, wherein said method comprises, prior to said calculating the vector of activation coefficients, and based on information from at least one of the plurality of segments, selecting the plurality of basis functions from a larger set of basis functions.

13. The method according to claim 1, wherein said method comprises:

for at least one of the plurality of segments, calculating a corresponding signal representation in a nonlinear frequency domain; and prior to said calculating the vector of activation coefficients, and based on the calculated signal representation in the nonlinear frequency domain and on a second plurality of basis functions, calculating a second vector of activation coefficients, wherein each of the second plurality of basis functions comprises a corresponding signal representation in the nonlinear frequency domain.

14. The method according to claim 13, wherein said method comprises, based on information from said calculated second vector of activation coefficients, selecting the plurality of basis functions from among an inventory of basis functions.

15. An apparatus for decomposing an audio signal, said apparatus comprising:

means for calculating, for each of a plurality of segments in time of the audio signal, a corresponding signal representation over a range of frequencies; and means for calculating a vector of activation coefficients, based on the plurality of calculated signal representations and on a plurality of basis functions, wherein each activation coefficient of the vector corresponds to a different basis function of the plurality of basis functions, and wherein each of the plurality of basis functions comprises a first corresponding signal representation over the range of frequencies and a second corresponding signal representation over the range of frequencies that is different than said first corresponding signal representation.

16. The apparatus according to claim 15, wherein, for at least one of the plurality of segments, a ratio of (A) total energy at frequencies above two hundred Hertz to (B) total energy over the range of frequencies is higher in the calculated corresponding signal representation than in the corresponding segment.

17. The apparatus according to claim 15, wherein, for at least one of the plurality of segments, a level of a modulation in the calculated corresponding signal representation is lower than a level of said modulation in the corresponding segment, said modulation being at least one among an amplitude modulation and a pitch modulation.

18. The apparatus according to claim 17, wherein said means for calculating the corresponding signal representation comprises means for recording a measure of said level of the modulation for said at least one of the plurality of segments.

19. The apparatus according to claim 15, wherein at least fifty percent of the activation coefficients of the vector are zero-valued.

20. The apparatus according to claim 15, wherein said means for calculating the vector of activation coefficients comprises means for calculating a solution to a system of linear equations of the form Bf=y, wherein y is a vector that includes the plurality of calculated signal representations, B is a matrix that includes the plurality of basis functions, and f is the vector of activation coefficients.

21. The apparatus according to claim 15, wherein said means for calculating the vector of activation coefficients comprises means for minimizing an L1 norm of the vector of activation coefficients.

22. The apparatus according to claim 15, wherein at least one of the plurality of segments is separated in the audio signal from each other segment of the plurality of segments by at least one segment of the audio signal that is not among said plurality of segments.

23. The apparatus according to claim 15, wherein, for each basis function of the plurality of basis functions:

said first corresponding signal representation describes a first timbre of a corresponding musical instrument over the range of frequencies, and said second corresponding signal representation describes a second timbre of the corresponding musical instrument, over the range of frequencies, that is different than the first timbre.

24. The apparatus according to claim 23, wherein, for each basis function of the plurality of basis functions:

said first timbre is a timbre during a first time interval of a corresponding note, and said first timbre is a timbre during a second time interval of the corresponding note that is different than the first time interval.

25. The apparatus according to claim 15, wherein, for each of the plurality of segments, the corresponding signal representation is based on a corresponding frequency-domain vector.

26. The apparatus according to claim 15, wherein said apparatus comprises means for selecting the plurality of basis functions from a larger set of basis functions, prior to said calculating the vector of activation coefficients and based on information from at least one of the plurality of segments.

27. The apparatus according to claim 15, wherein said means for selecting the plurality of basis functions from a larger set of basis functions comprises:

means for calculating, for at least one of the plurality of segments, a corresponding signal representation in a nonlinear frequency domain; and means for calculating a second vector of activation coefficients, prior to said calculating the vector of activation coefficients and based on the calculated signal representation in the nonlinear frequency domain and on a second plurality of basis functions, wherein each of the second plurality of basis functions comprises a corresponding signal representation in the nonlinear frequency domain.

28. The apparatus according to claim 27, wherein said apparatus comprises means for selecting the plurality of basis functions from among an inventory of basis functions, based on information from said calculated second vector of activation coefficients.

29. An apparatus for decomposing an audio signal, said apparatus comprising:

a transform module configured to calculate, for each of a plurality of segments in time of the audio signal, a corresponding signal representation over a range of frequencies; and a coefficient vector calculator configured to calculate a vector of activation coefficients, based on the plurality of calculated signal representations and on a plurality of basis functions, wherein each activation coefficient of the vector corresponds to a different basis function of the plurality of basis functions, and wherein each of the plurality of basis functions comprises a first corresponding signal representation over the range of frequencies and a second corresponding signal representation over the range of frequencies that is different than said first corresponding signal representation.

30. The apparatus according to claim 29, wherein, for at least one of the plurality of segments, a ratio of (A) total energy at frequencies above two hundred Hertz to (B) total energy over the range of frequencies is higher in the calculated corresponding signal representation than in the corresponding segment.

31. The apparatus according to claim 29, wherein, for at least one of the plurality of segments, a level of a modulation in the calculated corresponding signal representation is lower than a level of said modulation in the corresponding segment, said modulation being at least one among an amplitude modulation and a pitch modulation.

32. The apparatus according to claim 31, wherein said apparatus includes a modulation level calculator configured to calculate a measure of said level of the modulation for said at least one of the plurality of segments.

33. The apparatus according to claim 29, wherein at least fifty percent of the activation coefficients of the vector are zero-valued.

34. The apparatus according to claim 29, wherein said coefficient vector calculator is configured to calculate a solution to a system of linear equations of the form $Bf=y$, wherein y is a vector that includes the plurality of calculated signal representations, B is a matrix that includes the plurality of basis functions, and f is the vector of activation coefficients.

35. The apparatus according to claim 29, wherein said coefficient vector calculator is configured to minimize an L1 norm of the vector of activation coefficients.

36. The apparatus according to claim 29, wherein at least one of the plurality of segments is separated in the audio signal from each other segment of the plurality of segments by at least one segment of the audio signal that is not among said plurality of segments.

37. The apparatus according to claim 29, wherein, for each basis function of the plurality of basis functions:

said first corresponding signal representation describes a first timbre of a corresponding musical instrument over the range of frequencies, and said second corresponding signal representation describes a second timbre of the corresponding musical instrument, over the range of frequencies, that is different than the first timbre.

38. The apparatus according to claim 37, wherein, for each basis function of the plurality of basis functions:

said first timbre is a timbre during a first time interval of a corresponding note, and said first timbre is a timbre during a second time interval of the corresponding note that is different than the first time interval.

39. The apparatus according to claim 29, wherein, for each of the plurality of segments, the corresponding signal representation is based on a corresponding frequency-domain vector.

40. The apparatus according to claim 29, wherein said apparatus comprises an inventory reduction module configured to select the plurality of basis functions from a larger set of basis functions, prior to said calculating the vector of activation coefficients and based on information from at least one of the plurality of segments.

41. The apparatus according to claim 29, wherein said inventory reduction module comprises:

a second transform module configured to calculate, for at least one of the plurality of segments, a corresponding signal representation in a nonlinear frequency domain; and a second coefficient vector calculator configured to calculate a second vector of activation coefficients, prior to said calculating the vector of activation coefficients and based on the calculated signal representation in the nonlinear frequency domain and on a second plurality of basis functions, wherein each of the second plurality of basis functions comprises a corresponding signal representation in the nonlinear frequency domain.

42. The apparatus according to claim 41, wherein said apparatus comprises a basis function selector configured to select the plurality of basis functions from among an inventory of basis functions, based on information from said calculated second vector of activation coefficients.

43. A non-transitory machine-readable storage medium comprising tangible features that when read by a machine cause the machine to:

calculate, for each of a plurality of segments in time of the audio signal, a corresponding signal representation over a range of frequencies; and calculate a vector of activation coefficients, based on the plurality of calculated signal representations and on a plurality of basis functions, wherein each activation coefficient of the vector corresponds to a different basis function of the plurality of basis functions, and wherein each of the plurality of basis functions comprises a first corresponding signal representation over the range of frequencies and a second corresponding signal representation over the range of frequencies that is different than said first corresponding signal representation.

* * * * *